US008567070B2

(12) United States Patent
Rowlay et al.

(10) Patent No.: US 8,567,070 B2
(45) Date of Patent: Oct. 29, 2013

(54) UTILITY KNIFE WITH BLADE SNAPPER

(75) Inventors: Stephen Rowlay, Sheffield (GB); Edward Iliffe, Worksop (GB)

(73) Assignee: Stanley Black & Decker, Inc., New Britain, CT (US)

( * ) Notice: Subject to any disclaimer, the term of this patent is extended or adjusted under 35 U.S.C. 154(b) by 675 days.

(21) Appl. No.: 12/365,718

(22) Filed: Feb. 4, 2009

(65) Prior Publication Data

US 2010/0037468 A1 Feb. 18, 2010

Related U.S. Application Data

(60) Provisional application No. 61/089,312, filed on Aug. 15, 2008.

(51) Int. Cl.

| | |
|---|---|
| ***F41C 27/18*** | (2006.01) |
| ***F41B 13/02*** | (2006.01) |
| ***B26B 3/06*** | (2006.01) |
| ***B26B 1/00*** | (2006.01) |

(52) U.S. Cl.
USPC ..... 30/162; 30/335

(58) Field of Classification Search
USPC ..... 30/162, 335, 320–321, 124–125
See application file for complete search history.

(56) References Cited

U.S. PATENT DOCUMENTS

| | | | | | |
|---|---|---|---|---|---|
| 3,316,635 | A | * | 5/1967 | West et al. | 30/162 |
| 3,453,729 | A | * | 7/1969 | Larson | 30/162 |
| 3,577,637 | A | | 5/1971 | Braginetz | |
| 3,593,417 | A | | 7/1971 | West et al. | |
| 4,063,356 | A | * | 12/1977 | Hepworth | 30/162 |
| 4,103,421 | A | * | 8/1978 | Quenot | 30/162 |
| 4,170,062 | A | * | 10/1979 | Machida | 30/162 |
| 4,200,977 | A | * | 5/1980 | Kageyama et al. | 30/162 |
| 4,226,020 | A | * | 10/1980 | Quenot et al. | 30/162 |
| 4,233,734 | A | * | 11/1980 | Bies | 30/162 |
| RE30,733 | E | | 9/1981 | Quenot | |

(Continued)

FOREIGN PATENT DOCUMENTS

| | | |
|---|---|---|
| EP | 0 400 800 A1 | 12/1990 |
| GB | 1 547 002 A | 6/1979 |

(Continued)

OTHER PUBLICATIONS

Extended Search Report as issued for European Patent Application No. 09167952.2, dated Dec. 30, 2010.

(Continued)

*Primary Examiner* — Ghassem Alie
*Assistant Examiner* — Bharat C Patel
(74) *Attorney, Agent, or Firm* — Pillsbury Winthrop Shaw Pittman LLP

(57) ABSTRACT

A knife includes a body, a retractable blade slider, a blade snapper, and a manually engageable lock. The retractable blade slider is constructed and arranged to position a multi-blade blade assembly at a position of use wherein at least a forward most blade projects through an opening at one end of the body, and to retract the blade assembly into the body. The blade snapper is removably locked to the body. The blade snapper is constructed and arranged snap-off at least one or more blades from the blade assembly. The manually engageable lock is constructed and arranged to move between a lock position and an unlock position, wherein the movement of the manually engageable lock to the unlock position releases the blade snapper from the body.

11 Claims, 50 Drawing Sheets

(56) References Cited

U.S. PATENT DOCUMENTS

| | | | | |
|---|---|---|---|---|
| 4,517,741 | A | 5/1985 | Castelluzzo | |
| 4,586,256 | A | 5/1986 | Weimann | |
| 4,615,118 | A | 10/1986 | Ihata | |
| 4,794,692 | A | 1/1989 | Wang | |
| 5,014,429 | A | 5/1991 | McNamara | |
| 5,093,993 | A * | 3/1992 | Nishiyama | 30/124 |
| 5,269,063 | A | 12/1993 | Okada | |
| 5,301,428 | A | 4/1994 | Wilcox | |
| 5,502,896 | A * | 4/1996 | Chen | 30/162 |
| D436,825 | S | 1/2001 | Chen | |
| 6,192,589 | B1 | 2/2001 | Martone et al. | |
| 6,226,873 | B1 | 5/2001 | Okumura | |
| 6,510,612 | B1 | 1/2003 | Cybulski | |
| 6,553,674 | B1 | 4/2003 | Budrow | |
| 6,574,872 | B2 | 6/2003 | Roberts et al. | |
| 6,718,640 | B1 | 4/2004 | John | |
| 6,745,474 | B1 | 6/2004 | Huang | |
| 6,938,345 | B2 | 9/2005 | Yu | |
| 6,971,178 | B2 | 12/2005 | Rowlay | |
| 7,107,687 | B2 * | 9/2006 | Okada | 30/162 |
| D549,068 | S | 8/2007 | Groten | |
| 7,296,354 | B2 | 11/2007 | Van Deursen et al. | |
| 2005/0050734 | A1 * | 3/2005 | Kesinger | 30/162 |
| 2006/0059695 | A1 * | 3/2006 | Levine et al. | 30/162 |
| 2006/0130340 | A1 | 6/2006 | Berns | |
| 2006/0185172 | A1 | 8/2006 | Marshall et al. | |
| 2007/0011882 | A1 | 1/2007 | Ping | |
| 2007/0234573 | A1 | 10/2007 | Johnson et al. | |
| 2007/0294896 | A1 | 12/2007 | Brown et al. | |
| 2008/0256808 | A1 * | 10/2008 | Levine et al. | 30/162 |

FOREIGN PATENT DOCUMENTS

| | | | |
|---|---|---|---|
| JP | 52-112143 | U | 8/1977 |
| JP | 55-86846 | U | 6/1980 |
| JP | 08-052282 | A | 2/1996 |

OTHER PUBLICATIONS

Partial Search Report as issued for European Patent Application No. 09167952.2, dated Sep. 2, 2010.

Notice of Reasons for Rejection as issued for Japanese Patent Application No. 2009-185912, dated May 25, 2012.

* cited by examiner

UTILITY KNIFE WITH BLADE SNAPPER

The present application claims priority to U.S. Provisional Application Ser. No. 61/089,312, filed on Aug. 15, 2008, the entirety of which is hereby incorporated herein.

BACKGROUND OF THE INVENTION

Field of the Invention

The present invention relates generally to cutting devices, and, more particularly to a utility knives.

Cutting devices, such as utility knives, have been developed for use in various applications, such as, for example, construction, packaging and shipping, carpet installation, as well as other purposes.

Some utility knives include two mating halves secured to one another by various fastening mechanisms. A unitary blade is fixed between the two halves and can be released and replaced.

Other utility knives include a handle carrying a blade assembly comprising a plurality of snap-off blades. A slider carrying the blade assembly can be moved to extend at least the leading blade from one end of the handle. A plurality of break-lines formed in the blade assembly facilitate the snapping off of a used snap-off blade (e.g., that has become blunt or damaged through usage) from the snap-off blade assembly.

SUMMARY OF THE INVENTION

One aspect of the present invention provides a knife. The knife includes a body, a retractable blade slider, a blade snapper, and a manually engageable lock. The retractable blade slider is constructed and arranged to position a multi-blade blade assembly at a position of use wherein at least a forward most blade projects through an opening at one end of the body, and to retract the blade assembly into the body. The blade snapper is removably locked to the body. The blade snapper is constructed and arranged snap-off at least one or more blades from the blade assembly. The manually engageable lock is constructed and arranged to move between a lock position and an unlock position, wherein the movement of the manually engageable lock to the unlock position releases the blade snapper from the body.

Another aspect of the present invention provides a knife. The knife includes a body, a retractable blade slider, a cartridge, and a manually engageable lock. The retractable blade slider is constructed and arranged to position a multi-blade blade assembly at a position of use wherein at least a forward most blade projects through an opening at one end of the body, and to retract the blade assembly into the body. The cartridge is removably locked to the body. The cartridge, when removed from the body, is configured to receive a new blade assembly. The manually engageable lock is constructed and arranged to move between a lock position and an unlock position, wherein the movement of the manually engageable lock to the unlock position releases the cartridge from the body.

Another aspect of the present invention provides a knife. The knife includes a body, a retractable blade slider, a blade snapper, a cartridge, and a manually engageable lock. The retractable blade slider is constructed and arranged to position a multi-blade blade assembly at a position of use wherein at least a forward most blade projects through an opening at one end of the body, and to retract the blade assembly into the body. The blade snapper is removably locked to the body. The blade snapper is constructed and arranged snap-off at least one blade from the blade assembly. The cartridge is removably locked to the body. The cartridge, when removed from the body, is configured to receive a new blade assembly. The manually engageable lock is constructed and arranged to move between a lock position and an unlock position, wherein the movement of the manually engageable lock to the unlock position releases the cartridge and the blade snapper to enable either or both to be released from the body.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. However, each of the drawings herein can be considered to be drawn to scale, as examples of embodiments, it being understood that other scales and proportions are also contemplated and covered by this application. As used in the specification and in the claims, the singular form of "a", "an", and "the" include plural referents unless the context clearly dictates otherwise.

DETAILED DESCRIPTION OF THE INVENTION

Figure 22:
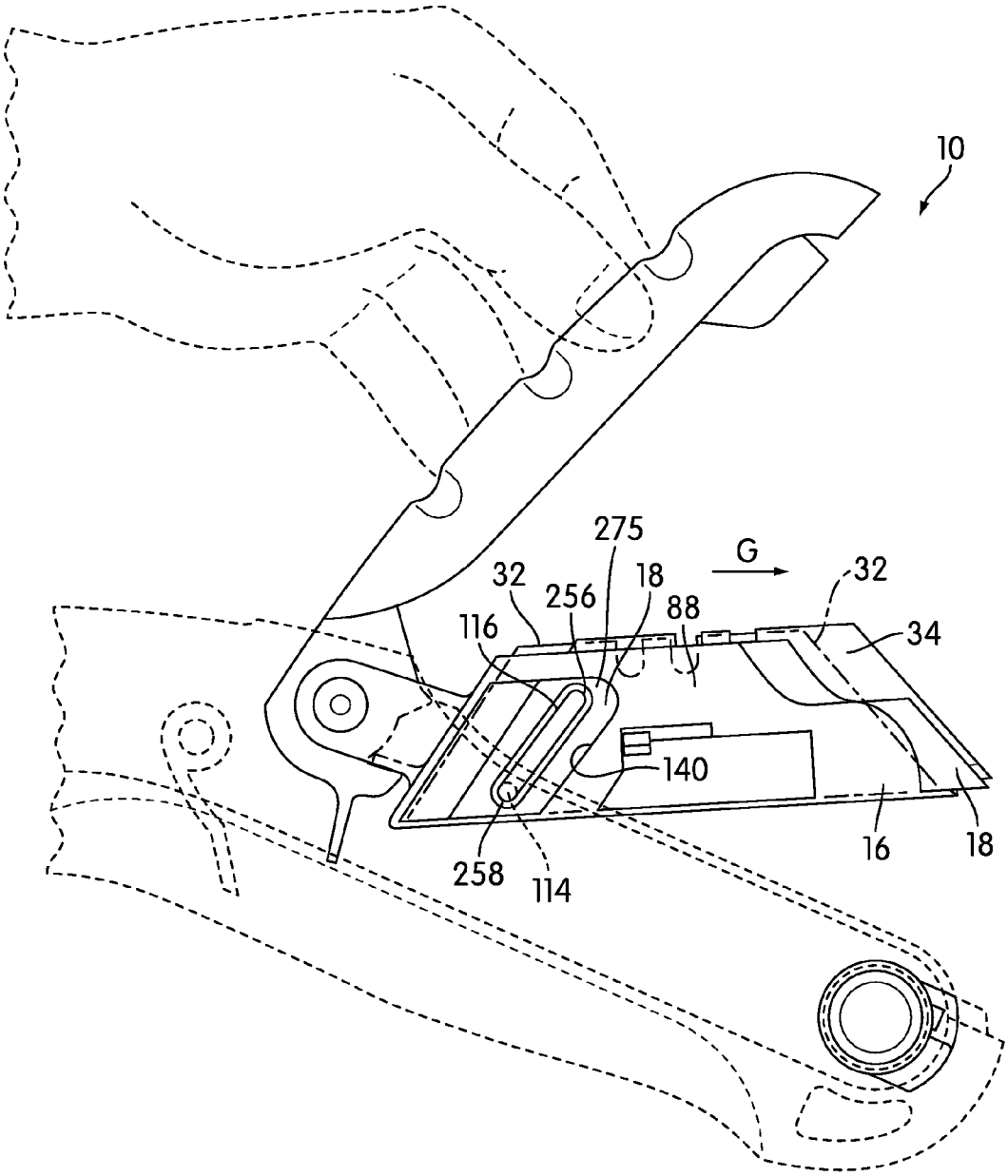
FIG. 22 is a partial side view of the utility knife, wherein a spare blade dispenser separates one of the spare blades from a plurality of spare blades in the spare blade carrier and presents the one separated blade to the user in accordance with a first embodiment of the present invention.
Figure 23:
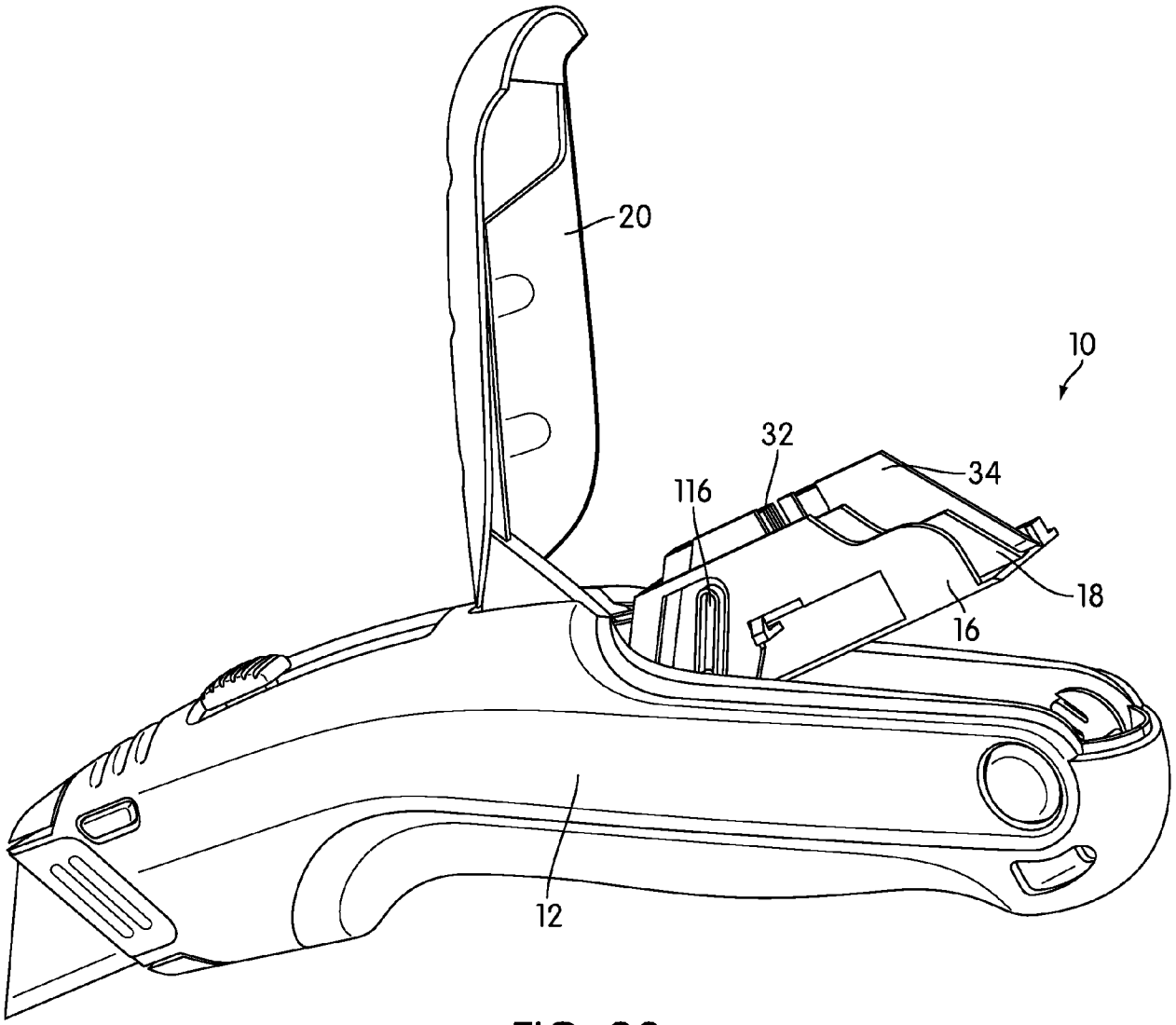
FIG. 23 is a partial side view of the utility knife, wherein the actuator is at a second position with the spare blade separated from the plurality of spare blades to present the one separated blade to the user in accordance with a first embodiment of the present invention.

FIGS. 1-6 show a utility knife 10 in accordance with an embodiment of the present invention. The utility knife 10 includes a handle 12, a blade holder assembly 14, a spare blade carrier 16, a spare blade dispenser 18, and a manually movable actuator 20. The utility knife 10 further comprises a clamp assembly 22 and a resilient blade wiper 24 (or wipers). In one embodiment, the handle 10 includes an opening 26 at a front end 28. In one embodiment, the blade holder assembly 14 is constructed and arranged to hold a blade 30 at a position of use, wherein the blade 30 projects through the opening 26 at the front end 28 of the handle 12, and to retract the blade 30 into the handle 12. The spare blade carrier 16 is configured to carry a plurality of spare blades 32 within the handle 12. The spare blade dispenser 18 is constructed to separate one of the spare blades 34 from the plurality 32 thereof and present the one separated blade 34 (as shown in FIGS. 22-23) to the user.

The manually movable actuator 20 is operatively associated with the blade dispenser, wherein movement of the manually movable actuator 20 moves the blade dispenser 18 to separate the one spare blade 34 from the plurality to present the one separated blade 34 to the user.

Figure 18:
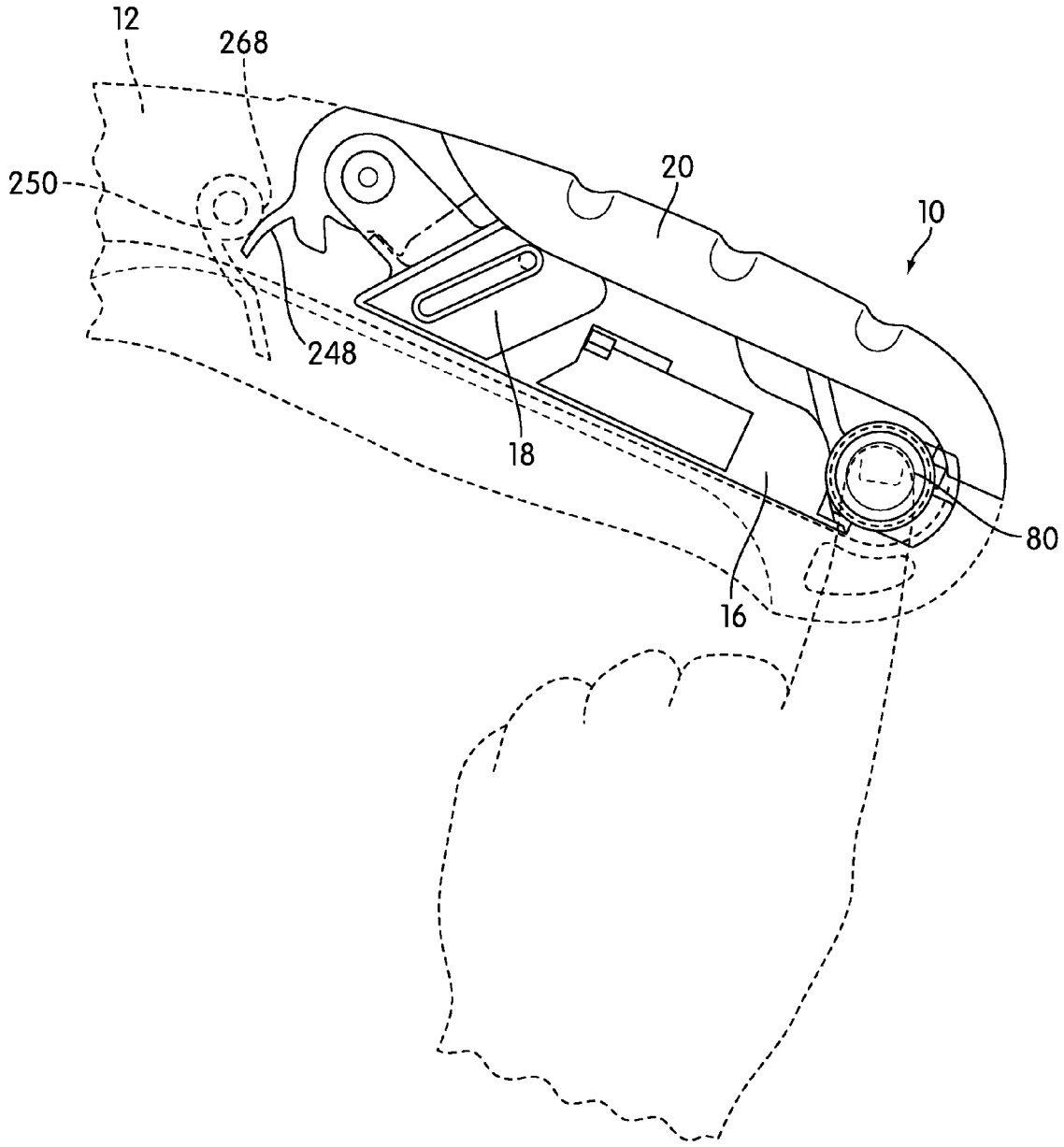
FIG. 18 is a partial side view of the utility knife, wherein a lock member is actuated to unlock a manually movable actuator from a first position in accordance with a first embodiment of the present invention.

In one embodiment, the actuator 20 is movable from a first position (as shown in FIG. 18) progressively toward to a second position (as shown in FIGS. 19-23).

The clamp assembly 22 is constructed and arranged to move between a clamp position wherein the clamp assembly 22 applies a clamp force to side surfaces 36 of the blade 30 and a release position wherein the clamp assembly 22 releases the clamping force.

The resilient blade wiper 24 is constructed and arranged to be positioned toward the front end 28 of the handle 12. The blade wiper 24 is constructed and arranged to remove debris from the side surfaces 36 of the blade 30 when the blade 30 is retracted into the handle 12.

The handle 12 is made of an appropriate metal (such as aluminum or steel) or other material of suitable strength and is comprised of two mating handle portions 48, 50. In one embodiment, the handle 12 is made of molded plastic material. The first handle portion 48 and the second handle portion 50 are secured together to form the handle 12 by a threaded or other type of conventional fastener 52. In one embodiment, the exterior surface of the handle 12 is suitably contoured to assist the user in holding onto the handle 12 and to facilitate employment of the blade 30 to perform various cutting tasks. Specifically, in one embodiment, the top portion of the handle 12 and the top portion of the manually movable actuator 20 are contoured or arranged, preferably slightly convexly, to more comfortably accommodate the palm of the user's hand.

Figure 6:
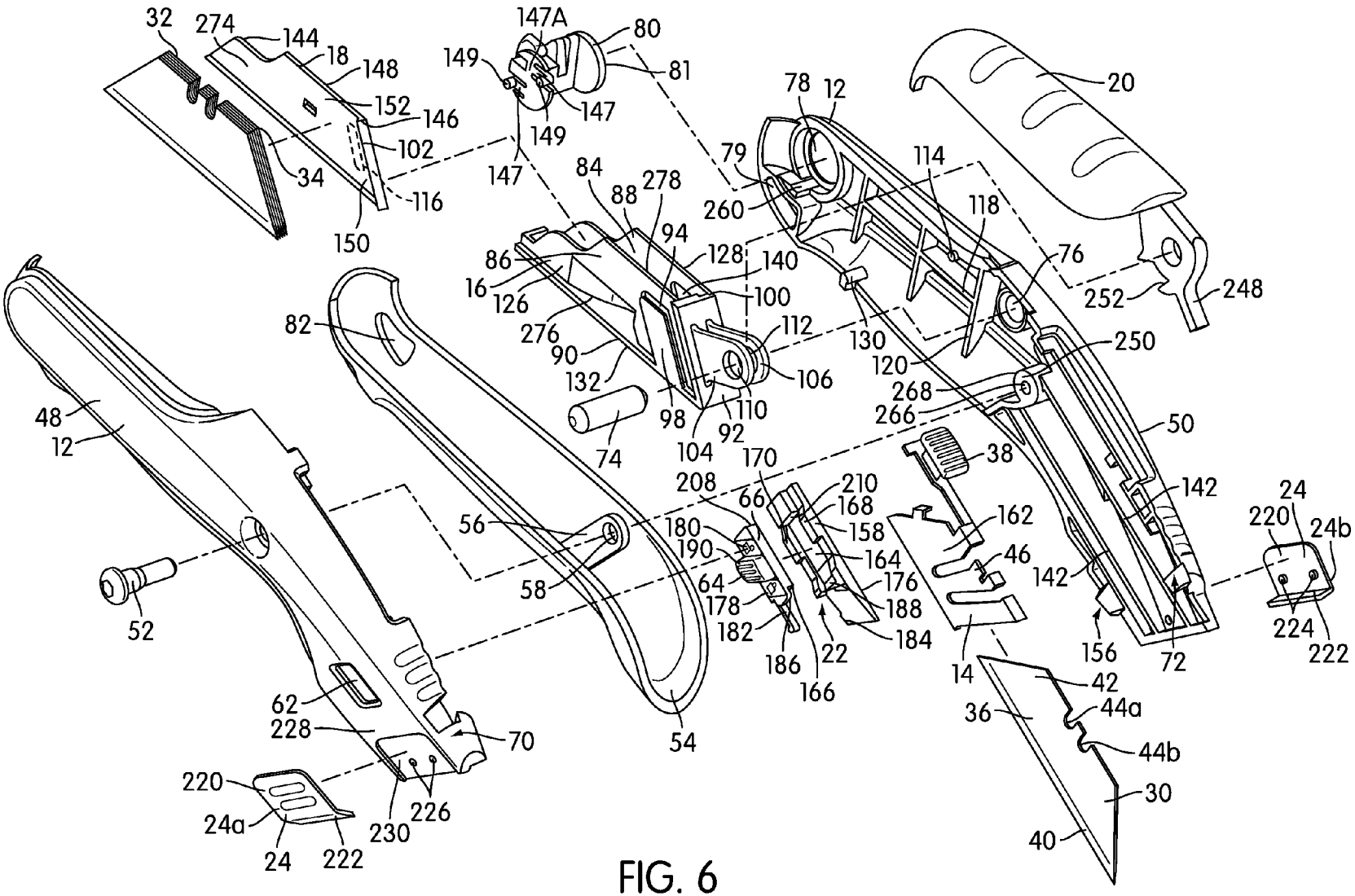
FIG. 6 is an exploded view of the utility knife in accordance with a first embodiment of the present invention.
Figure 8:
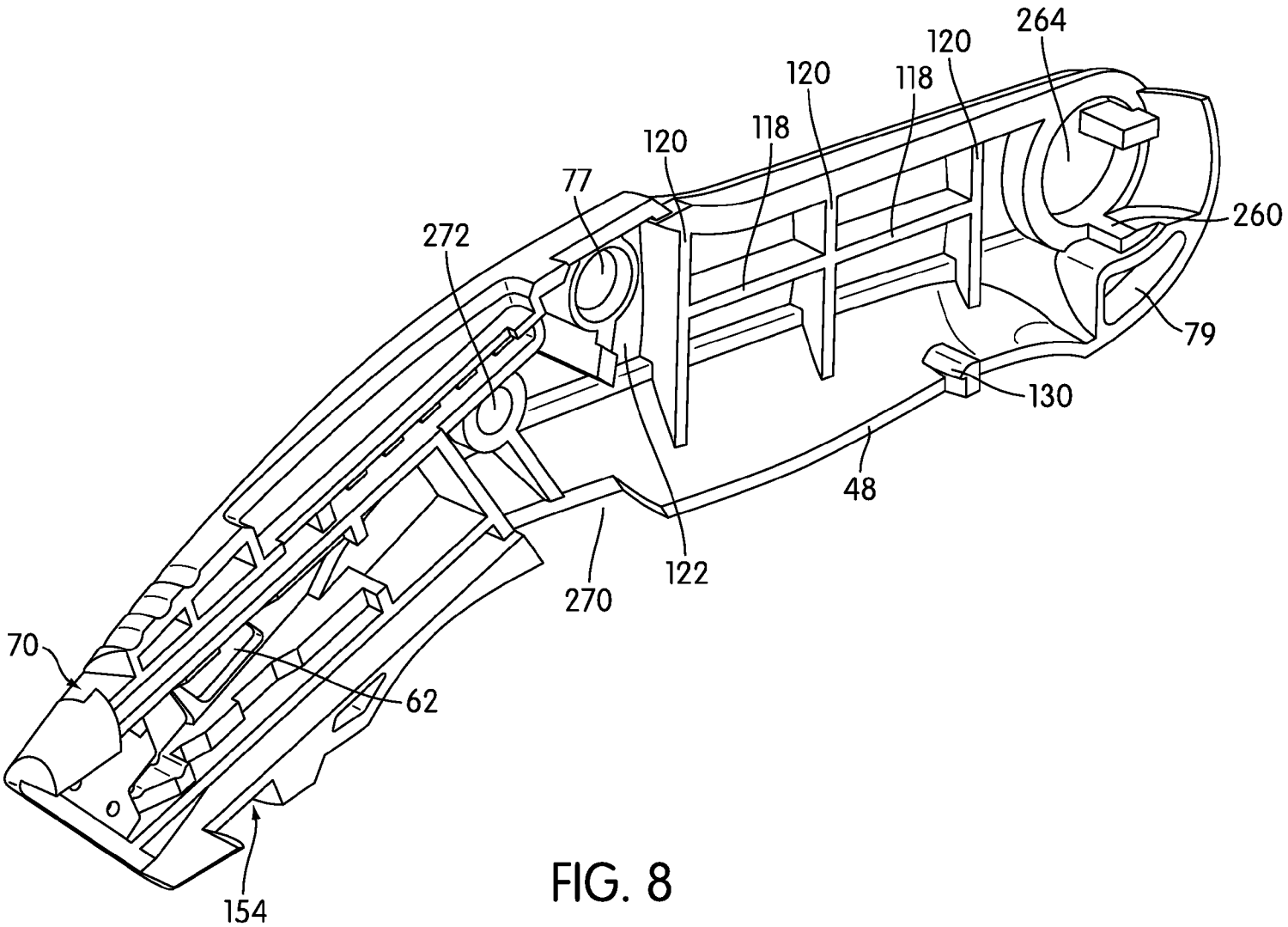
FIG. 8 is a left side perspective view of a first portion of the handle of the utility knife in accordance with a first embodiment of the present invention.

In one embodiment, as shown in FIG. 6, the first handle portion 48 provides a first cooperating interlocking structure 70 and the second handle portion 50 provides a second cooperating interlocking structure 72. The first and second cooperating interlocking structures 70, 72 are configured to interlock with one another to prevent relative pivotal movement (or other movement) of the first and second handle portions 48, 50 of the handle 12 away from one another (prevents separation). In one embodiment, the first handle portion 48 provides a third cooperating interlocking structure 154 (as shown in FIG. 8) and the second handle portion 50 provides a fourth cooperating interlocking structure 156. The third and fourth cooperating interlocking structures 154, 156 are also configured to interlock with one another to prevent relative pivotal movement or separation between the first and second handle portions 48, 50 of the handle 12. In one embodiment, the first and second cooperating interlocking structures 70, 72 are located near top surface portions of the first and second handle portions 48, 50 of the handle 12 respectively, while the third and fourth cooperating interlocking structures 154, 156 are located near bottom surface portions of the first and second handle portions 48, 50 of the handle 12 respectively.

Figure 1:
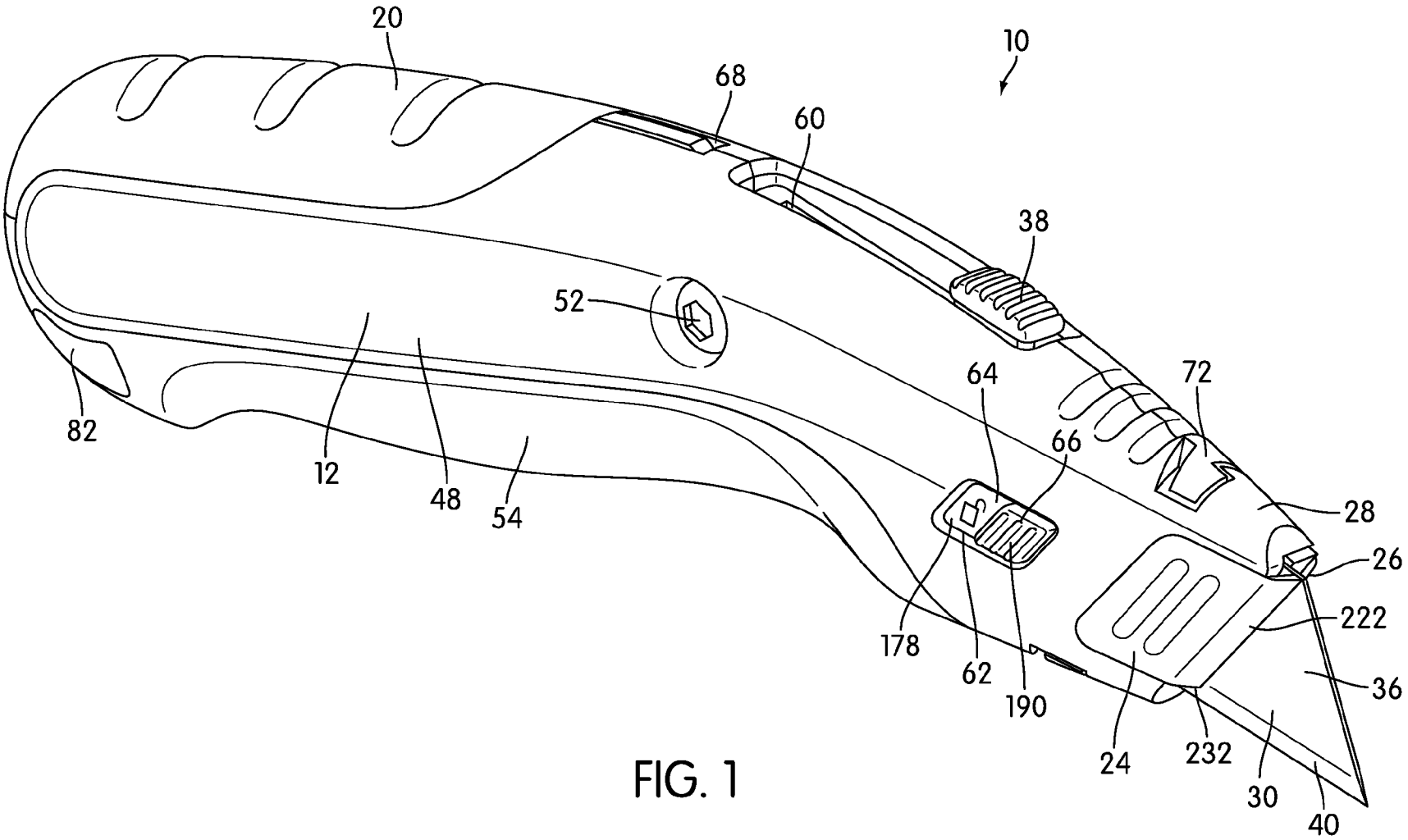
FIG. 1 is a right side perspective view of a utility knife with a blade at a position of use in accordance with a first embodiment of the present invention.
Figure 2:
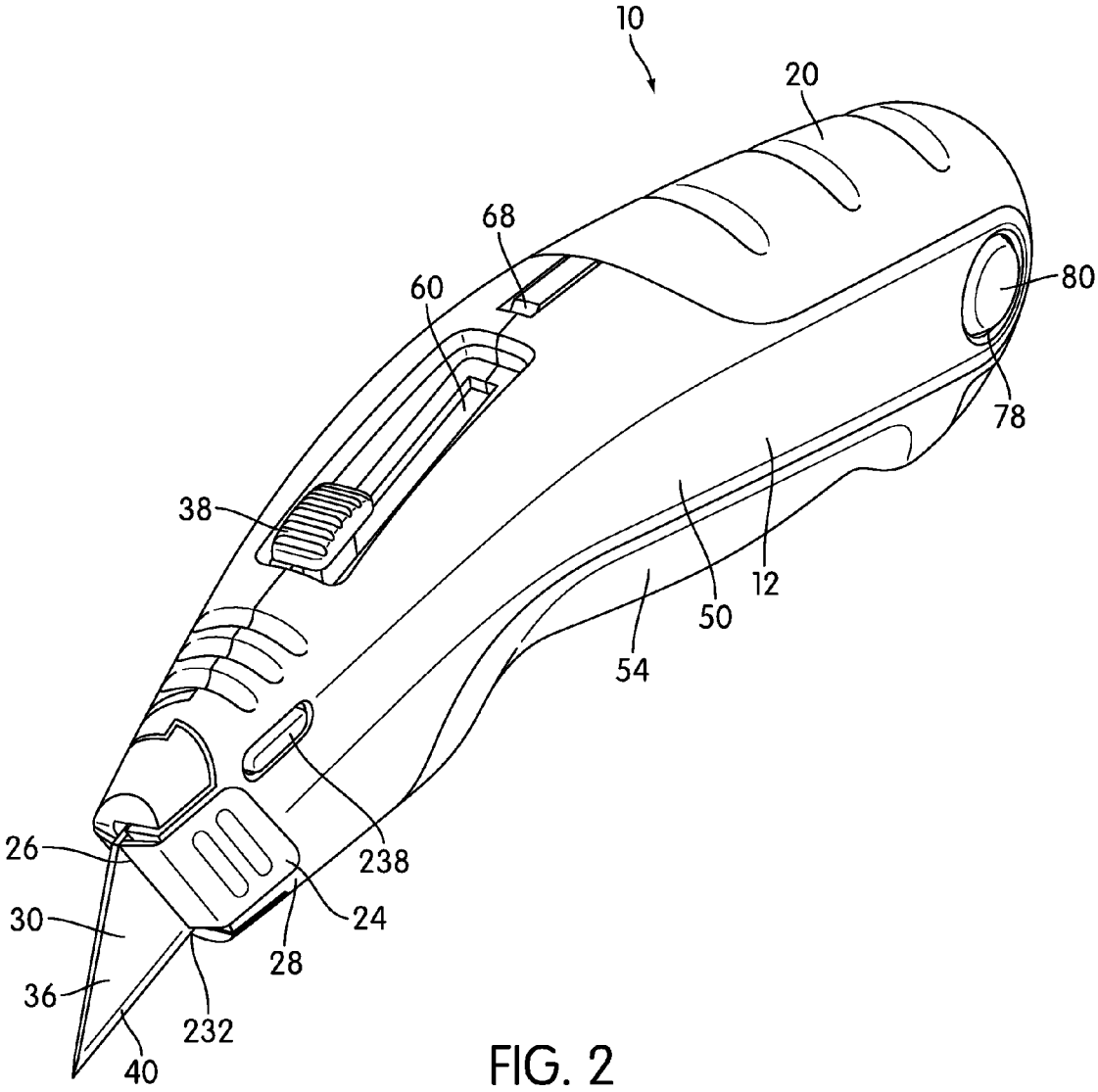
FIG. 2 is an upper left side perspective view of the utility knife with the blade at the position of use in accordance with a first embodiment of the present invention.
Figure 3:
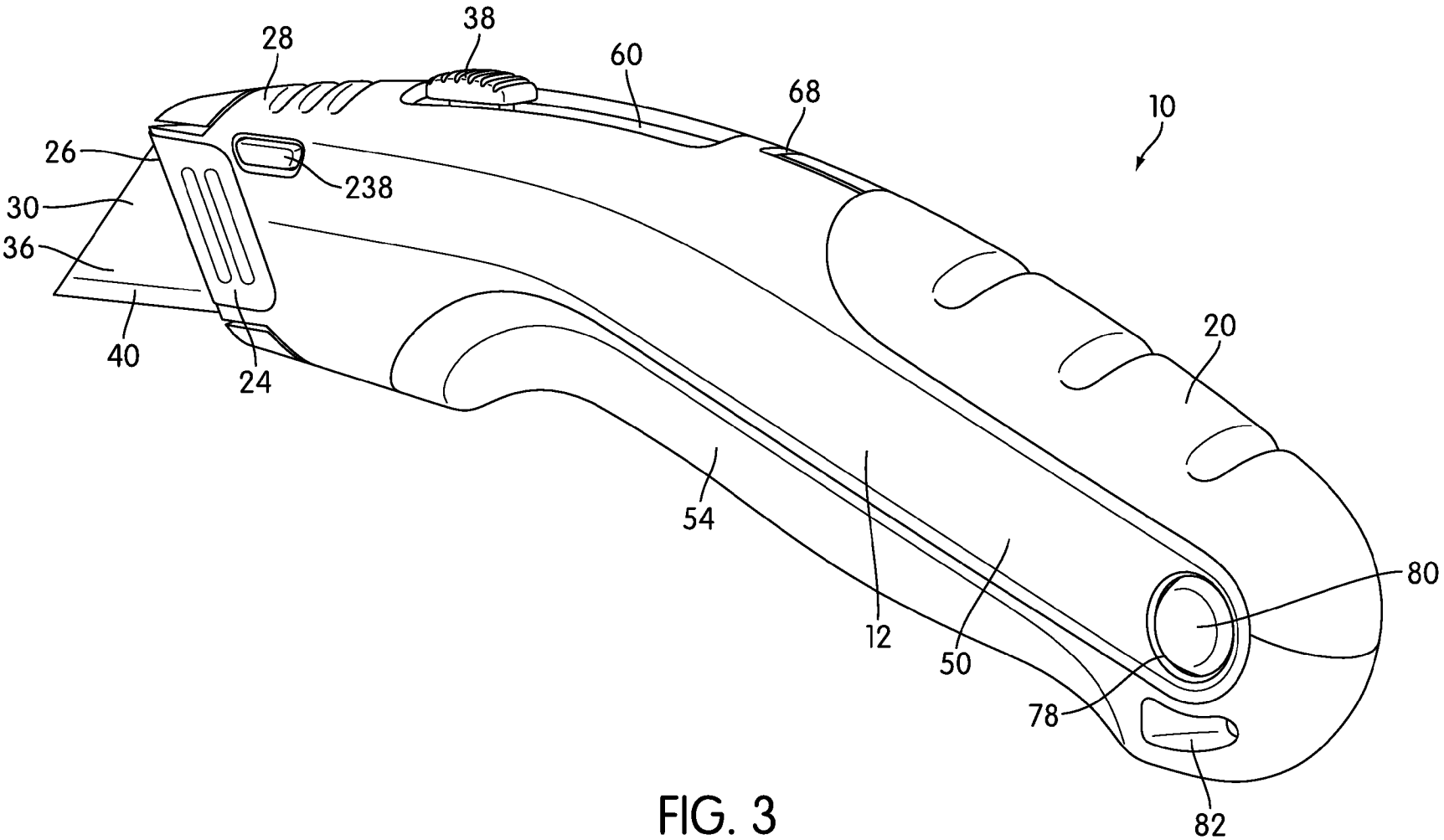
FIG. 3 is a left side perspective view of the utility knife with the blade at the position of use in accordance with a first embodiment of the present invention.

In one embodiment, as shown in FIGS. 1-3, the first and the second handle portions 48 and 50 cooperate to form an upper slot 60 for a manually engageable member 38 of the blade holder assembly 14, and the opening 26 at the front end 28 sized to allow the blade 30 mounted in the blade holder assembly 14 to move in and out of the handle 12. The first and the second handle portions 48 and 50 also cooperate to form an upper opening 68 that is constructed and arranged to accommodate a pivotal movement of the manually movable actuator 20 and to provide access of the plurality of blades 32 stored in the spare blade carrier 16 therethrough.

As shown in FIG. 6, the first handle portion 48 includes an opening 62 that is constructed and arranged to receive a second portion 64 of a manually engageable actuator portion 66 of the clamp assembly 22 therewithin. The second portion 64 is configured to linearly move within the opening 62 to enable the movement of the clamp assembly 22 between the clamp position and the release position. In one embodiment, the first handle portion 48 includes an opening 272 that is constructed and arranged to receive the fastener 52, when the first handle portion 48 is connected to the second handle portion 50.

Figure 20:
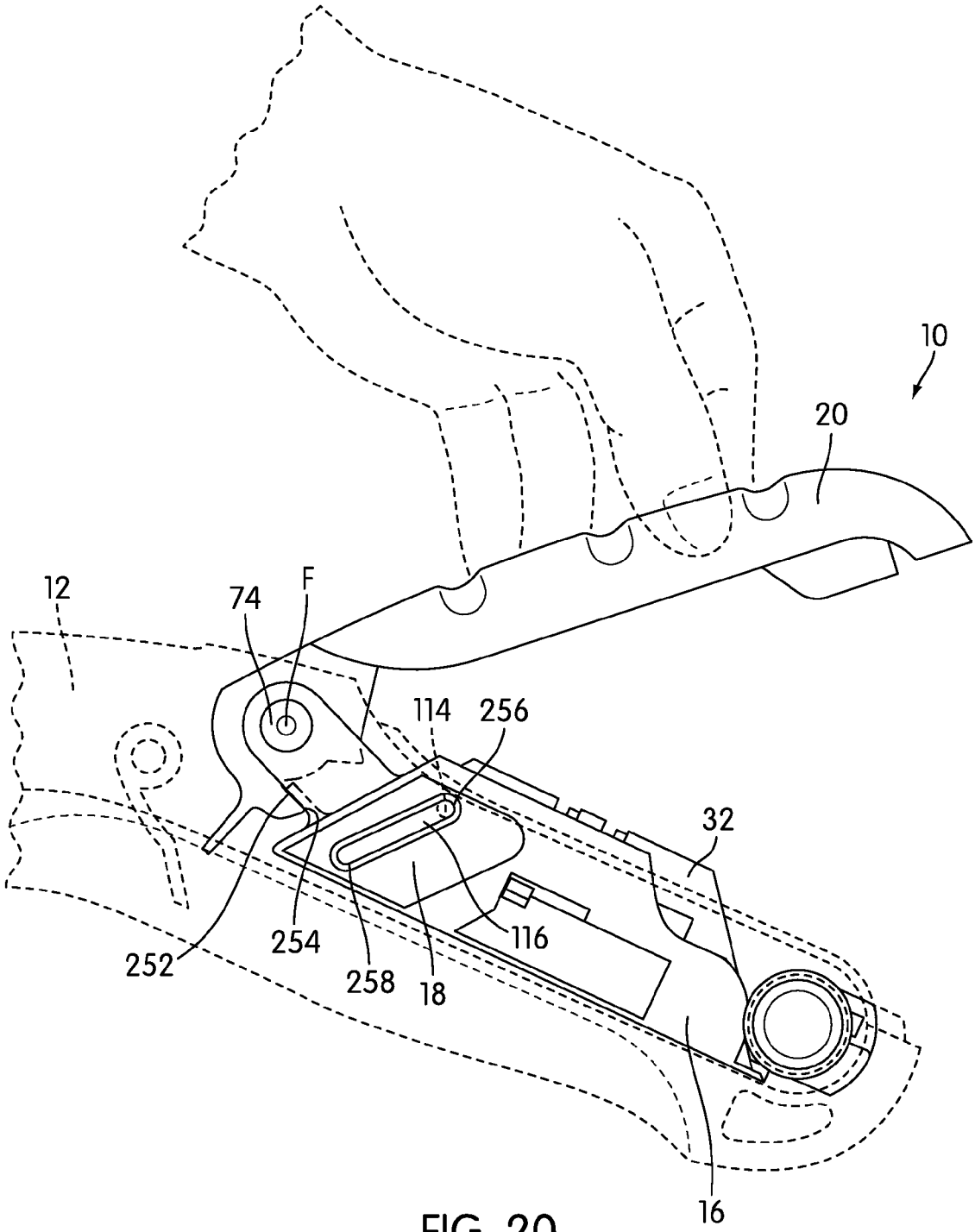
FIG. 20 is a partial side view of the utility knife, wherein the actuator is manually pivotable about a pivot axis from the first intermediate position to a second intermediate position, wherein an engagement surface of the actuator is engaged with an engagement structure of the spare blade carrier in accordance with a first embodiment of the present invention.

The second handle portion 50 includes an opening 78 that is constructed and arranged to receive a lock 80 therewithin. The lock 80 is movable between a lock position and an unlock position, wherein the movement of the lock 80 from the lock position to the unlock position unlocks the manually movable actuator 20 to enable movement of the manually movable actuator 20. The second handle portion 50 includes an engagement member or projection 114 that is constructed and arranged to ride along an slot 116 in the spare blade dispenser 18 to facilitate the movement of the spare blade dispenser 18 relative to the carrier 16. In one embodiment, the dispenser 18 is movable between a first position (as shown in FIG. 20) and a second position (as shown in FIGS. 22 and 23). The movement of dispenser 18 relative to the carrier 16 is configured to separate one of the spare blades 34 from the plurality 32 thereof and present the one separated blade 34 to the user, as will be described in detail with respect to FIGS. 20-23. The second handle portion 50 includes a pair of support ribs 142 that are constructed and arranged to provide an opposing clamping engagement, when the blade 30 is clamped by the clamping assembly 22 as will be discussed in detail with respect to FIG. 17.

Figure 7:
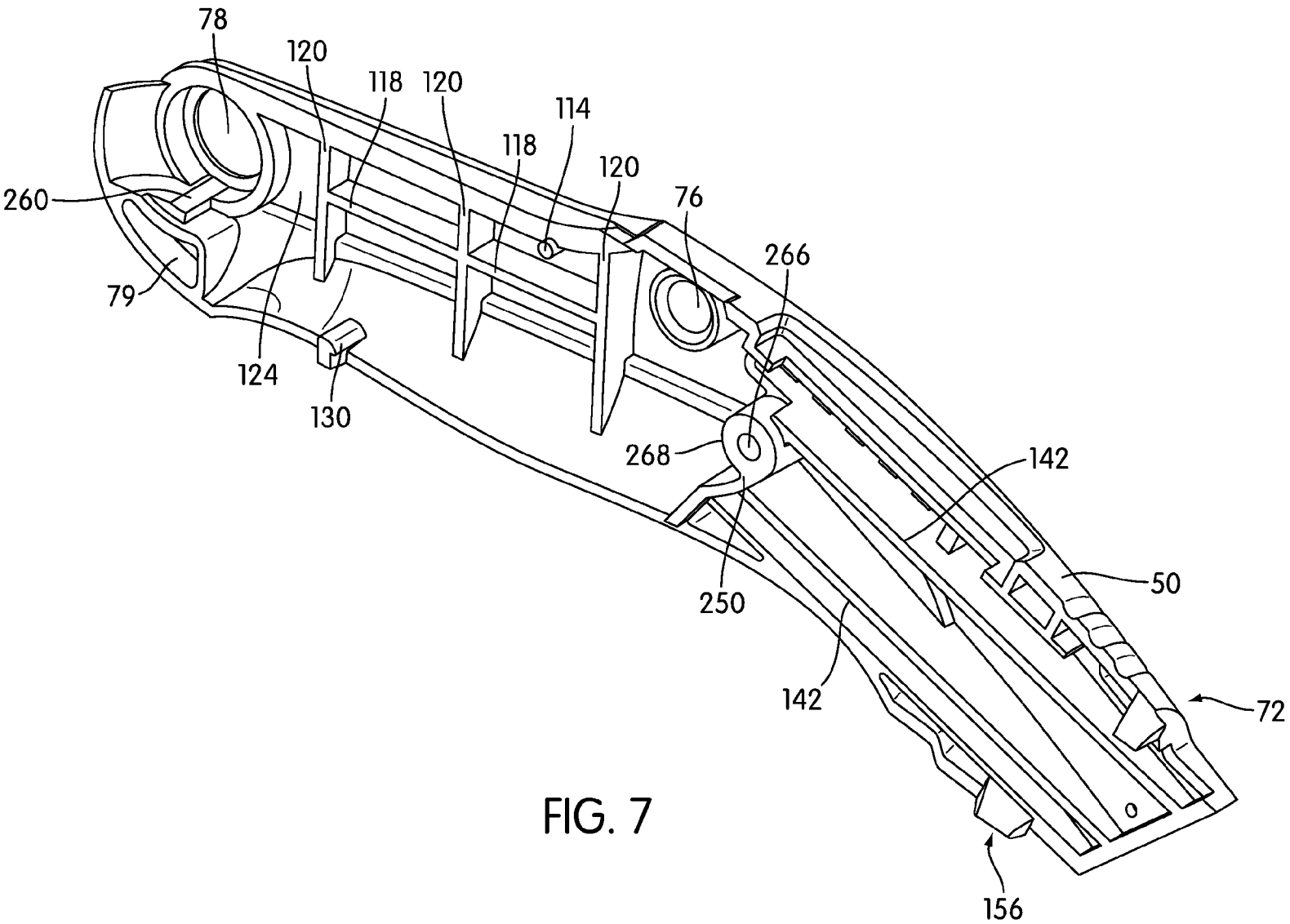
FIG. 7 is a right side perspective view of a second portion of the handle of the utility knife in accordance with a first embodiment of the present invention.

As shown in FIGS. 6, 7 and 8, the first handle portion 48 and the second handle portion 50 include a plurality of support ribs 118 and 120 (e.g., horizontal ribs and vertical ribs) that are located on inner surfaces 122 and 124 of the first handle portion 48 and the second handle portion 50 respectively. These support ribs 118 and 120 are constructed and arranged to support surfaces 126 and 128 of the spare blade carrier 16, when the spare blade carrier 16 is in a stored position (as shown, for example, in FIG. 18) disposed in the handle 12. The first handle portion 48 and the second handle portion 50 also include support portions 130 that are constructed and arranged to support surface 132 of the spare blade carrier 16, when the spare blade carrier 16 is in a stored position (as shown, for example, in FIG. 18) disposed in the handle 12.

Figure 27:
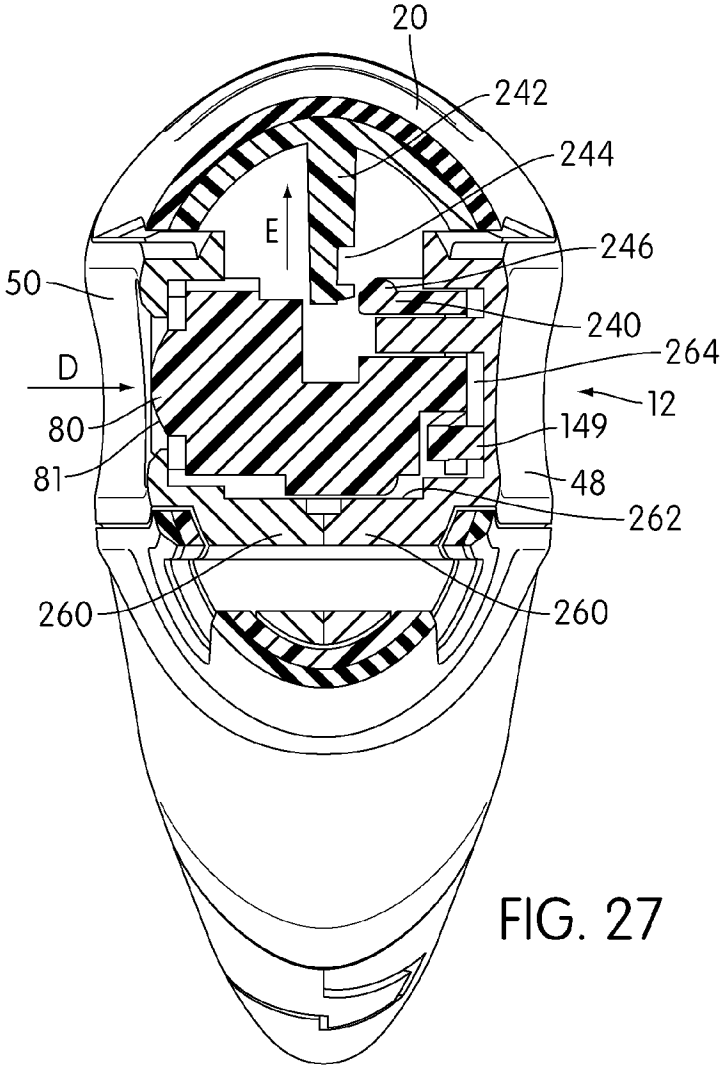
FIG. 27 is a partial cross-sectional view of the utility knife, wherein the actuator is in an unlocked position in accordance with a first embodiment of the present invention.
Figure 26:
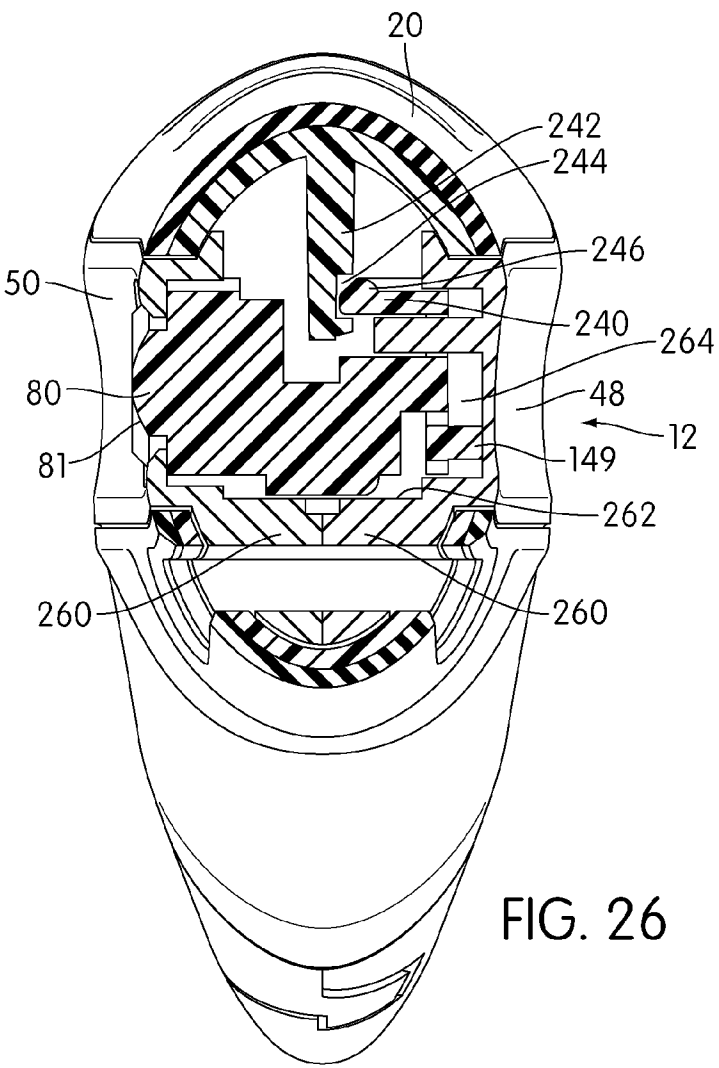
FIG. 26 is a partial cross-sectional view of the utility knife, wherein the actuator is in a locked position in accordance with a first embodiment of the present invention.

In one embodiment, the first and second handle portions 48 and 50 include support portions 260 that cooperate to form a support surface 262 (as shown in FIGS. 26 and 27) that supports the lock 80 when disposed in the handle 12. As shown in FIG. 8, the first handle portion 48 includes a notch 264 that is aligned with the opening 78 of the second handle portion 50, wherein the notch 264 is constructed and arranged to receive the lock 80 therewithin.

In one embodiment, the second handle portion 50 includes a support member 250 disposed on the inner surface 124 of the second handle portion, 50. A spring tab 248 of the actuator 20 is constructed and arranged to rest against a surface portion 268 of the support member 250, when the actuator 20 is in the first position. The support member 250 includes an opening 266 that is constructed and arranged to receive the fastener 52, when the first handle portion 48 is connected to the second handle portion 50.

Figure 4:
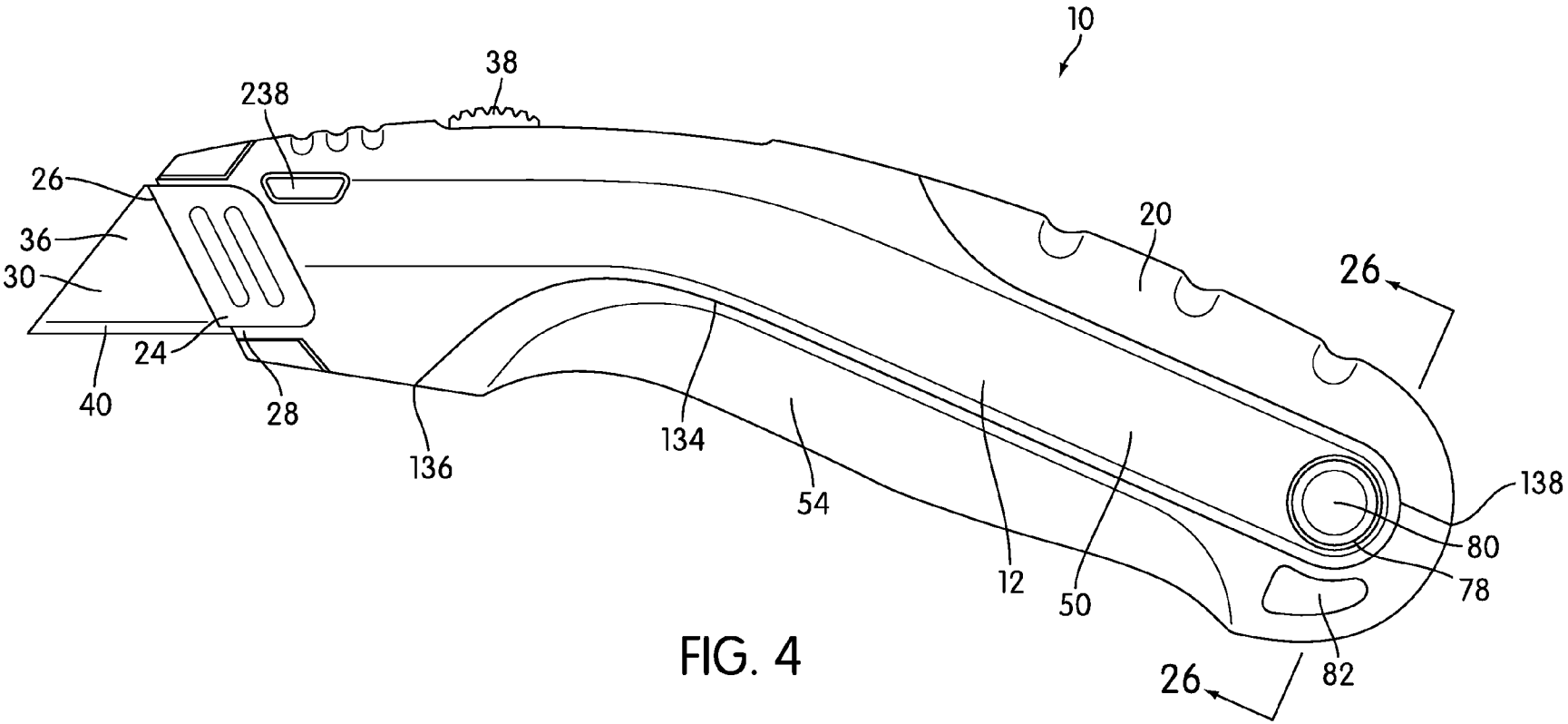
FIG. 4 is a left side view of the utility knife with the blade at the position of use in accordance with a first embodiment of the present invention.
Figure 5:
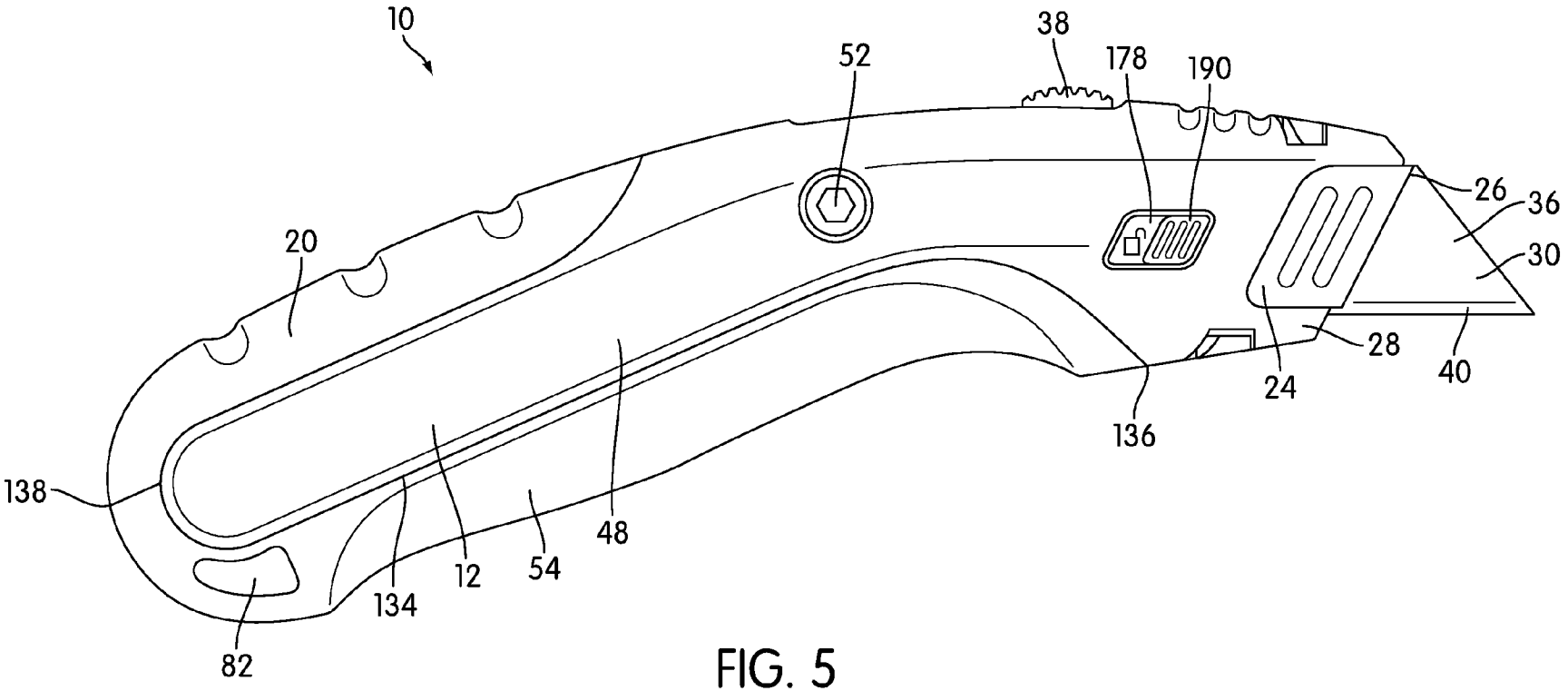
FIG. 5 is a right side view of the utility knife with the blade at the position of use in accordance with a first embodiment of the present invention.

In one embodiment, as shown in FIGS. 4-6, a lower gripping member 54 is mountable on the handle 12 in a position to engage the palm of a gripping hand to provide the palm with a comfortable gripping surface. In one embodiment, the lower gripping member 54 is preferably made of a suitable molded plastic material. In another embodiment, the lower gripping member 54 is preferably made of a suitable molded plastic material and is coated with a layer of an elastomeric material, such as rubber.

The lower gripping member 54 includes a connector member 56 that is constructed and arranged to receive the fastener 52 through a fastener receiving opening 58 of the connector member 56 to connect the lower gripping member 54 to the handle 12. In one embodiment, as shown in FIG. 8, the first handle portion 48 includes an opening 270 that is constructed and arranged to receive the connector member 56 of the lower gripping surface 54 therewithin. The lower gripping member 54 of the handle 12 is contoured or arranged to more comfortably accommodate the fingers of the user rather than the palm.

In one embodiment, as shown in FIG. 6, the fastener 52 is constructed and arranged to pass through the opening 266 of the second handle portion 50, the opening 272 of the first handle portion 48, and the fastener receiving opening 58 of the lower gripping member 54 to fasten or connect the first handle portion 48, the second handle portion 50, and the lower gripping member 54 together.

The lower gripping member 54 is provided with a pair of attachment apertures 82 to facilitate attachment of the knife 10 to a tool belt or to provide a way to hang the knife 10 for storage when not in use. In one embodiment, as shown in FIG. 6, apertures 79 having a matching shape as the attachment apertures 82 may be located on the first handle portion 48 and the second handle portion 50. The apertures 79 along with the attachment apertures 82 facilitate the attachment of the knife 10 to a tool belt or to provide a way to hang the knife 10 for storage when not in use. In one embodiment, the lower gripping member 54 extends along a lower surface 134 of the first and the second handle portions 48 and 50 from a first end 136 to a second end 138 as shown in FIGS. 4 and 5.

The interior of the handle 12 is configured to receive the blade holder assembly 14 that may be of conventional construction and is constructed and arranged to hold the conventional utility knife blade 30 at a position of use.

In the illustrated embodiment, the blade holder assembly 14 is movable between a retracted position (FIG. 12) wherein the blade 30 is disposed within the handle 12 and an extended position (shown, for example, in FIGS. 1-5) wherein the blade 30 protrudes outwardly (e.g., from the opening 26 at the front end 28) from the handle 12 to enable a cutting operation. The extended position may include not only a fully extended position, but may also include at least one intermediate position wherein the blade can be releasably locked at a position in which only a part of the possible extent of the blade extends from the handle. The manually engageable member 38 is slidably disposed on the handle 12 and is operatively connected with the blade holder assembly 14 such that movement of the manually engageable member 38 moves the blade holder assembly 14 between the extended and retracted positions.

In various embodiments, the structure of the illustrated blade holder assembly 14 can be of the type described in commonly assigned U.S. Pat. Nos. 4,586,256; 6,192,589; 6,971,178; and 7,296,354, that are each hereby incorporated by reference in their entirety.

In one embodiment, a blade releasing structure is associated with the blade holder assembly 14 and includes a manually engageable portion 238 (as shown in FIGS. 2-4) that is movable to disengage the blade 30 from the blade holder assembly 14 to enable the blade 30 to be removed from the blade holder assembly 14. The structure of such blade releasing structure can be of the type described in more detail in U.S. Pat. No. 3,577,637, and commonly assigned U.S. Pat. No. 6,192,589, that are each hereby incorporated by reference in their entirety.

In the illustrated embodiment, the blade 30 has a trapezoidal shape, a longest side of which includes the linear cutting edge 40. Other cutting edges and blade shapes can also be used (e.g., a hook type blade). A shorter side 42 of the blade 30 includes at least one locating notch 44*a*, 44*b* configured to mate with a complementary blade engaging protrusion 46 provided on the blade holder assembly 14 to prevent the blade 30 from moving longitudinally forwardly or rearwardly out of engagement with the blade holder assembly 14, as known in the art.

Figure 21:
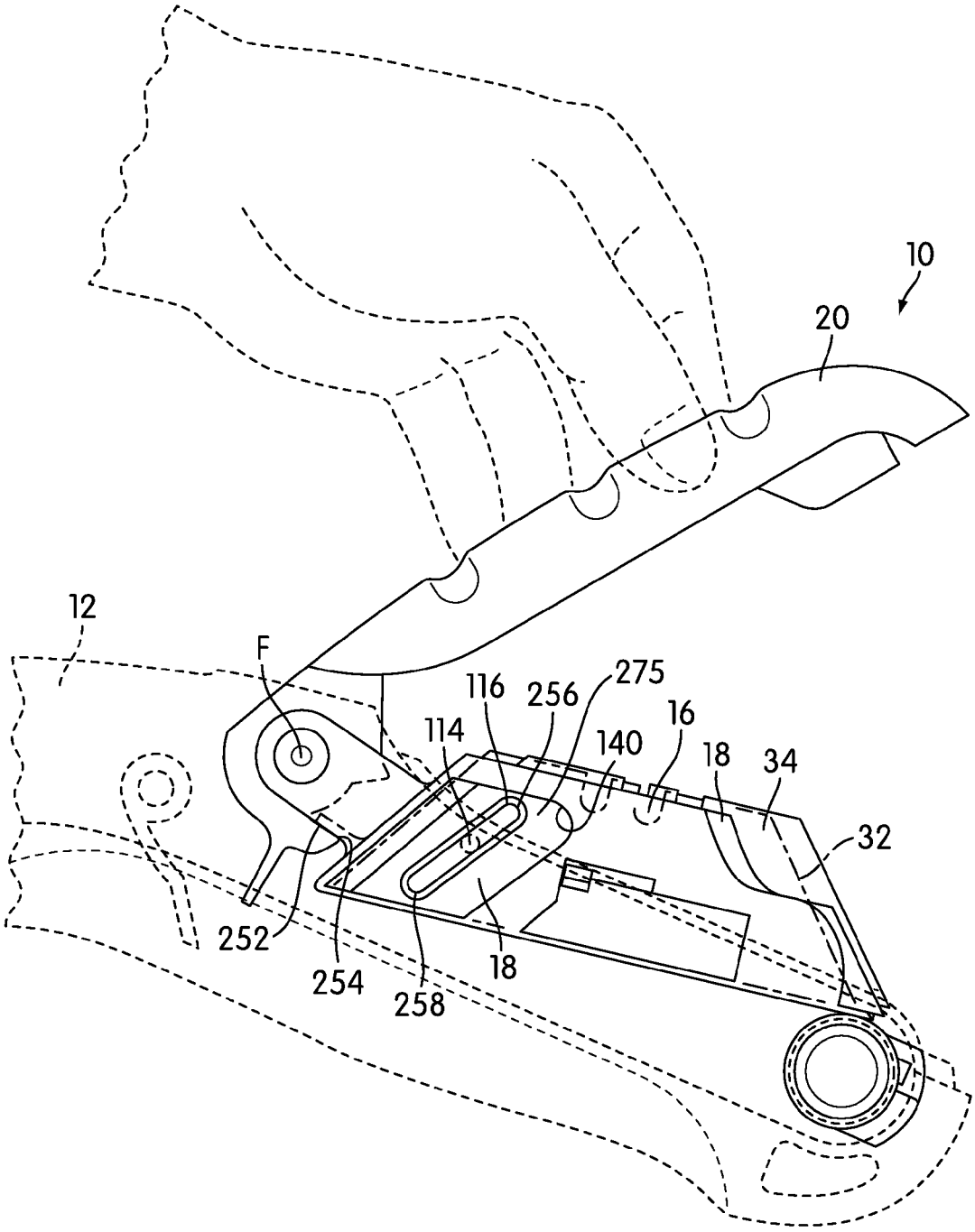
FIG. 21 is a partial side view of the utility knife, wherein the actuator is pivotable about the pivot axis beyond the second intermediate position, wherein such movement of the actuator moves the spare blade carrier upwardly and outwardly from the handle in accordance with a first embodiment of the present invention.
Figure 28:
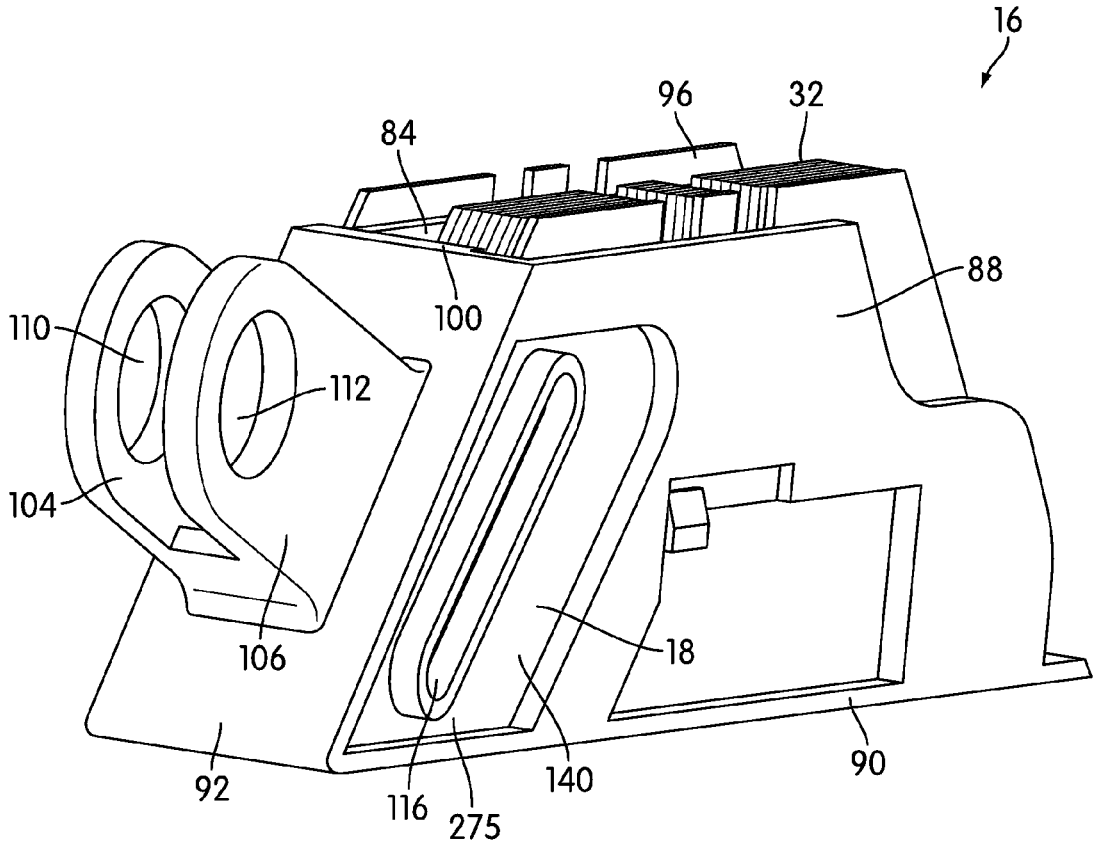
FIG. 28 is a right side perspective view of the spare blade carrier in accordance with a first embodiment of the present invention.

The spare blade carrier 16 is pivotally movable relative to the handle 12 in a manner best seen in FIGS. 18-23 and is constructed and arranged to carry a plurality of blades 32 as shown in FIG. 28. The spare blade carrier 16 is movable between the stored position (as shown in FIG. 18) wherein the carrier 16 is disposed in the handle 12 (concealed) and an access position (as shown in FIGS. 21-23) wherein the carrier 16 provides the user with access to the spare blades 32.

As shown in FIGS. 6 and 28, the spare blade carrier 16 includes a pair of opposing side walls 86, 88, a bottom wall 90, and a rear wall 92. The rear wall 92 is joined with the opposing side walls 86 and 88 to form a storage space 84 therewithin. The storage space 84 is constructed and arranged to receive a supply of spare blades 32.

Figure 24:
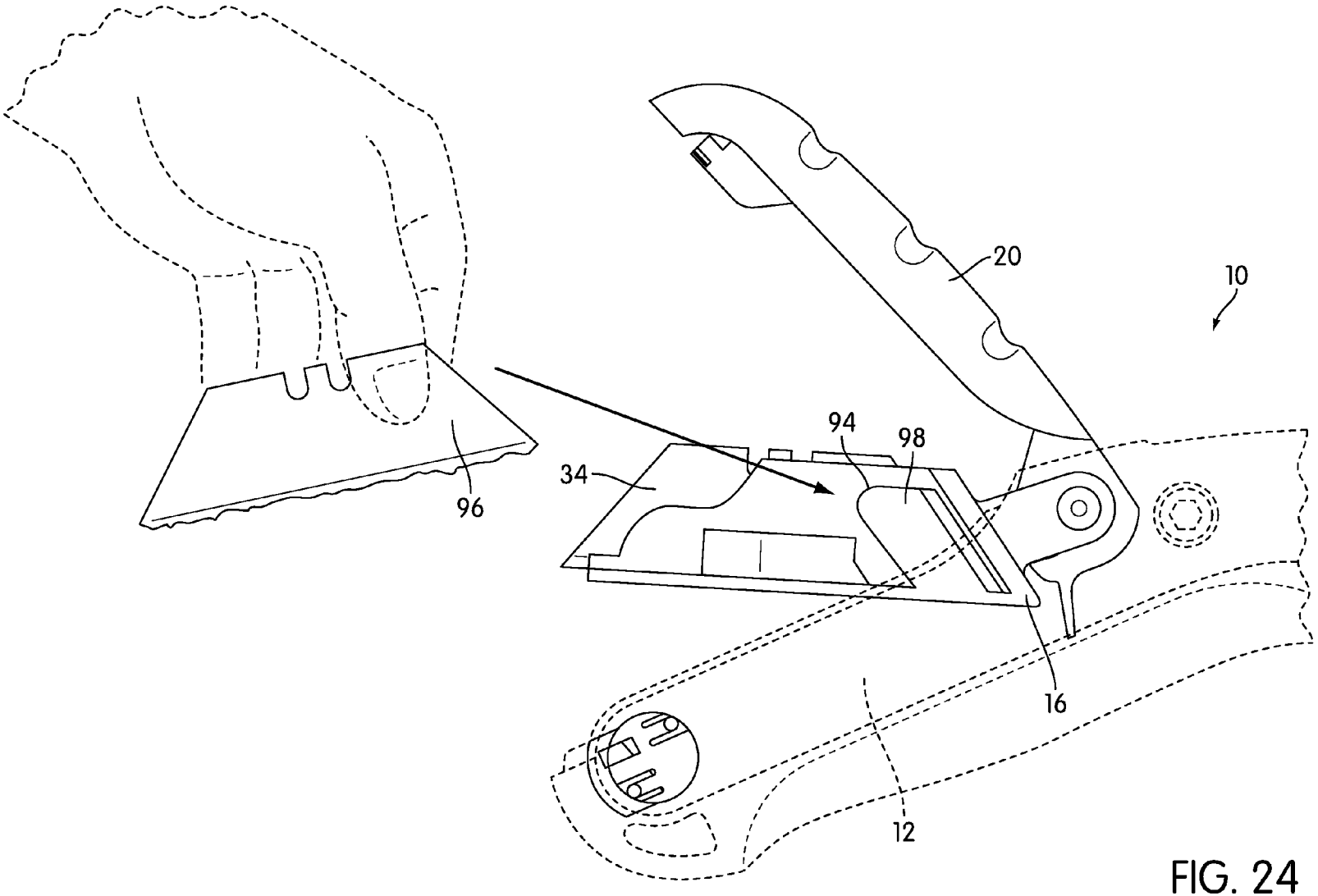
FIG. 24 is a partial side view of the utility knife, wherein a used blade is being placed in a used blade holder in accordance with a first embodiment of the present invention.
Figure 25:
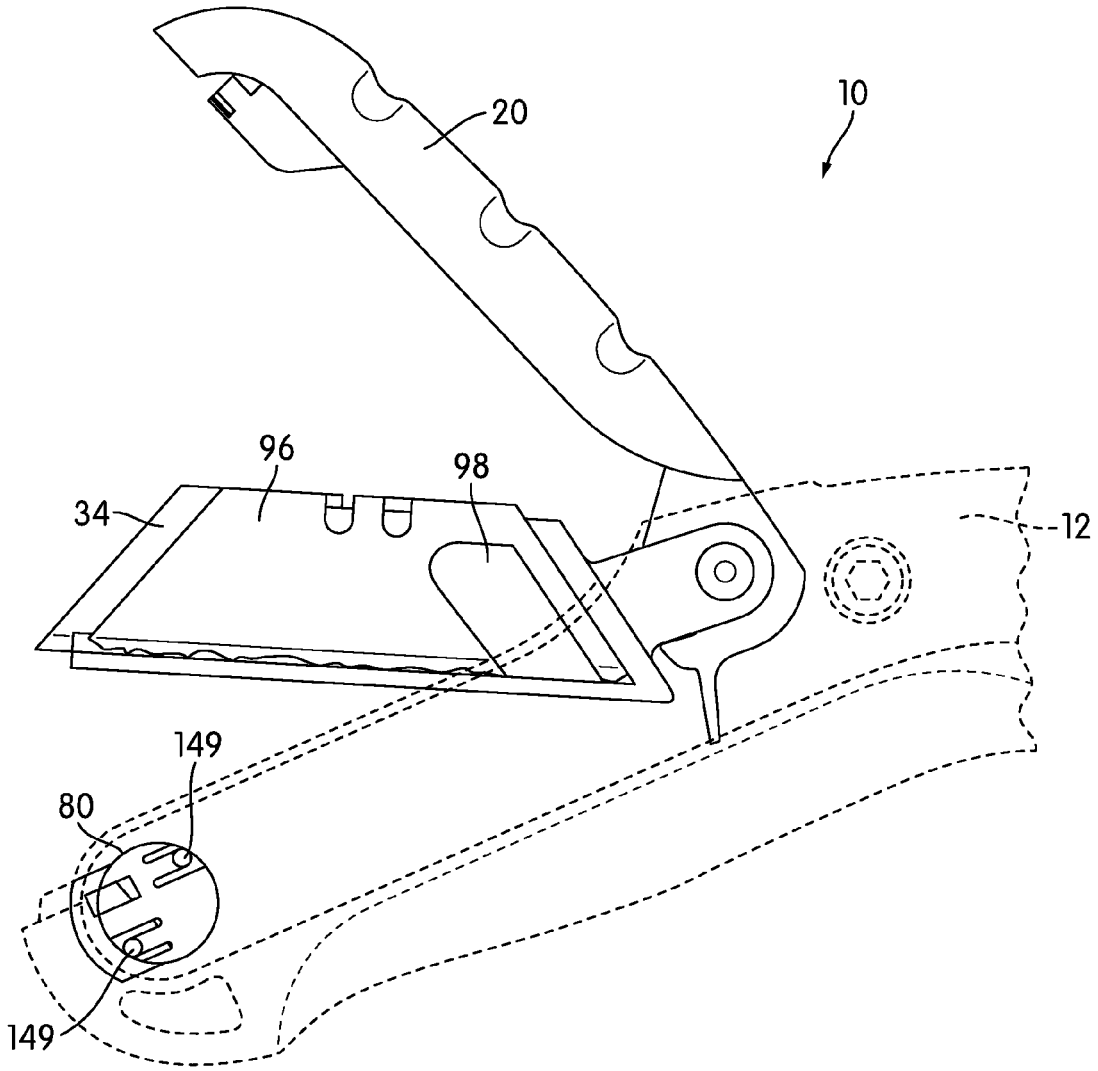
FIG. 25 is a partial side view of the utility knife, wherein the actuator is moved towards the first position to store the spare blade carrier in the handle with the used blade stored in the used blade holder in accordance with a first embodiment of the present invention.

In one embodiment, the side wall 86 has projection portion 98 that serves as a used blade holder to enable the user to store at least one user blade. The projection portion 98 cooperates with the main portion of the side wall 86 to define a storage space 94 therebetween. The used blade storage space 94 is constructed and arranged to receive and store a used blade 96 (as shown in FIGS. 24 and 25). The used blade holder 98 extends upwardly from the bottom wall 90 and is disposed in a side-by-side relation with the main side wall 86. The used blade holder 98 is constructed and arranged to support the used blade 96, when the used blade 96 is stored in the used blade storage space 94. The rear wall 92 of the spare blade carrier 16 includes a recess 100 that is constructed and arranged to accommodate a projection 102 of the spare blade dispenser 18.

As shown in FIGS. 6 and 28, the spare blade carrier 16 includes a pair of connecting members 104, 106 that are constructed and arranged to connect the spare blade carrier 16 to the first and the second handle portions 48, 50 using a pivot member 74. A pair of transversely aligned opening 110 and 112 are formed on the respective connecting members 104, 106 of the spare blade carrier 16. In one embodiment, the pivot member 74 is in the form of a hinge pin. The pivot member 74 is received within a notch 76 formed on the inside surface of second handle portion 50 of the handle 12, received through the pair of transversely aligned openings 110 and 112, and a notch 77 (as shown in FIG. 8) in the first handle portion 48 to pivotally mount the spare blade carrier 16 to the handle 12 of the utility knife 10.

In one embodiment, as shown in FIGS. 6 and 22, the side wall 88 of the spare blade carrier 16 includes an opening 140 (as shown in FIG. 28) that is constructed and arranged to allow the engagement member 114 of the second handle portion 50 to pass therethrough and to engage with the slot 116 of the spare blade dispenser 18.

As noted above, and as shown in FIG. 6, the spare blade dispenser 18 is constructed and arranged to separate one of the spare blades from the plurality thereof and present the one separated blade 34 to the user. Specifically, the spare blade dispenser 18 is in the form of an integral sheet metal slide that includes forward and rearward ends 144, 146 respectively and upper and lower ends 148, 150, respectively. A web portion 152 extends between the upper and lower ends 148, 150. The web portion 152 has a planar surface 274 for abutting against the planar side face of the first blade (the blade 34 to be separated) of the blade stack 32 to provide lateral retention and support for the first blade 34 on one side, and the web portion 152 has an opposite planar surface 275 (as shown in FIGS. 21, 22, and 28) for abutting against the planar side face of the spare blade carrier 16.

The rear projection 102 of the spare blade dispenser 18 extends outwardly from the rearward end 146 of the web portion 152 to engage with the first or top blade 34 within the spare blade stack 32. The projection 102 extends inwardly into storage space 84 a distance from the web 152 that is about equal to (or slightly less than) the thickness of a single blade so that it only engages a single blade at a time. The dispenser 18 can thus separate a single spare blade 34 from the plurality 32 to present the one separated blade 34 to the user. In one embodiment, the projection 102 is movable relative to the carrier 16 and engages the one spare blade 34 and moves the spare blade 34 relative to the carrier 16 and also relative to any remaining blades 32 in the carrier 16. The top or end blade 34 in the spare blade stack 32 is always retained against the side surface of the dispenser 18 by a spring 276 applying a biasing force on the last (or bottom) spare blade with the spare blade stack 32. In one embodiment, the spring 276 is a leaf spring stamped as a cut-out portion of the side wall 86 of the carrier 16.

The illustrated embodiment shows the spring 276 formed as part of the side wall 86 of the carrier 16. The spring 276 generally presses or biases the plurality of the blades 32 in the carrier 16 towards the spare blade dispenser 18 so as to place the blade 34 that is in contact with the dispenser 18 in an ejecting position. In the ejecting position, the blade 34 is positioned to engage with the projection 102 of the dispenser 18 so that the blade 34 moves along with the dispenser 18 relative to the carrier 16 to separate the blade 34 and then to present the separated blade 34 to the user. In an alternate embodiment, a separate spring (not formed as part of the wall 86) may be provided instead of spring 276.

As noted above, and as shown in FIGS. 6 and 28, the spare blade dispenser 18 includes the angled slot 116 disposed on the planar face 275 (as shown in FIG. 28) that is abutting against the planar side face of the spare blade carrier 16. The slot 116 of the spare blade dispenser 18 is constructed and arranged to receive the engagement member or pin 114 of the second handle portion 50. In the illustrated embodiment, the slot 116 is in the form of an elongated opening. As the slot 116 moves from the first position (as shown in FIG. 20) to the second position (as shown in FIGS. 22 and 23), the engagement member 114 disposed in the slot 116 facilitates the movement of the spare blade dispenser 18 (by a camming action) relative to the spare blade carrier 16 so that projection 102 engages and separates one of the spare blades 34 from the plurality 32 thereof and presents the one separated blade 34 to the user.

As shown in FIG. 6, the blade wiper 24 comprises a pair of resilient members 24*a* and 24*b* connected to opposite sides of the handle 12. Each resilient member 24*a* or 24*b* comprises a first portion 220 disposed substantially side-by-side relationship with the handle 12, and a second portion 222 protruding inwardly towards the opening 26 located at the front end 28. The first portions 220 of the resilient members 24*a* and 24*b* are constructed and arranged to connect the resilient member 24*a* and 24*b* of the blade wiper 24 to the opposite sides of the handle 12. Each first portion 220 comprises a pair of engaging members 224 that are constructed and arranged to engage with a pair of recesses 226 on an outer surface 228 of the handle 12 to secure each resilient member 24*a* or 24*b* to the handle 12. In one embodiment, the pair of recesses 226 are positioned in a notch or groove 230 located on the outer surface 228 of the handle 12.

The second portions 222 of the resilient members 24*a* and 24*b* (or wiper) are constructed and arranged to rest on the side surfaces 36 of the blade 30, when the blade 30 is in the position of use. In one embodiment, the second portions 222 of the resilient members 24*a* and 24*b* form an opening 232 (as shown in FIGS. 1 and 2) therebetween to allow the blade 30 to move to the position of use. The opening 232 formed between the resilient members 24*a* and 24*b* form a width smaller than a width of the blade 30, when the blade 30 is stored in the handle 12. In one embodiment, the height of the resilient members 24*a* and 24*b* is at least equal to a height of the blade 30. In one embodiment, the resilient members 24*a* and 24*b* engage with the blade 30 along an entire height of the blade 30 (from top edge to cutting edge of the blade 30) to remove debris from entire height of the blade. In another embodiment, only the lower portion of the blade is engaged with the wipers.

In the illustrated embodiment, the resilient blade wiper 24 includes two separate resilient members 24*a* and 24*b* that are individually connected to the handle 12, however, it is contemplated that in another embodiment the resilient blade wiper 24 may include a unitary structure connected to the handle 12, wherein the unitary structure may include two resilient members that are connected to each other. It is also contemplated that the wiper may be disposed on only one side of the blade. In another embodiment, the wiper may be made from a resilient metal material, or a rigid metal material. The wiper may be made from a plastic and/or elastomeric material in another embodiment.

The resilient blade wiper 24 is disposed to rest on the side surfaces 36 of the blade 30 when the blade projects through the opening 26 at the front end 28 of the handle 12 so as to remove debris from the side surfaces 36 of the blade 30 when the blade 30 is retracted into the handle 12.

Figure 9:
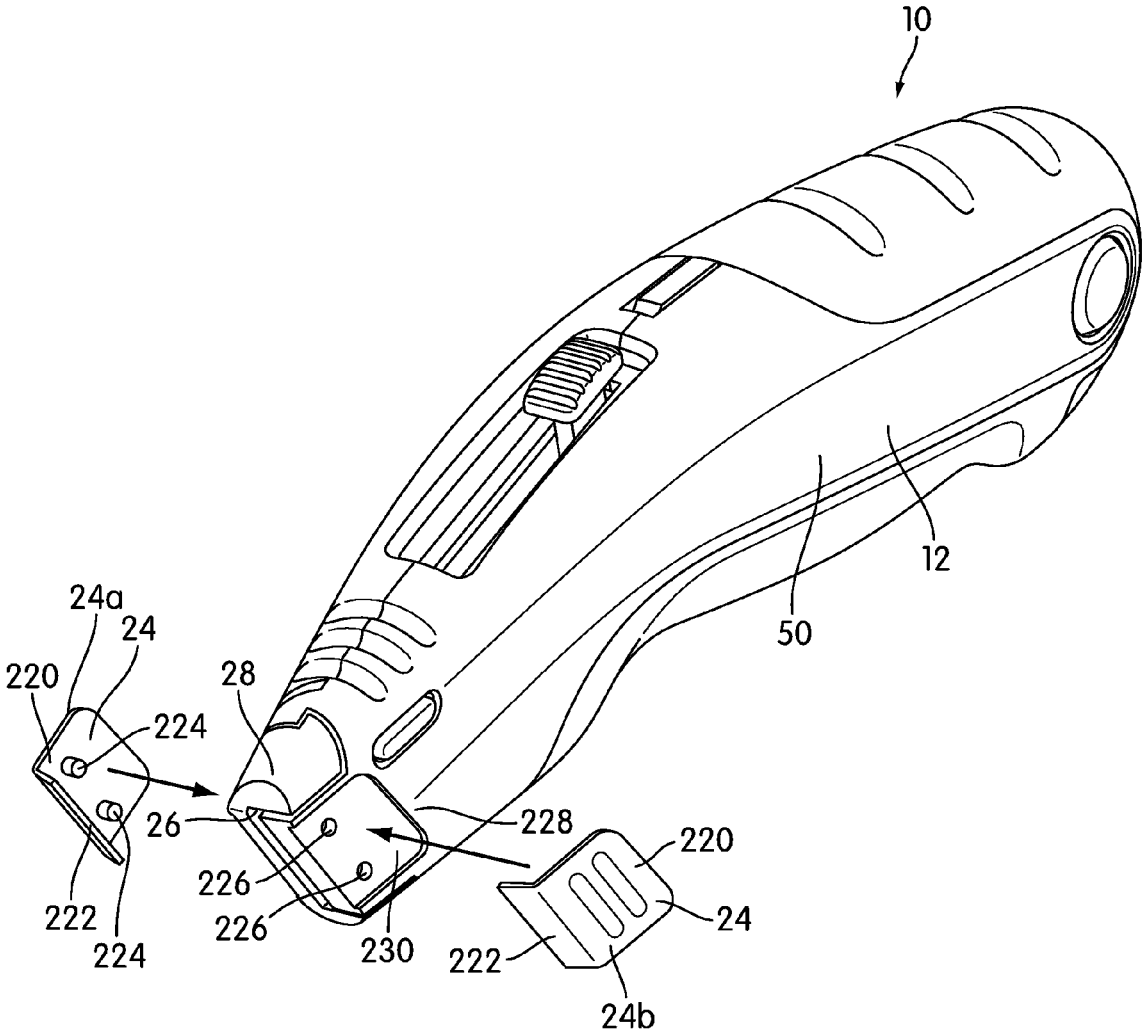
FIG. 9 is an upper right side perspective view of the utility knife with a blade wiper being assembled to the handle of the utility knife in accordance with a first embodiment of the present invention.

FIG. 9 shows the process of connecting the resilient blade wiper 24 to the handle 12. The pair of engaging members 224 of the resilient members 24*a* and 24*b* are constructed and arranged to engage with the pair of recesses 226 located on the grooves 230 on the outer surface 228 of the handle 12. The first portions 220 of the resilient members 24*a* and 24*b* are connected to the opposite sides of the handle 12 by any attachment mechanism as would be appreciated by one skilled in the art. In one embodiment, the attachment mechanism includes, but not limited to, welding, fastening, friction fitting, snap fitting, or adhesive bonding.

Figure 10:
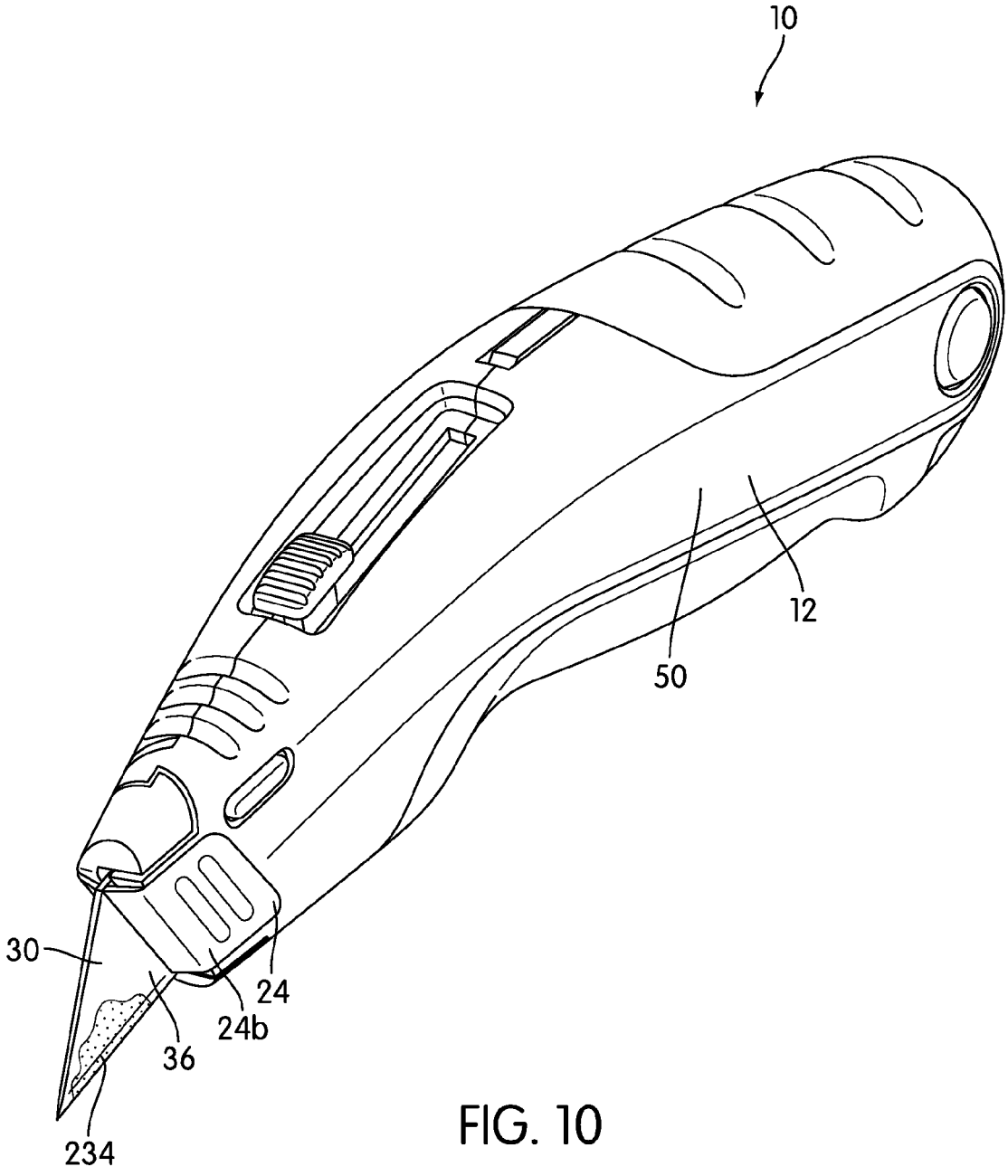
FIG. 10 is an upper left side perspective view of the utility knife with the blade at the position of use, wherein debris is located on side surfaces on the blade.
Figure 11:
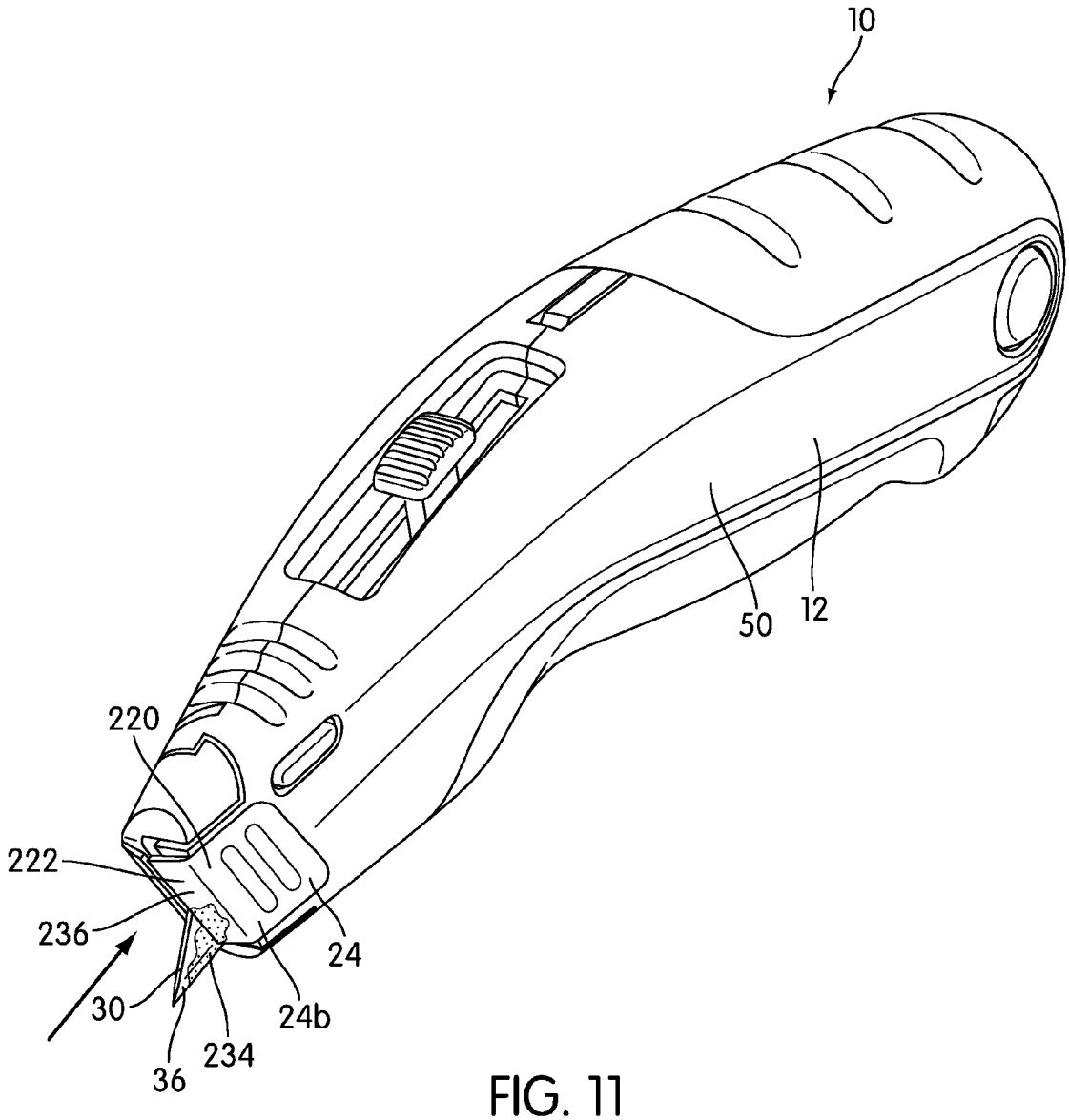
FIG. 11 is an upper left side perspective view of the utility knife with the blade being retracted into the handle, wherein debris is removed from the side surfaces on the blade using the blade wiper in accordance with a first embodiment of the present invention.
Figure 12:
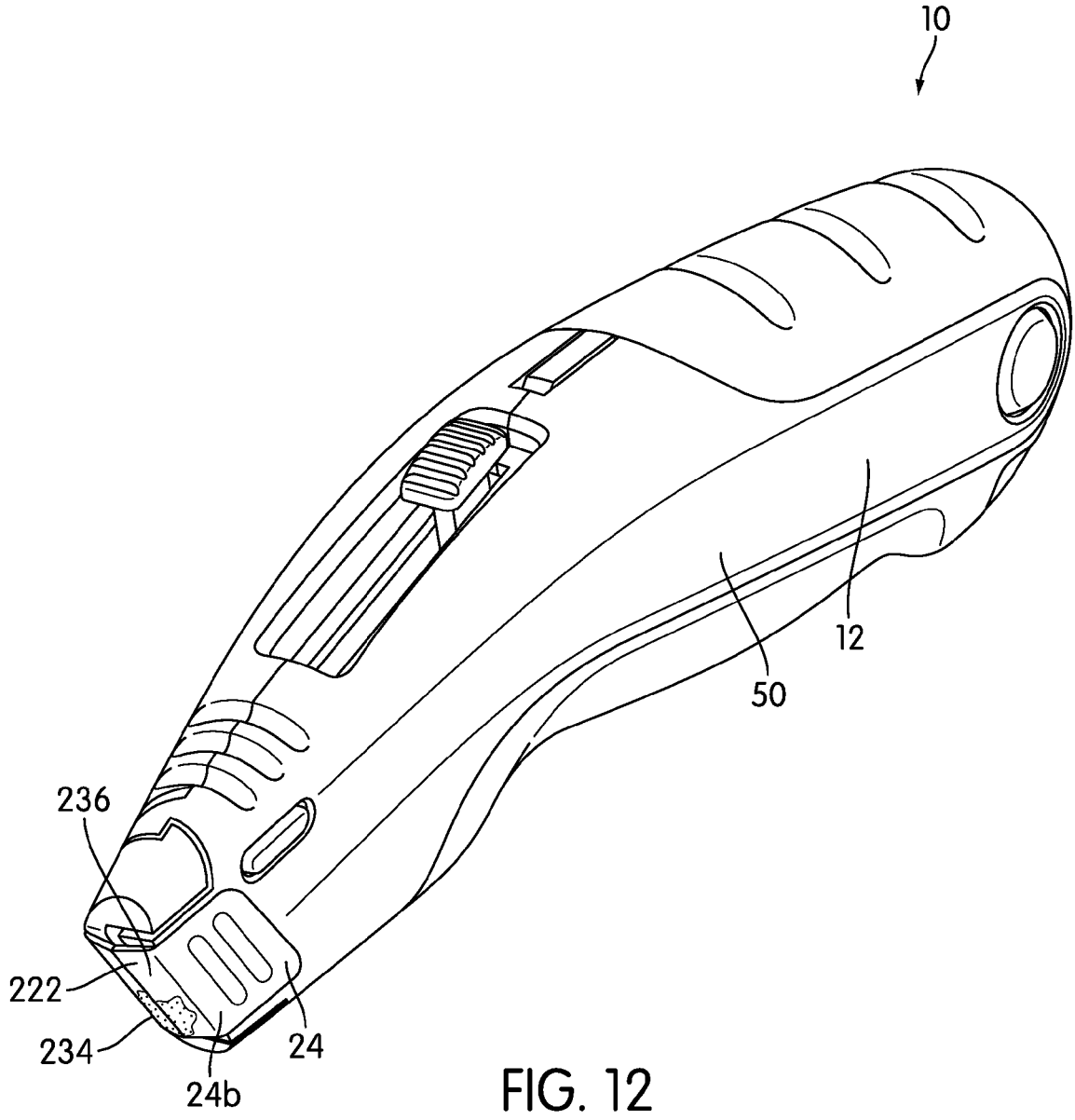
FIG. 12 is an upper left side perspective view of the utility knife with the blade retracted into the handle, wherein debris removed from the side surfaces on the blade using the blade wiper is collected on surfaces of the blade wiper in accordance with a first embodiment of the present invention.

FIGS. 10-12 show the process of removing debris from the side surfaces 36 of the blade 30, before the blade 30 is retracted into the handle 12, to prevent debris from entering into the handle 12 and thus to minimize and to avoid jamming of the blade 30 in the handle 12. FIG. 10 shows the utility knife 10 with the blade 30 at a position of use, wherein debris 234 is located on the side surfaces 36 on the blade 30. As shown in FIG. 11, as the blade 30 is retracted into the handle 12, the blade wiper 24 resting on the side surfaces 36 of the blade 30 is constructed and arranged to allow the blade 30 to be retracted into the handle 12 and to simultaneously remove the debris 234 from the side surfaces 36 of the blade 30. As shown in FIG. 12, the debris 234, thus, removed is collected on surface portions 236 of the second portions 222 of the resilient members 24*a* and 24*b* of the blade wiper 24 and may be cleaned or wiped off easily.

By removing the debris 234 from the side surfaces 36 of the blade 20 before the blade 30 is retracted into the handle 12, the debris 234 does not enter the handle 12, and consequently does not get trapped in the handle 12 to jam the blade 30. The blade wiper 24 contacts the side surfaces 36 of the blade 30 thereby removing debris from the blade 30 and storing the clean blade 30 in the handle 12.

Figure 13:
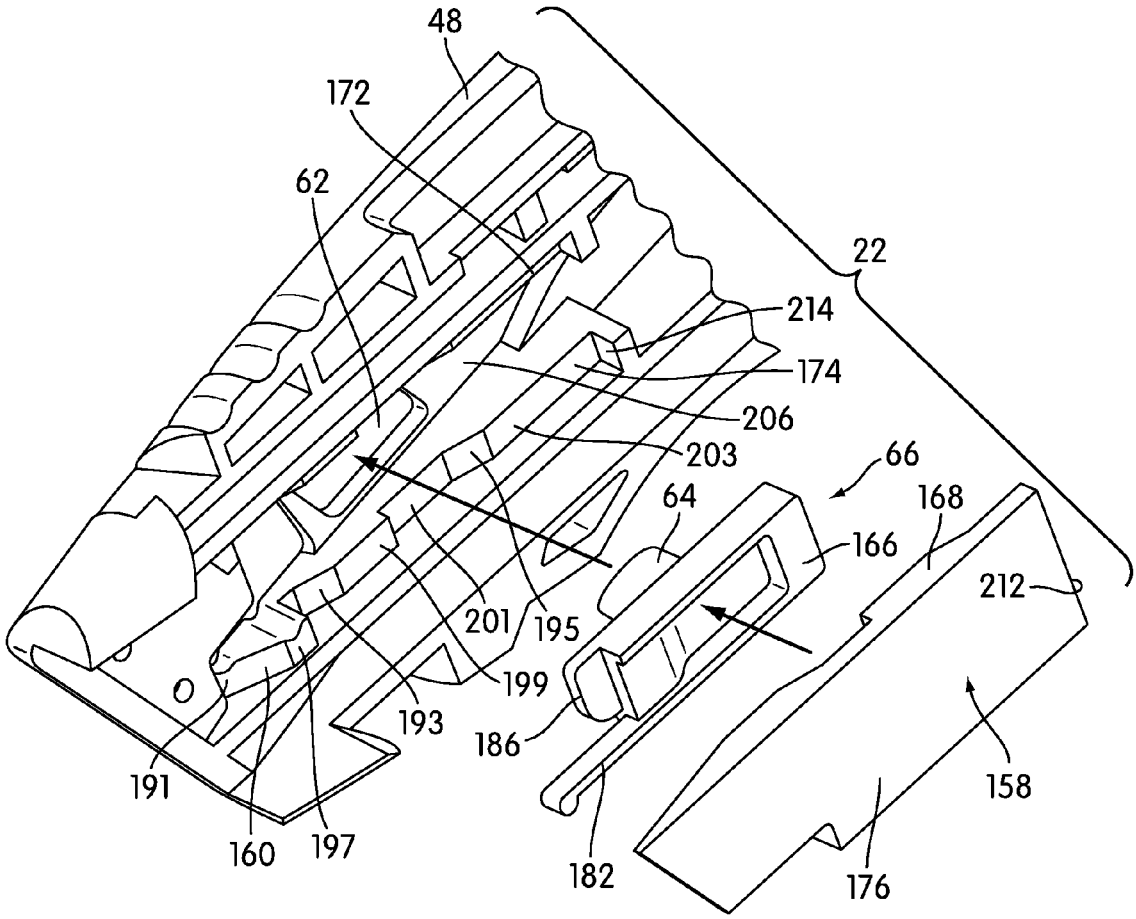
FIG. 13 is a perspective view of a clamp assembly in accordance with a first embodiment of the present invention.
Figure 14:
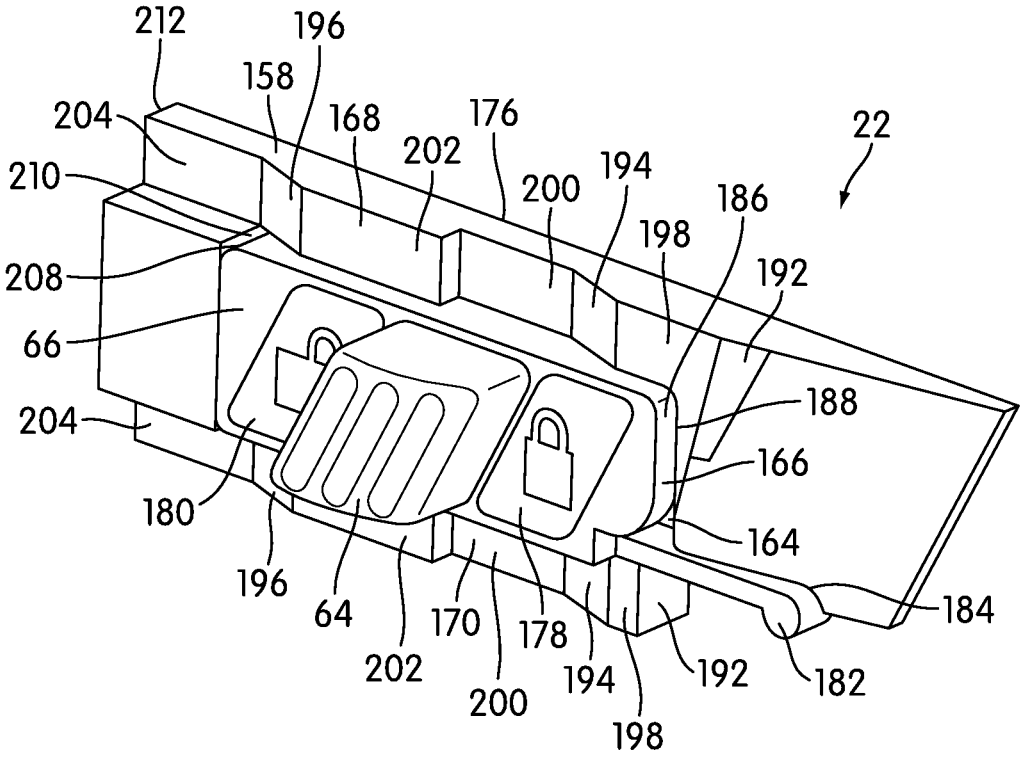
FIG. 14 is a perspective view of an actuator portion and a support portion of the clamp assembly in accordance with a first embodiment of the present invention.

In one embodiment, as shown in FIGS. 6, 13 and 14, the clamp assembly 22 comprises the manually engageable actuator portion 66 and a support portion 158. In one embodiment, as best seen in FIG. 13, the clamp assembly 22 further comprises a surface portion 160 of the handle 12. In one embodiment, the surface portion 160 is disposed on an inner wall 206 of the first handle portion 48 of the handle 12.

The actuator portion 66 is manually actuatable to move (e.g., linearly) the clamp assembly 22 between the clamp position and the release position. As noted earlier, and as shown in FIGS. 6, 13 and 14, the handle 12 comprises the opening 62 in the first handle portion 48 constructed and arranged to receive the manually engageable portion 64 of the manually engageable actuator portion 66 therewithin, wherein the manually engageable portion 64 is configured to move (e.g., linearly) within the opening 62 to move the clamp assembly 22 between the clamp position and the release position. In one embodiment, the actuator portion 66 also includes an elongated portion 182 and a first outer surface portion 186 that is constructed and arranged to engage with a surface portion 184 and a first inner surface portion 188 of the support portion 158, when the actuator portion 66 is disposed in a recess 164 of the support portion 158. In one embodiment, a second outer surface portion 208 of the actuator portion 66 is constructed and arranged to engage with an second inner surface portion 210 of the support portion 158, when the actuator portion 66 is disposed in a recess 164 of the support portion 158.

As seen in, for example, in FIGS. 6, 13 and 14, the support portion 158 comprises the recess 164 constructed and arranged to receive a first portion 166 of the actuator portion 66 therewithin. In one embodiment, the support portion 158 is constructed and arranged to apply clamp force to the side surfaces 162 of the blade holder assembly 14. Specifically, the support portion 158 comprises a clamp surface 176 that is constructed and arranged to apply clamp force to the side surfaces 162 of the blade holder assembly 14. In one embodiment, the clamp surface 176 is located on a side of the support portion 158 that is opposite to the recess 164.

As shown in FIG. 14, the support portion 158 also includes engageable portions 168 and 170. In one embodiment, the engageable portions 168 and 170 of the support portion 158 are constructed and arranged to be positioned above and below the recess 164. In one embodiment, each of the engageable portions 168 and 170 of the support portion 158 includes a plurality of ramp portions 194 and 196 that are separated from each other one or more planar surfaces portions 198-204. In one embodiment, the plurality of ramp portions may include two downwardly sloping ramp portions 194 and 196.

As shown in FIG. 13, the surface portion 160 of the handle 12 includes engageable portions 172 and 174. In one embodiment, each of the engageable portions 172 and 174 of the surface portion 160 includes a plurality of ramp portions 191-195 that are separated from each other one or more planar surfaces portions 197-203. In one embodiment, the plurality of ramp portions two downwardly sloping ramp portions 193 and 195.

The engageable portions 172 and 174 of the first handle portion 48 are constructed and arranged to engage with the corresponding the engageable portions 168 and 170 of the support portion 158, wherein the relative movement of the one or, more ramp portions (e.g., relative movement of the ramp portions 194 and 196 of each of the engageable portions 168 and 170 of the support portion 158 with respect to the ramp portions 193 and 195 of each of the engageable portion 172 and 174 of the surface portion 160) forces the clamp assembly 22 to apply clamp force. That is, when the support portion 158 is manually moved rearwardly by manual movement of the actuator portion 66, the ramp portions 194 and 196 move rearwardly and slide against the ramp portions 193 and 195, respectively, so as to apply a camming or wedging force that drives the support portion 158 inwardly toward and against the side surfaces 162 of the blade holder assembly 14. The opposite side of the blade assembly 14 is supported by the pair of support ribs 142 (as shown in FIG. 7) of the second handle portion 50. Thus, the blade is clamped between the support portion 158 and the pair of support ribs 142 (as shown in FIG. 7) of the second handle portion 50 that function as part of the clamp assembly 22.

As shown in FIG. 14, the clamp assembly 22 further comprises indicators 178 and 180 configured to provide an indication whether the clamp assembly 22 is in the clamp position or the release position. In one embodiment, the indication is visual indication. In one embodiment, the indicators 178 and 180, each correspond to the clamp position and the release position of the clamp assembly 22 respectively. In one embodiment, the indicators 178 and 180 are located on either side of the manually engageable portion 64 of the actuator portion 66.

Figure 15:
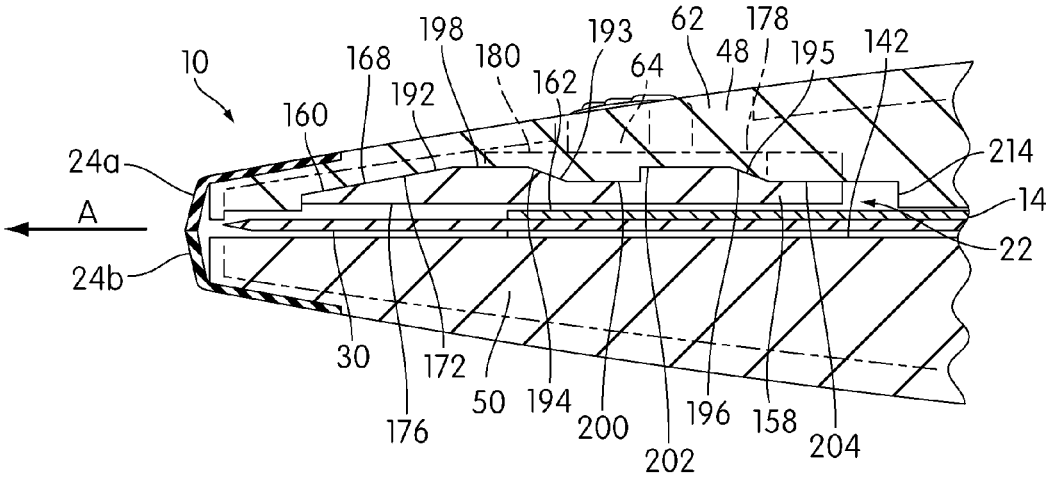
FIG. 15 is a partial top cross-sectional view of the utility knife, wherein the blade is disposed in the handle in accordance with a first embodiment of the present invention.
Figure 16:
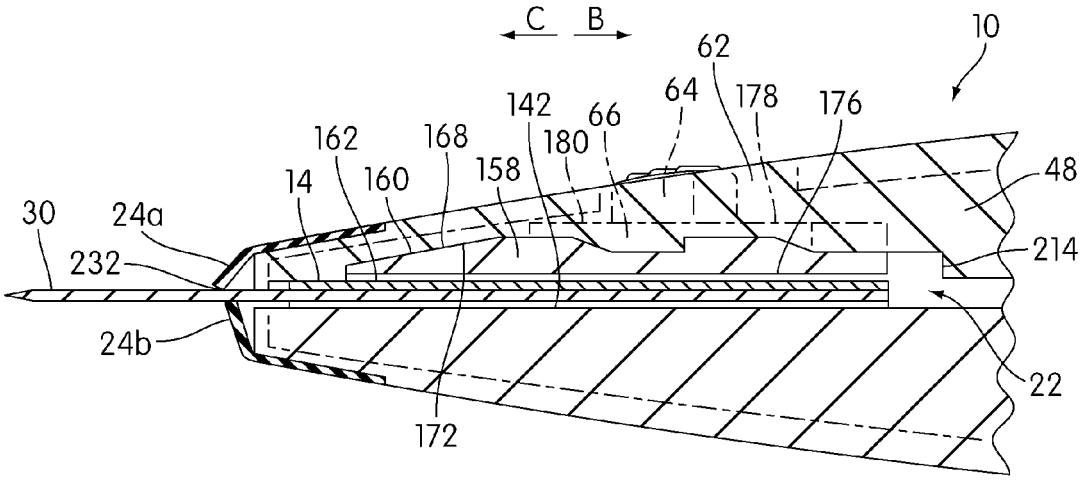
FIG. 16 is a partial top cross-sectional view of the utility knife, wherein the blade is disposed at the position of use in accordance with a first embodiment of the present invention.

The operation of the clamp assembly 22 is discussed with reference to FIGS. 15-17. As shown in FIG. 15, the blade 30 is in a retracted position and is stored within the handle 12 of the utility knife 10. In one embodiment, the manually engageable member 38 (as shown in FIG. 6) of the blade holder assembly 14 is manually actuated to move the blade 30 disposed within the blade holder assembly 14 in the direction of an arrow A from the retracted position (as shown in FIG. 15) to an extended position (as shown in FIG. 16). In one embodiment, as the blade 30 is being extended in the direction of the arrow A, the resilient members 24*a* and 24*b* of the resilient blade wiper 24 flex to allow the blade 30 to pass through the opening 232 therethrough. In the illustrated embodiment, the blade holder assembly 14 includes a retractable assembly, however, it is contemplated that the clamp assembly 22 may be used with any other form of blade holder assemblies (e.g., some examples of such blade holder assemblies are discussed above) that are constructed and arranged to hold the blade at a position of use.

When the clamp assembly 22 is in the release position, as shown in FIGS. 15 and 16, the engageable portions 172 and 174 (as shown in FIG. 13) of the first handle portion 48 are constructed and arranged to engage with the corresponding the engageable portions 168 and 170 (as shown in FIG. 14) of the support portion 158.

In one embodiment, as shown in FIGS. 1, 5, 15 and 16, when the clamp assembly 22 is in the release position and the actuator portion 66 is in a first position, the indicator 180 (i.e., the indicator for indicating the release position of the clamp assembly 22) and the manually engageable portion 64 are visible through the opening 62. In such embodiment, the indicator 178 (i.e., the indicator for indicating the clamp position of the clamp assembly 22) is positioned under the first handle portion 48 and is not visible through the opening 62, thus, providing an indication about the release position of the clamp assembly 22.

Figure 17:
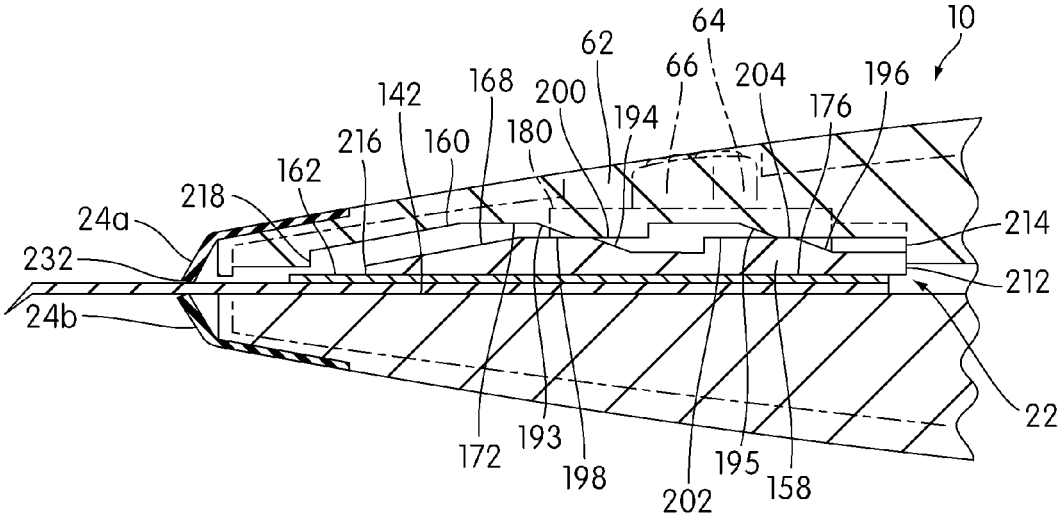
FIG. 17 is a partial top cross-sectional view of the utility knife, wherein the blade is clamped by the clamp assembly disposed in the handle in accordance with a first embodiment of the present invention.

The clamp assembly 22 can be moved from the release position (as shown in FIGS. 1, 5 and 16) to the clamp position (as shown in FIG. 17) by manually actuating the manually engageable portion 64 of the actuator portion 66 in the direction of an arrow B from the first position to a second position. As the manually engageable portion 64 of the actuator portion 66 is moved in the direction of the arrow B, the second outer surface portion 208 (as shown in FIG. 6) of the actuator portion 66 applies a force on the second inner surface portion 210 (as shown in FIG. 6) of the support portion 158 to move the support portion 158 along with the actuator portion 66 in the direction of the arrow B. The movement of the actuator portion 66 from the first position to the second position also cams the ramp portions 194 and 196 of the engageable portions 168 and 170 (only engageable portion 168 is shown in FIGS. 15-17) of the support portion 158 away from the ramp portions 193 and 195 of the engageable portions 172 and 174 (only 172 is shown in FIGS. 15-17) of the first handle portion 48 to apply the clamp force to the side surfaces 162 of the blade holder assembly 14.

When the ramp portions 194 and 196 of the engageable portions 168 and 170 of the support portion 158 are cammed away from the ramp portions 193 and 195 of the engageable portions 172 and 174 of the first handle portion 48, the clamp surface 176 of the support portion 158 contacts and bears against the side surfaces 162 of the blade holder assembly 14 to exert and apply the clamp force on the side surfaces 162 of the blade holder assembly 14 and the blade 30 disposed therein. The pair of support ribs 142 (as shown in FIG. 7) of the second handle portion 50 are constructed and arranged to provide the opposing clamping engagement for the blade 30, when the blade 30 is clamped by the clamping assembly 22.

Also, when the clamp assembly 22 is in the clamp position (as shown in FIG. 17) that is the engageable portions 168 and 170 of the support portion 158 are moved away from the engageable portions 172 and 174 of the first handle portion 48, then the actuator portion 66 located in the support portion 158 is also moved along with the support portion 158 away from the first handle portion 48. Therefore, as shown in FIG. 17, the actuator portion 66 is slightly moved down into the first handle portion 48, when the clamp assembly is in clamp position.

As shown in FIG. 17, an outer surface portion 212 of the support portion 158 is constructed and arranged to engage with inner surface portions 214 of the first handle portion 48, wherein the inner surface portions 214 of the first handle portion 48 act a stop to limit the rearward movement of the support portion 158 and the actuator portion 66 disposed therein in the direction of the arrow B beyond a maximum clamp position. In the clamp position, the planar surfaces portions 198 and 202 of the support member 158 bear against the planar surfaces portions 200 and 204 of the surface portion 160 of the handle 12.

In one embodiment, as shown in FIG. 16, when the clamp assembly 22 is in the clamp position and the actuator portion 66 is in the second position, the indicator 178 (i.e., the indicator for indicating the clamp position of the clamp assembly 22) and the manually engageable portion 64 are visible through the opening 62. In such embodiment, the indicator 180 (i.e., the indicator for indicating the release position of the clamp assembly 22) is positioned under the first handle portion 48 and is not visible through the opening 62, thus, providing an indication about the position (e.g., release or clamp position) of the clamp assembly 22.

When the clamp assembly 22 is moved from the clamp position (as shown in FIG. 17) to the release position (as shown in FIGS. 1, 5, and 16) by manually actuating the manually engageable portion 64 of the actuator portion 66 in the direction of an arrow C from the second position to the first position, the ramp portions 194 and 196 of the engageable portions 168 and 170 of the support portion 158 are moved towards the ramp portions 193 and 195 of the engageable portions 172 and 174 of the first handle portion 48 and the clamp surface 176 of the support portion 158 is moved out of contact with the side surfaces 162 of the blade holder assembly 14, thus, releasing the clamp force applied on the blade holder assembly 14.

As shown in FIG. 17, an outer surface portion 216 of the support portion 158 is constructed and arranged to engage with inner surface portions 218 of the first handle portion 48, wherein the inner surface portions 218 of the first handle portion 48 act a stop to limit the movement of the support portion 158 and the actuator portion 66 disposed therein in the direction of an arrow C beyond a maximum release position.

The operation of the spare blade carrier 16, the spare blade dispenser 18, and the manually movable actuator 20 is discussed primarily with reference to FIGS. 6 and 18-27. As shown in FIG. 18, the manually movable actuator 20 is in the first position, wherein the actuator 20 is locked and is disposed coveringly over the spare blade carrier 16, which is stored within the handle 12. When the actuator is in the first position, the spring tab 248 of the actuator 20 is constructed and arranged to engage with (e.g., rest against) the surface portion 268 of the support member 250 of the second handle portion 50. In this embodiment, the actuator 20 also acts as a movable part of the handle or housing, to conceal the stored blades. In another embodiment, the actuator can be a separate button.

As shown in FIG. 26, the lock 80 comprises a latch member 240 that is constructed and arranged to engage with an engagement portion 242 of the actuator 20 to lock the actuator 20 in the first position. In one embodiment, the engagement portion 242 of the actuator 20 extends downwardly (e.g., when the actuator 20 is in the first position) from the actuator 20 and includes a recess or an opening 244 therewithin. The latch member 240 of the lock 80 includes projections 246 that, are constructed and arranged to be received in the recess 244 of the engagement portion 242, when the lock 80 is in the lock position.

The lock 80 has an outer surface 81 or button that can be depressed so that lock 80 is movable between the lock position (as shown in FIG. 26) and the unlock position (as shown in FIG. 27), wherein the movement of the lock 80 from the lock position to the unlock position unlocks the actuator 20 to enable movement of the actuator 20. In one embodiment, as shown in FIG. 18, the lock 80 is manually actuated by the user in the direction of an arrow D (as shown in FIG. 27) to unlock the actuator 20 to enable the movement of the actuator 20. When the lock 80 is actuated or moved in the direction of the arrow D, the latch member 240 of the lock 80 also move in the direction of the arrow D to move the projections 246 outwardly from the recess 244 of the engagement portion 242. When the projections 246 are moved outwardly from the recess 244 of the engagement portion 242, the actuator 20 is unlocked and is moved from the first position.

As shown in FIG. 6, the lock 80 includes a pair of resilient arms 147 joined with a body portion 147A of the lock 80, and having a protrusion portion 149 on the ends thereof. The spring arms 147 are not visible in the view provided in FIGS. 26 and 27, as they are behind the protrusion 149. In one embodiment, the protrusion portions 149 of each resilient arms 147 are constructed and arranged to bear against the inner surface 122 of the first handle portion 48, when the lock 80 is moved from the lock position (as shown in FIG. 26) to the unlock position (as shown in FIG. 27) and this movement stresses the spring arms 147. Once the user stops actuating the lock 80 in the direction of the arrow D, the resilient spring arms 147 are constructed and arranged to return the lock to the position as shown in FIG. 26.

Figure 19:
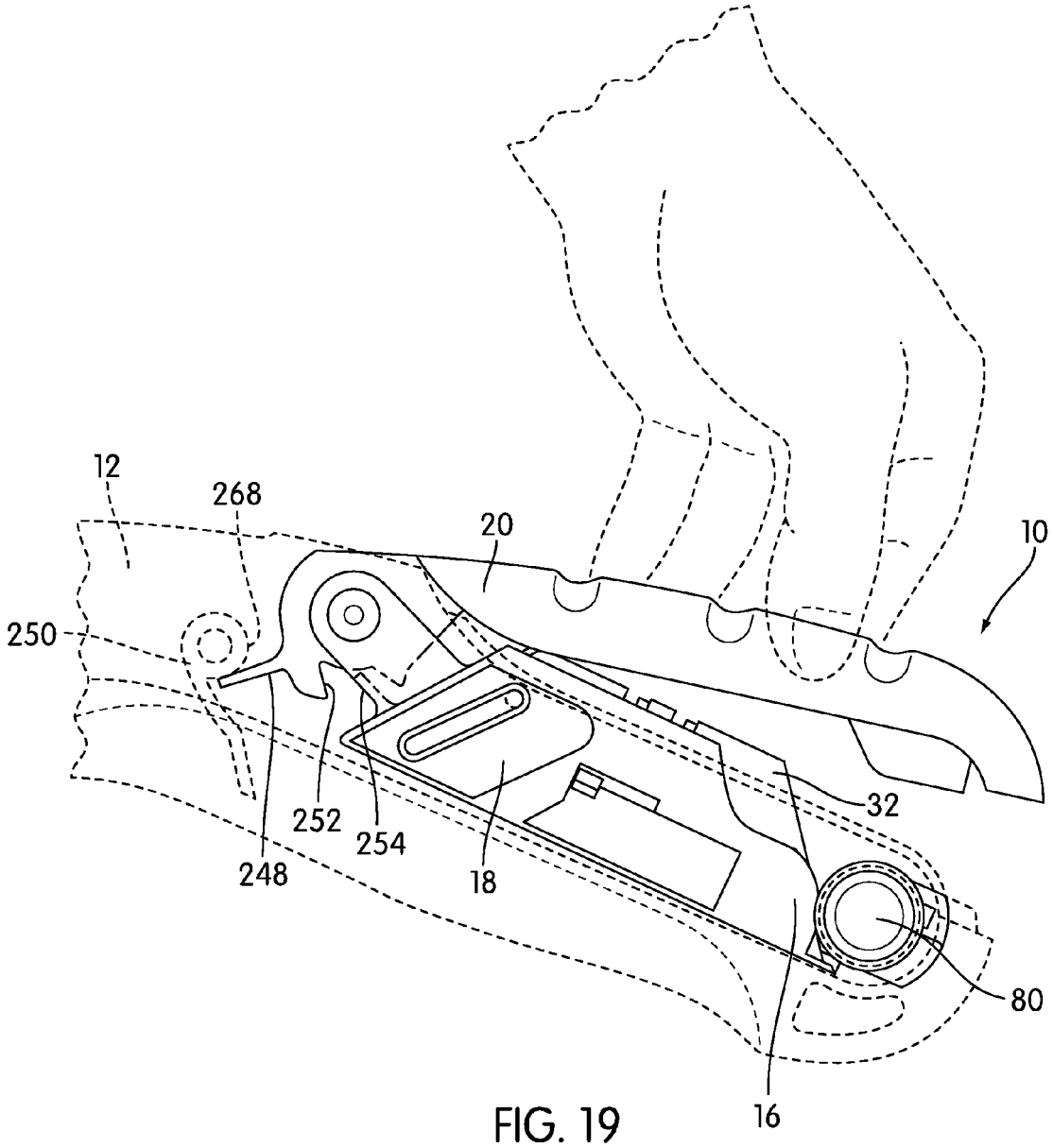
FIG. 19 is a partial side view of the utility knife, wherein the actuator is spring biased away from the first position to a first intermediate position in accordance with a first embodiment of the present invention.

The actuator 20 is spring biased away by the spring tab 248 from the first position (FIG. 18) into a first intermediate position as shown in FIG. 19. In the first intermediate position (after the lock 80 is released), the spring arm 248 remains engaged with surface portion 268, but is straightened out when tension in the spring arm (or tab) 248 is released. This release of tension and straightening of the spring tab 248 automatically "pops" the actuator 20 open to the first intermediate position when the lock 80 is released. In one embodiment, the spring biasing action pivots the actuator 20 from the handle 12 (e.g., or from the first position of the actuator) by approximately five degrees.

After reaching this position, the user manually pivots the actuator 20 about a pivot axis F from the first intermediate position (as shown in FIG. 19) to a second intermediate position (as shown in FIG. 20). In one embodiment, the actuator 20 comprises the pivot pin 74 connected with the handle 12. In one embodiment, the pivot pin 74 pivotally connects the spate blade carrier 16 and the actuator 20 to the handle 12. The spare blade carrier 16 is pivotally movable relative to the handle 12. The pivotal movement of the actuator 20 causes the pivotal movement of the carrier 16. Specifically, when the actuator 20 is in the second intermediate position, an engagement surface 252 (as shown in FIG. 19) of the actuator 20 is engaged with an engagement structure 254 (as shown in FIG. 19) on the spare blade carrier 16. The engagement structure 254 may comprise a bar or link extending between the connecting members 104 and 106 of the blade carrier 16 (the bar is hidden from view in FIG. 6).

As shown in FIG. 21, when the actuator 20 is manually pivotable about the pivot axis F beyond the second intermediate position (as shown in FIG. 20), such movement of the actuator 20 (via surface 252) exerts force on the engagement structure 254 of the carrier 16 and, thus, pivotally moves the carrier 16 upwardly, in a counterclockwise direction in FIG. 21, about the axis F. Also, as the actuator 20 is manually pivotable about the pivot axis F beyond the second intermediate position (as shown in FIG. 20), the movement of the spare blade carrier 16 and the spare blade dispenser 18 disposed therewithin causes the fixed engagement member or pin 114 of the second handle portion 50 to ride along the moving opening or slot 116 of the spare blade dispenser 18. (See FIG. 28). Specifically, the fixed engagement member or pin 114 extends through the opening 140 in the side wall 88 of the spare blade carrier 16, so as to be received in the slot 116 formed on the side surface of the blade dispenser 18. In one embodiment, the blade dispenser 18 is constructed and arranged to pivotally move along with the spare blade carrier 16. During this movement, the slot 116 is pivotally moved as well. As will be appreciated from the drawings and description, the engagement member 114 riding within the slot 116 causes (cams) the blade dispenser 18 to also move outwardly (in the direction of arrow "G" in FIG. 22) as it pivots. The slot 116 of the spare blade dispenser 18 moves from a first position (as shown in FIG. 20), wherein the engagement member 114 is closer to a first end 256 of the slot 116 to a second position (as shown in FIG. 22), wherein the engagement member 114 is closer to a second end 258 of the slot 116.

The slot 116, as shown in FIG. 21, is disposed at an intermediate position between the first and the second positions where the engagement member 114 is located at an intermediate region of the slot 116.

FIG. 22 shows the slot 116 in the second position. As the engagement member 114 rides along the slot 116 (i.e., as the slot 116 moves from the first position to the second position), the engagement member 114 moves the spare blade dispenser 18 outwardly, in the direction in the direction of an arrow G, relative to the spare blade carrier 16. This outwardly movement of the spare blade dispenser 18 causes the projection 102 on the spare blade dispenser 18 (see FIG. 6) to move relative to the carrier 16, to engage the one spare blade 34 and to move the spare blade 34 relative to the carrier 16 and any remaining blades 32 in the carrier 16. As noted earlier, the spring 276 generally presses or biases the plurality of the blades 32 in the carrier 16 towards the spare blade dispenser 18 so as to place the blade 34 that is in contact with the dispenser 18 in the ejecting position.

FIG. 23 shows the actuator 20 in a position, wherein the blade dispenser 18 presents the one spare blade 34, which is separated from the plurality of blades 32 in the carrier 16, to user.

FIG. 24 shows a used blade 96 of the utility knife 10 being placed in the used blade storage space 94 in the carrier 16. As noted earlier, used blade holder 98 is constructed and arranged to support the used blade 96, when the used blade 96 is stored in the used blade storage space 94. The user can store the used blade 96 separately from the plurality of blades 32 disposed in the carrier 16.

As shown in FIG. 25, the used blade 96 is placed in the used blade storage space 94 of the carrier 16. The actuator 20 can then be manually pivotable about the pivot axis from the second position to the first intermediate position. Once the actuator 20 is at the first intermediate position, the actuator 20 is moved slightly pressed downwardly so that engagement portion 242 of the actuator 20 pushes the latch member 240 outwardly against the spring bias caused by the resilient arms 147 of the lock 80 so that the recess 244 of the engagement portion 242 engages with the projections 246 on the latch member 240, thus locking the actuator 20 in the closed position.

It should be appreciated that the blade dispenser (with spare blades) aspect of this embodiment can be used in different types of utility knives. For example, in another embodiment, the blade holder assembly 14 is constructed and arranged to mount a pivotally movable blade, also referred to as a sporting knife. The pivotally movable blade is pivotally connected to the handle 12 and is movably mounted between the first handle portion 48 and the second handle portion 50. The pivotally movable blade is movable between a storage position and an operative position. In the storage position, a cutting edge of the movable blade is concealed by the handle 12. In the operative position, the cutting edge is exposed. The structure of this type of blade holder assembly is described in more detail in commonly assigned U.S. Pat. No. 7,296,354, which is hereby incorporated by reference in its entirety. The structure of this type blade holder assembly and the manner in which the same is pivotally mounts the blade within the handle 12 of the utility knife 10 is described in the above incorporated patent; consequently, will not be discussed in detail.

In yet another embodiment, the blade dispenser (with spare blades) aspect of this embodiment can be used in a utility knife that includes the blade holder assembly 14 that is constructed and arranged to hold the blade 30 at a position of use. In such embodiment, the blade 30 may be placed in the position of use during the cutting operation and be removed and stored thereafter. In such embodiment, the blade holder assembly 14 may not include retractable blade assembly that retracts the blade into the handle.

Figure 41:
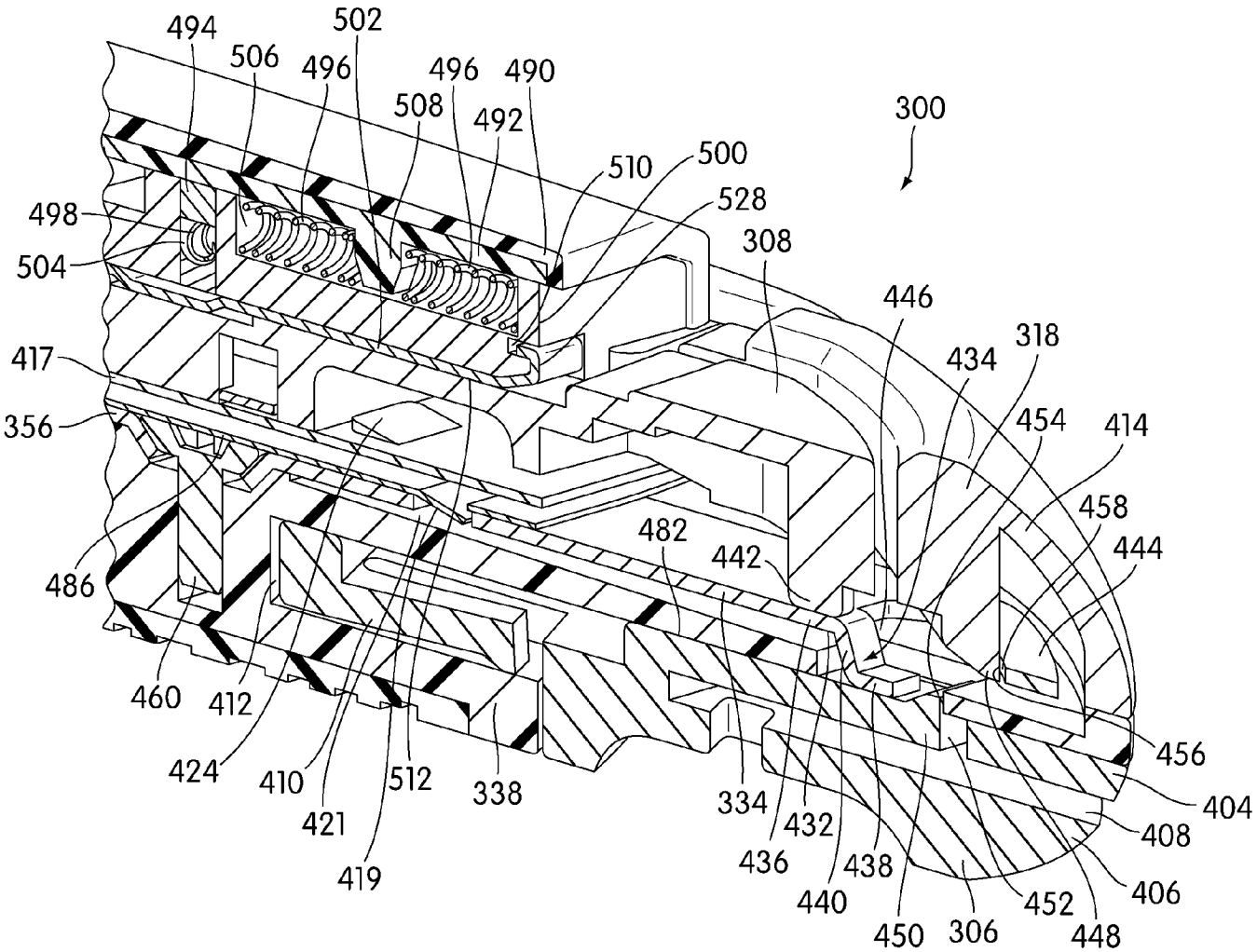
FIG. 41 is a partial cross-sectional view of the knife, wherein a blade snapper and a cartridge are lockingly connected to the body in accordance to a second embodiment of the present invention.
Figure 42:
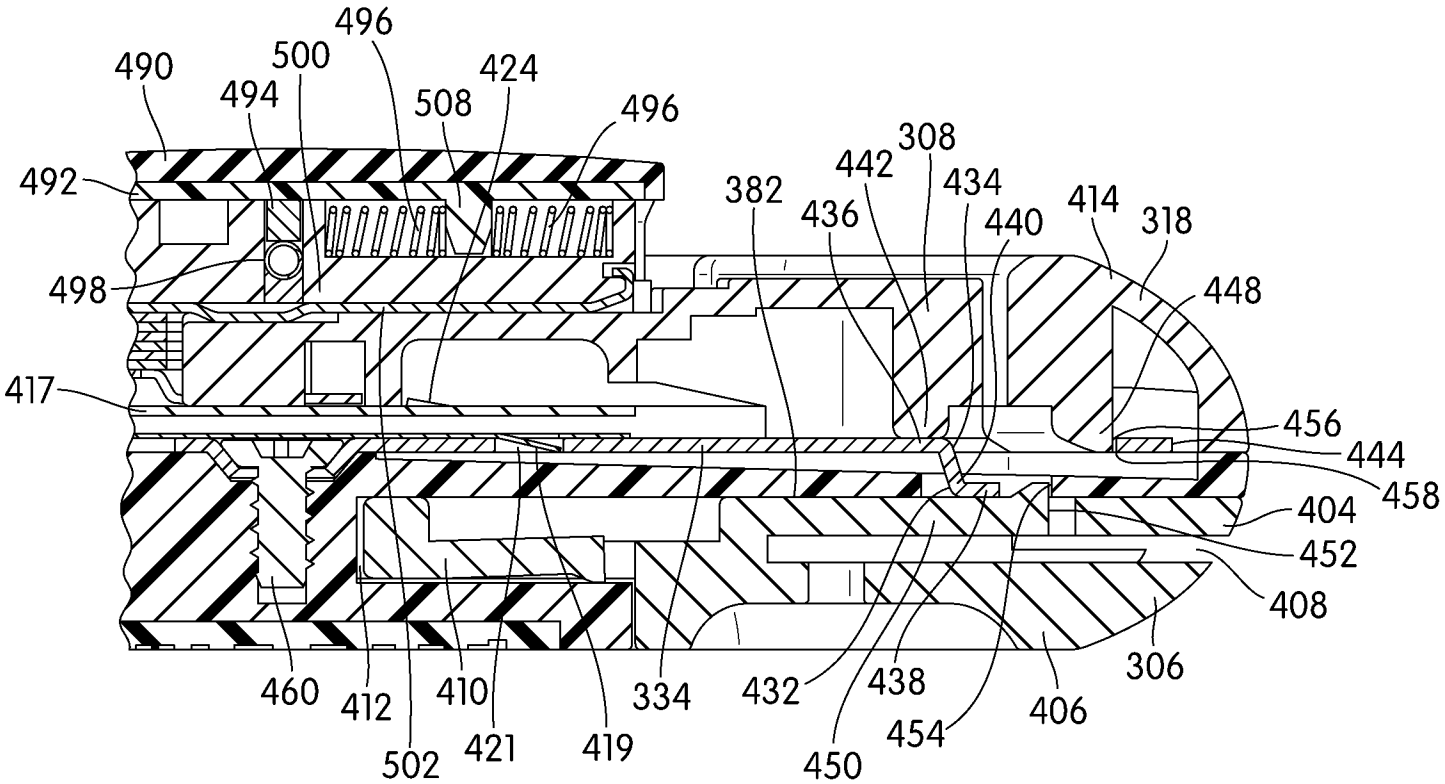
FIG. 42 is a partial cross-sectional side view of the knife, wherein the blade snapper and the cartridge are lockingly connected to the body in accordance to a second embodiment of the present invention.

FIGS. 29-33 show a knife 300 in accordance with another embodiment of the present invention. The knife 300 includes a body 302, a blade slider 304, a blade snapper 306, and a manually engageable lock 308. The retractable blade slider 304 is constructed and arranged to be able to position a multi-blade blade assembly 310 at a position of use wherein at least a portion of a forwardmost blade 312 projects through an opening 314 at one end 316 of the body 302, and to retract the blade assembly 310 into the body 302 so that no blades are exposed outside the body 302. The blade snapper 306 is removably locked to the body 302. The blade snapper 306 is constructed and arranged snap-off one blade from the remainder of a blade assembly 310. In one embodiment, multiple blades may be snapped-off by repeating the snap-off operation multiple times. The manually engageable lock 308 is constructed and arranged to move between a lock position (as shown in FIGS. 41 and 42) and an unlock position (as shown in FIGS. 44-47), wherein the movement of the manually engageable lock 308 to the unlock position releases the blade snapper 306 from the body 302. In one embodiment, the knife 300 includes a cartridge 318 that is removably locked to the body 302. The movement of the manually engageable lock 308 to the unlock position can, in one embodiment, release the cartridge 318 from the body 302. The cartridge 318, when removed from the body 302, is configured to receive one or more new blade assemblies 310. In another embodiment, the movement of the manually engageable lock 308 to the unlock position releases the cartridge 318 and the blade snapper 306 to enable either or both to be released from the body 302.

Figure 30:
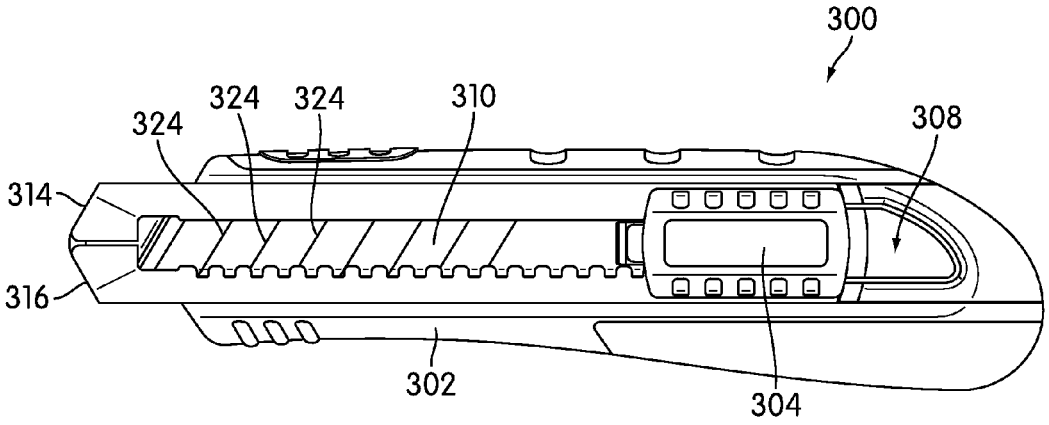
FIG. 30 is a left side plan view of the knife, wherein a multi-blade blade assembly is retracted into a body in accordance to a second embodiment of the present invention.
Figure 32:
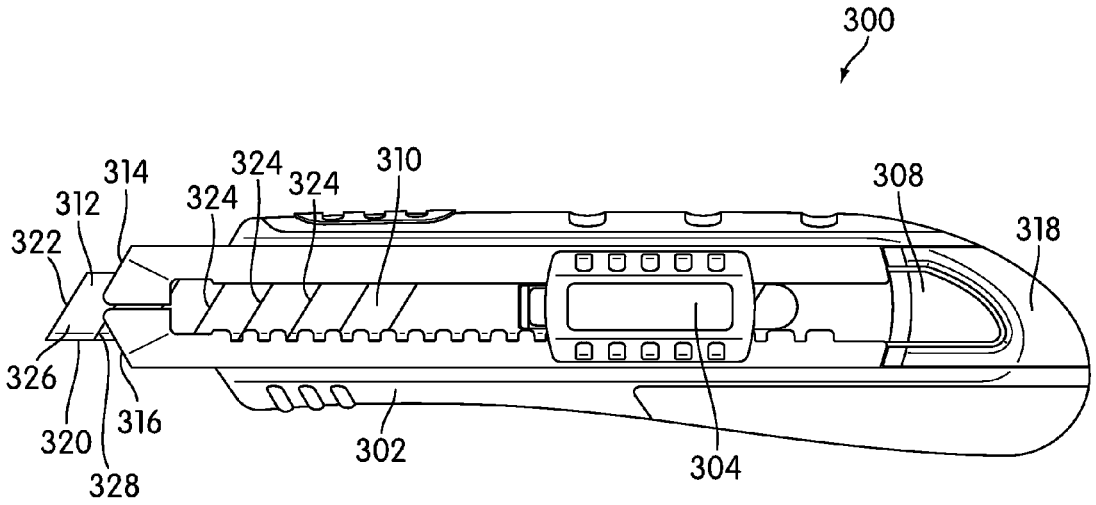
FIG. 32 is a left side plan view of the knife, wherein the blade assembly at a position of use wherein at least a forward most blade projects through an opening at one end of the body in accordance to a second embodiment of the present invention.

In one embodiment, as shown in FIGS. 30 and 32, the blade assembly 310 is the form of an elongated flat, thin strip which is sharpened along a lower edge 320 with the point of the blade being formed by the intersection of lower edge 320 and an inclined front edge 322. In one embodiment, the blade assembly 310 is made of steel material. The blade assembly 310 is formed with a series of score lines 324 parallel to the front edge 322 so that when a sharp new edge 320 is required, this can be obtained by snapping off a forward section 326 of the blade assembly 310 at the leading score line 328. In one embodiment, as discussed previously, the blade snapper 306 can be used to snap-off one blade from the blade assembly 310.

Figure 48:
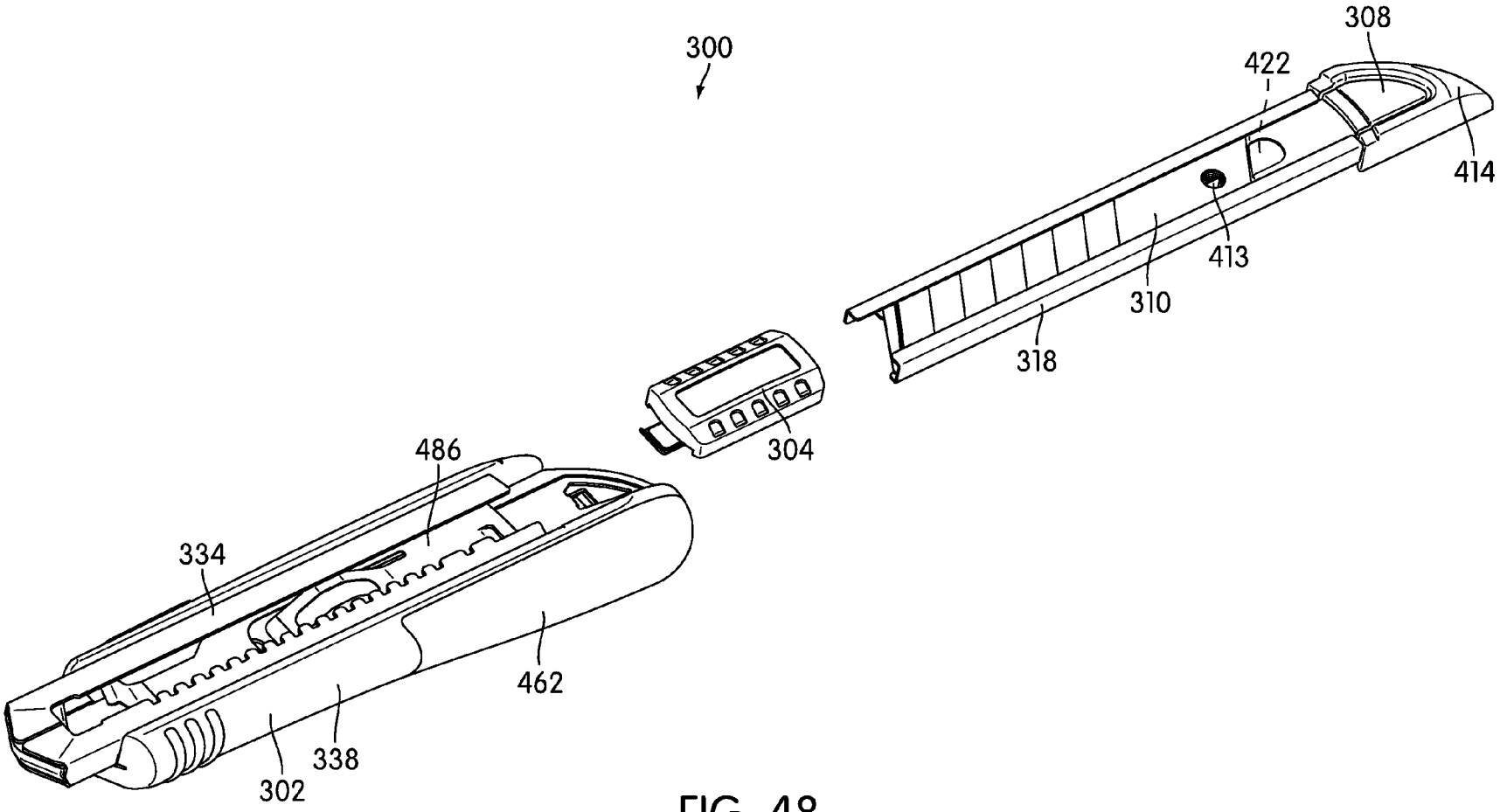
FIG. 48 is an exploded view of the knife in accordance to a second embodiment of the present invention.

Referring to FIG. 48 which shows an exploded view of the knife 300. FIG. 48 shows the assembled body 302, the assembled retractable blade slider 304, and the assembled cartridge 318.

Figure 49:
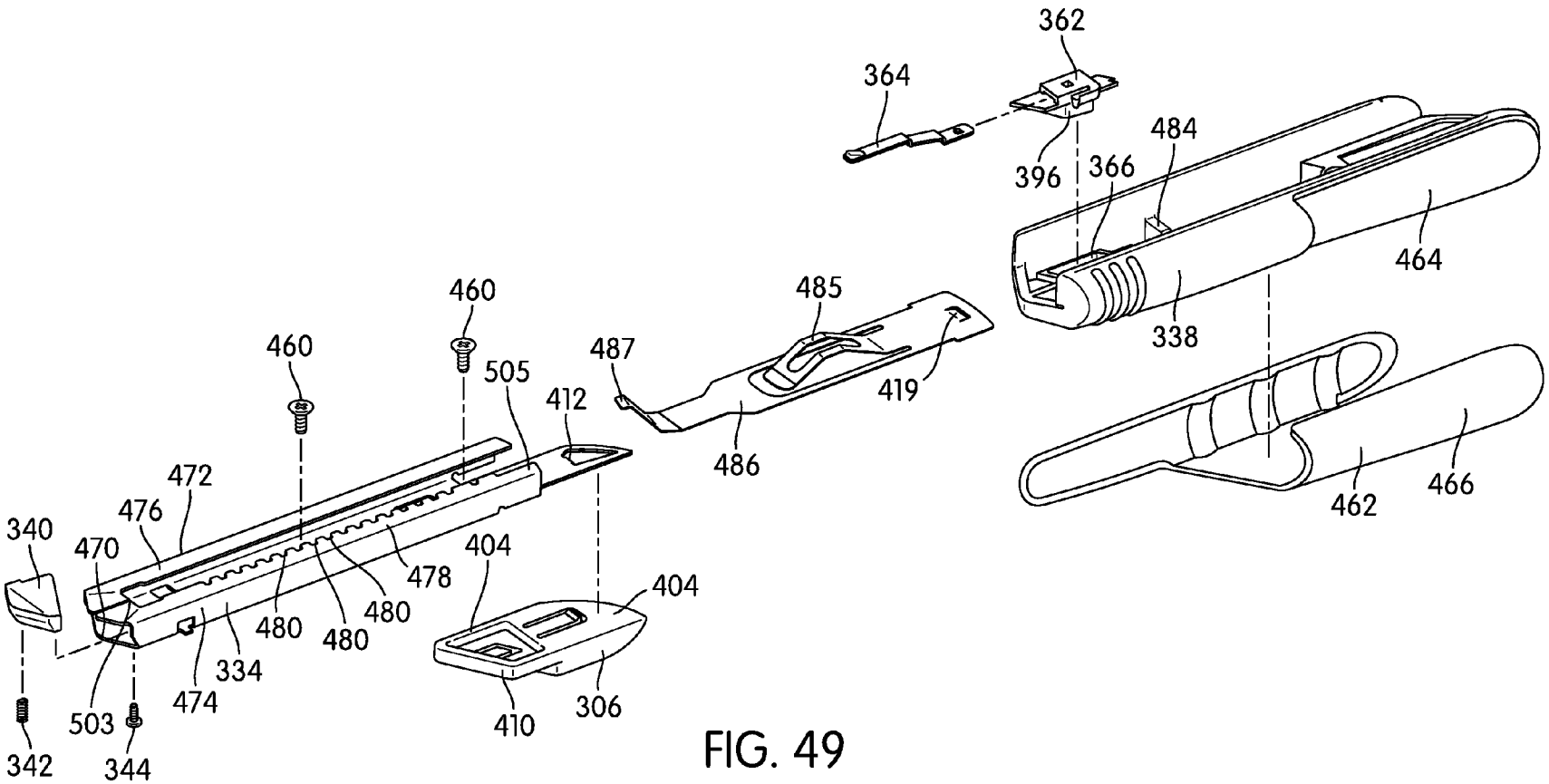
FIG. 49 is another exploded view of the knife in accordance to a second embodiment of the present invention.

FIG. 49 shows an exploded view of the body 302. The body 302 includes a barrel 334 and a body portion 338. The body portion 338 is constructed and arranged to receive the barrel 334 therewithin. In one embodiment, the barrel 334 is constructed and arranged to be connected to the body portion 338 using a threaded or other type of conventional fastener 460 (two are shown in the illustrated embodiment). In one embodiment, the body portion 338 of the knife 300 is made from a bi-material plastic material to provide light weight, and corrosion resistance.

In one embodiment, the barrel 334 includes a base wall 470, a pair of opposing side walls 472 and 474, and a pair of top wall portions 476 and 478. In one embodiment, the barrel 334 is generally molded as a unitary structure. In one embodiment, the top wall portion 478 includes a series of notches 480 formed at regular intervals spaced at a desired distance for incremental locking positions as the blade assembly 310 is being advanced forward.

In one embodiment, the body portion 338 includes an opening 366 that is constructed and arranged to receive a manually engageable portion 396 of an actuator portion 362 of a clamp assembly 360 as will be described in detail with respect to FIGS. 36-38. In one embodiment, the body portion 338 may include one or more supporting ribs 484 (one show in the illustrated embodiment) that are constructed and arranged to support the barrel 334, when the barrel 334 is disposed in the body portion 338. In one embodiment, one end of the body portion 338 is constructed and arranged to receive the blade snapper 306. Specifically, as will be discussed in more detail with respect to FIGS. 41 and 42, the body portion 338 includes a notch 412 that is constructed and arranged to receive an extension member 410 of the blade snapper 306, and at least a portion of an upper portion 404 of the blade snapper 306 is disposed to rest against a surface portion 482 of the body portion 338 as shown in FIGS. 41 and 42.

Figure 29:
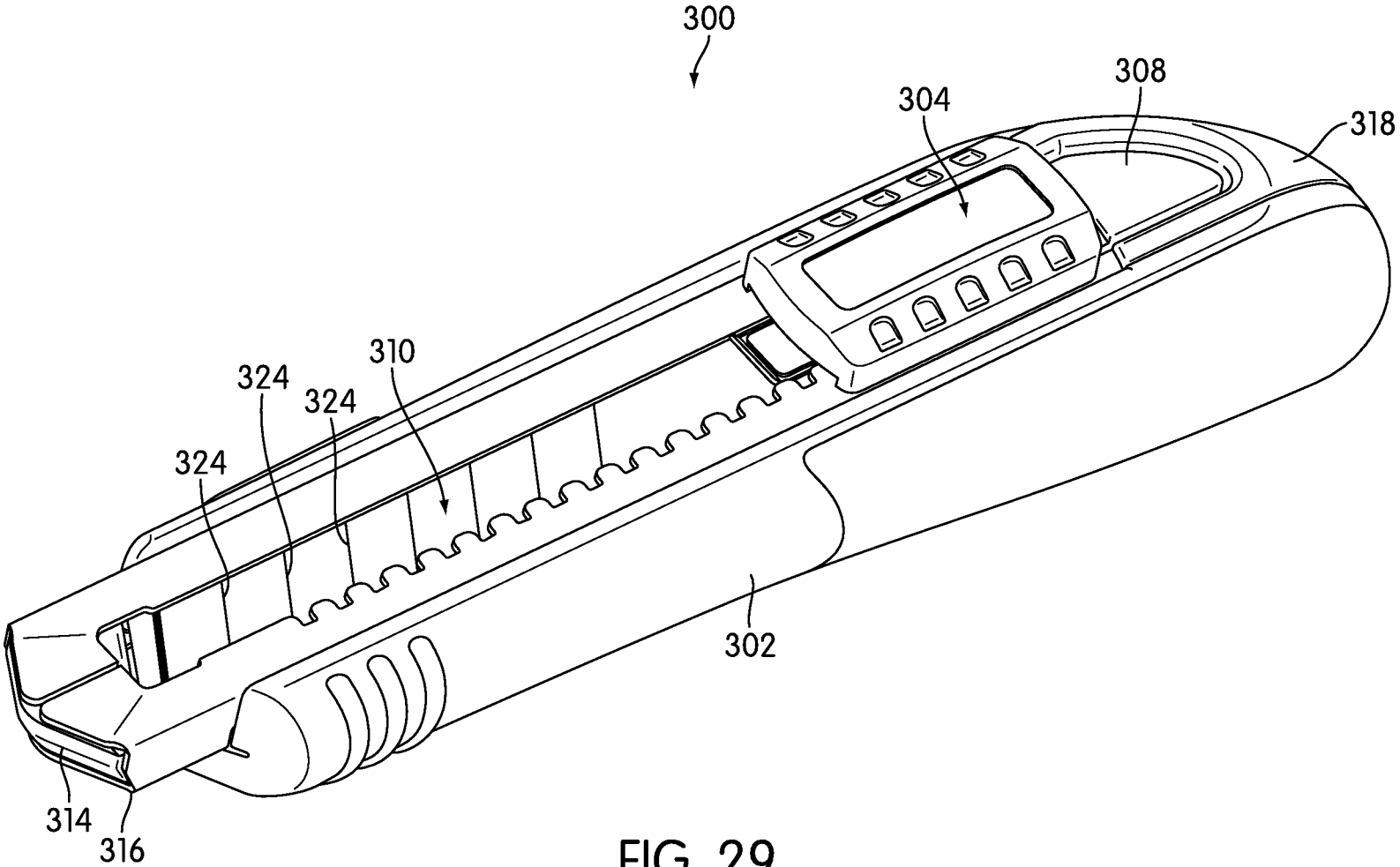
FIG. 29 is a perspective view of a knife in accordance to a second embodiment of the present invention.
Figure 39:
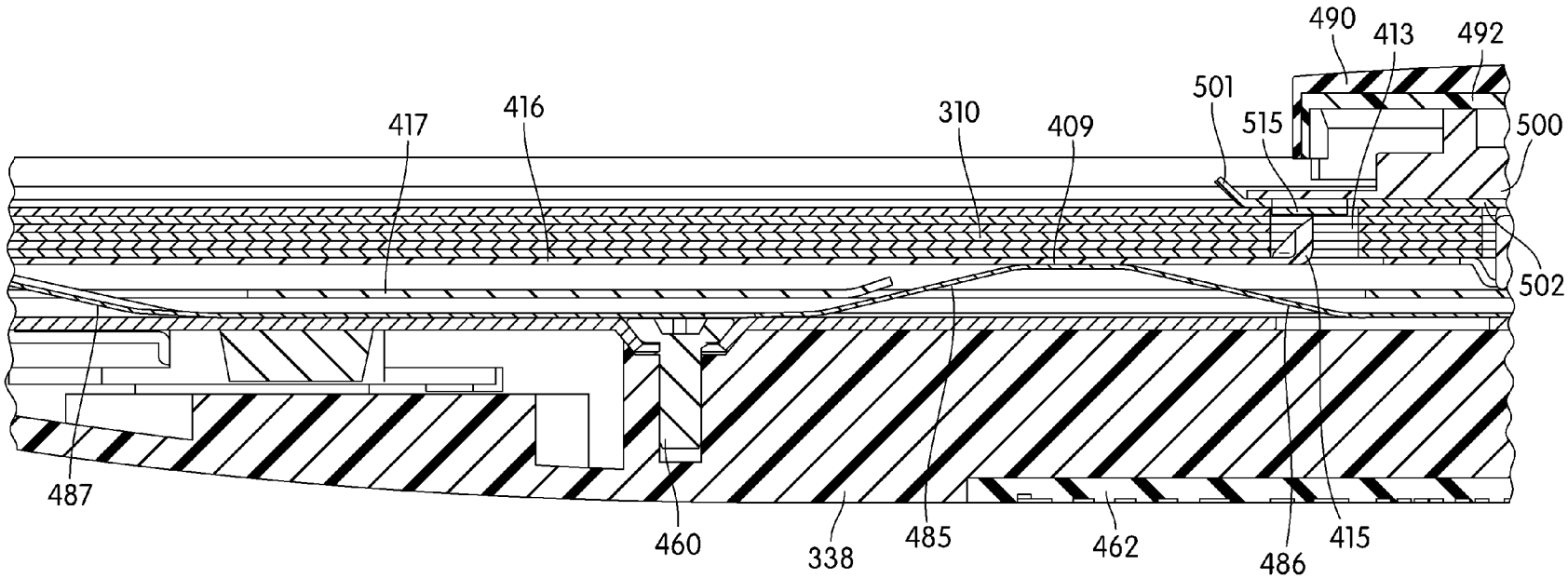
FIG. 39 is another partial cross-sectional side view of the knife, wherein resilient portions of a cartridge spring provide a force upwardly against portions of a blade platform portion, thus, securing a blade assembly in a cartridge in accordance to a second embodiment of the present invention.
Figure 40:
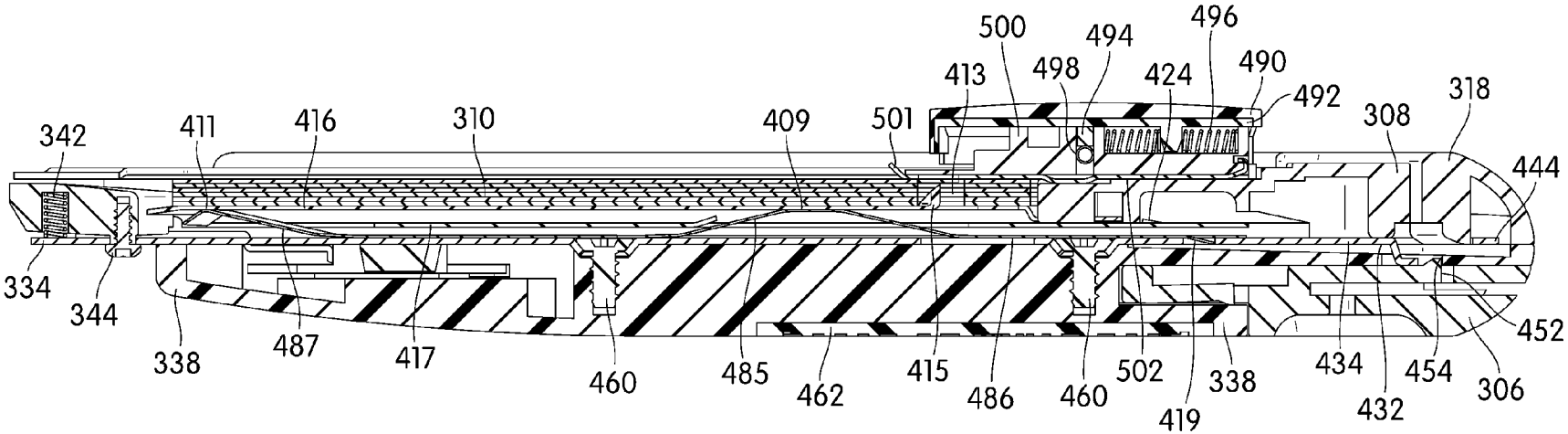
FIG. 40 is a fall cross-sectional view of the knife, wherein a blade snapper and a cartridge are lockingly connected to the body in accordance to a second embodiment of the present invention.
Figure 51:
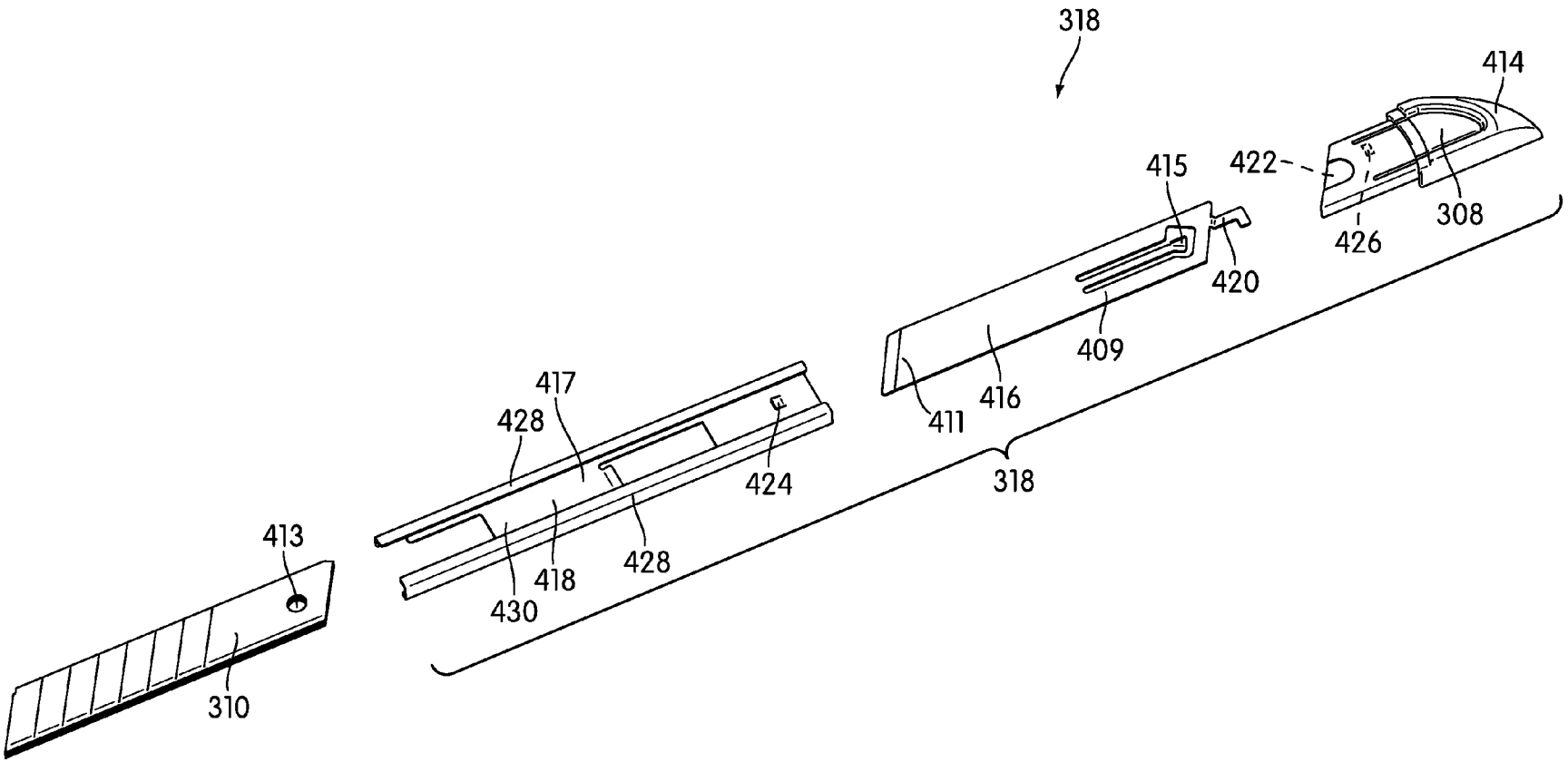
FIG. 51 is an exploded view of the cartridge in accordance to a second embodiment of the present invention.

The knife 300 also includes a cartridge spring 486 that is constructed and arranged to be received in the barrel 334 of the knife 300. In one embodiment, as shown in FIG. 49, the cartridge spring 486 includes a first resilient portion 485 and a second resilient portion 487. The first and the second resilient portions 485 and 487 are constructed and arranged to be compressed (tensioned) as the cartridge 318 is moved into the barrel 334 to a locked position (as shown in FIG. 29 and 30) and are released to their relaxed configuration as the cartridge 318 is moved out of the barrel 334. In other words, a forward portion 411 of a blade platform portion 416 (as shown in FIG. 51) of the cartridge 318 is constructed and arranged to apply force on the first and the second resilient portions 485 and 487 of the cartridge spring 487 to move the first and the second resilient portions 485 and 487 downwardly as the cartridge 318 is moved into the barrel 334 to a locked position (as shown in FIG. 29 and 30). Once the cartridge 318 is in the locked position, the first and the second resilient portions 485 and 487 of the cartridge spring 486 provide a force upwardly against a central portion 409 and the forward portion 411 of a blade platform portion 416 (as shown in FIGS. 39, 40 and 51) of the cartridge 318 respectively, thus, securing the blade assembly 310 in the cartridge 318 firmly against a pair of opposing wall portions 428 (as shown in FIGS. 39, 40 and 51) of the cartridge 318, when the cartridge 318 is in the locked position. In one embodiment, the cartridge spring 486 provides some resistance to the movement of the cartridge 318 as the cartridge 318 moves into and out the barrel 334.

In one embodiment, as shown in FIG. 49, the cartridge spring 486 has the resilient portions 485 and 487 thereof formed as a punched out leaf spring that is sized and shaped to provide a force (e.g., in a upwardly direction) that acts on the stack of the blades assemblies 310 in the cartridge 318 so that the top blade assembly 310 of the stack of the blades assemblies 310 is presented at the correct height for the blade slider 304, after a used blade assembly 310 is ejected out of the knife. In such embodiment, the first and the second resilient portions 485 and 487 of the cartridge spring 486 provide the upwardly force on the stack of the blades assemblies 310 in the cartridge 318 (as shown in FIGS. 39 and 40). In one embodiment, the top blade assembly 310 of the stack of the blades assemblies 310 contacts the underside of the cartridge 318 providing it a set datum height to enable the protrusion portion 515 on the blade slider 304 to engage in the hole 413 in the top blade assembly 310.

Figure 43:
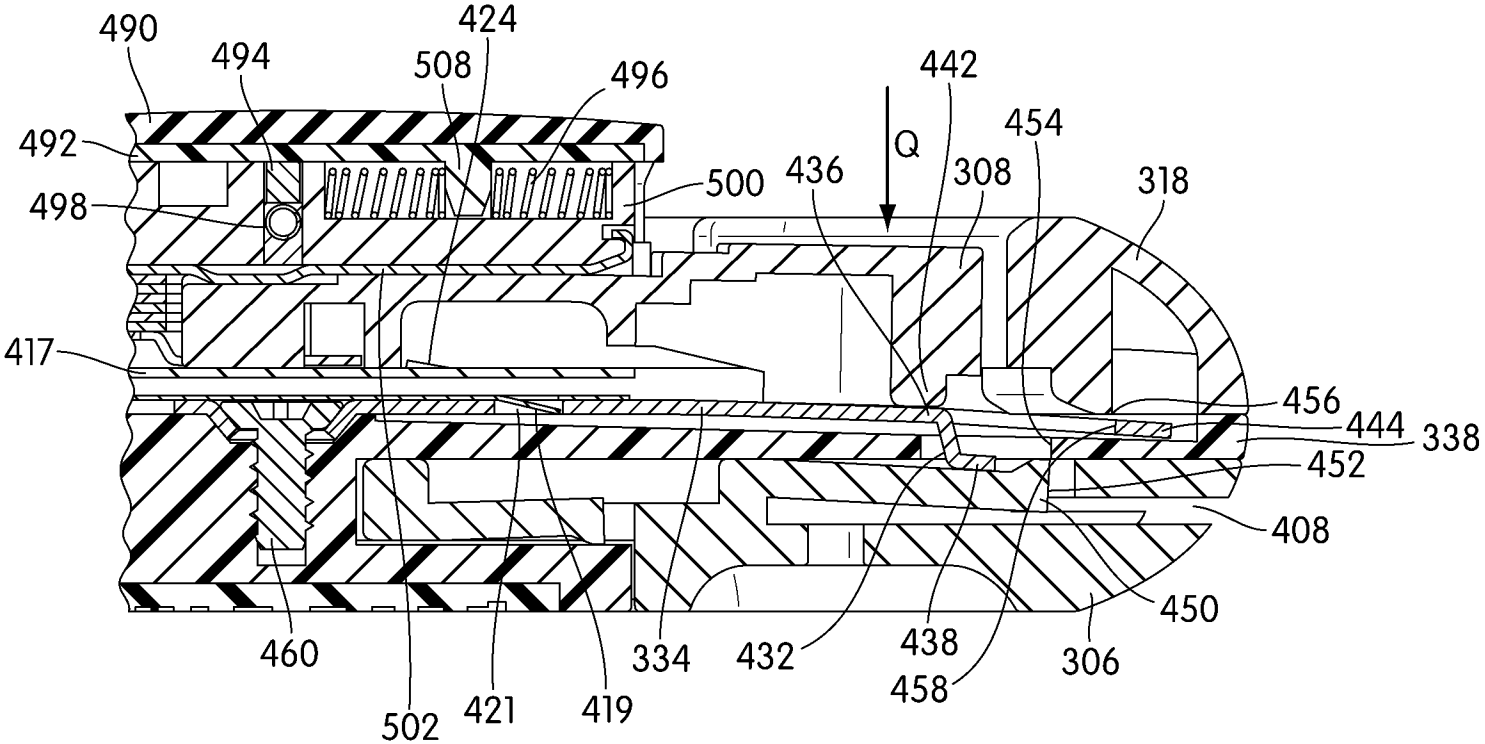
FIG. 43 is a partial cross-sectional side view of the knife, wherein a manually engageable lock is moved from a lock position to an unlock position in accordance to a second embodiment of the present invention.
Figure 44:
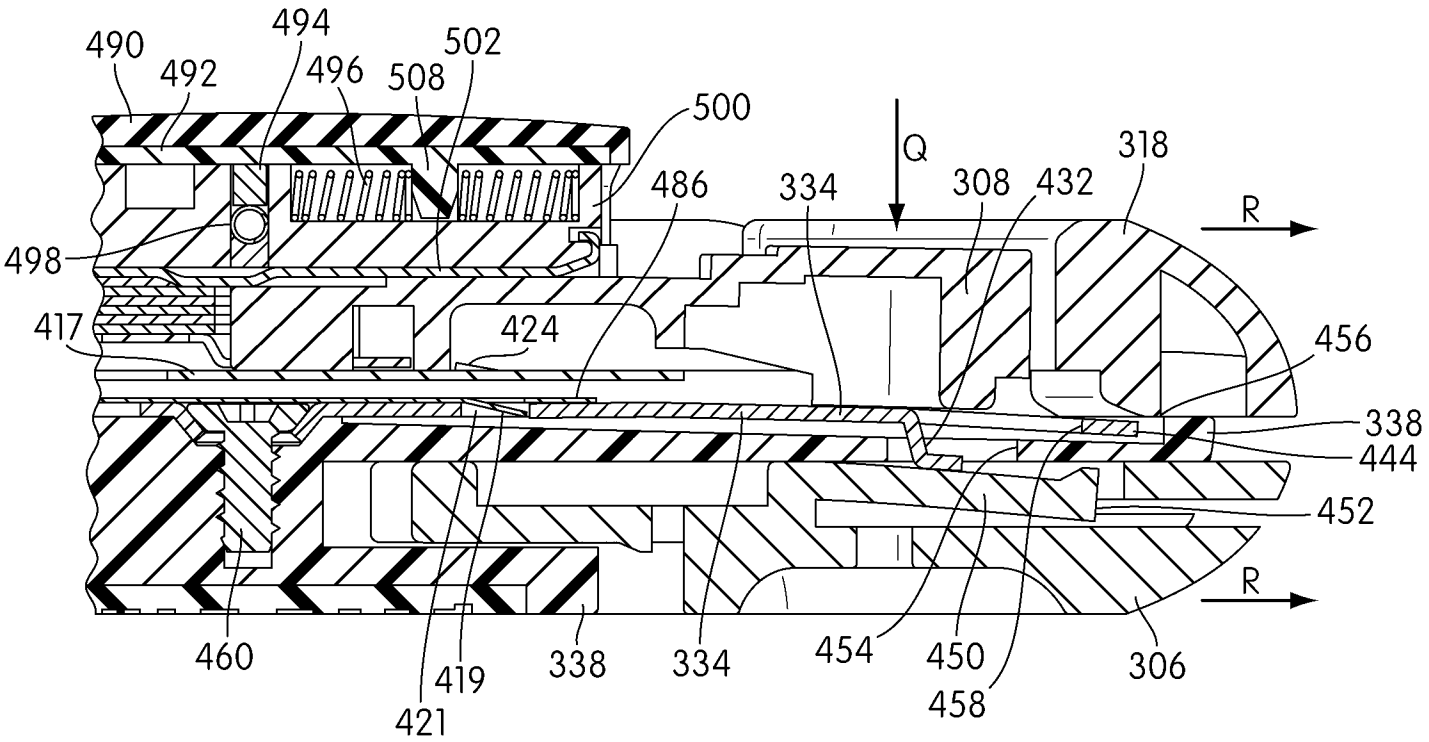
FIG. 44 is a partial cross-sectional side view of the knife, wherein the movement of the manually engageable lock to the unlock position releases the blade snapper and/or the cartridge from the body in accordance to a second embodiment of the present invention.
Figure 45:
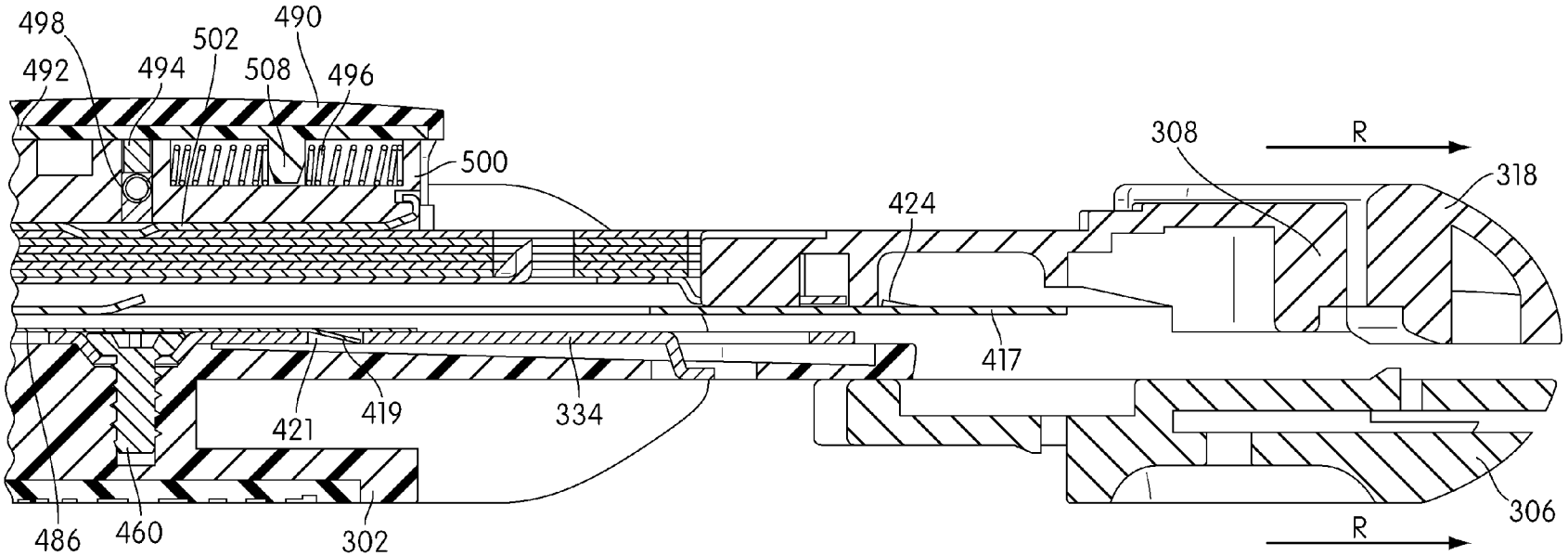
FIG. 45 is a partial cross-sectional side view of the knife, wherein the blade snapper and/or the cartridge are released from the body in accordance to a second embodiment of the present invention.
Figure 46:
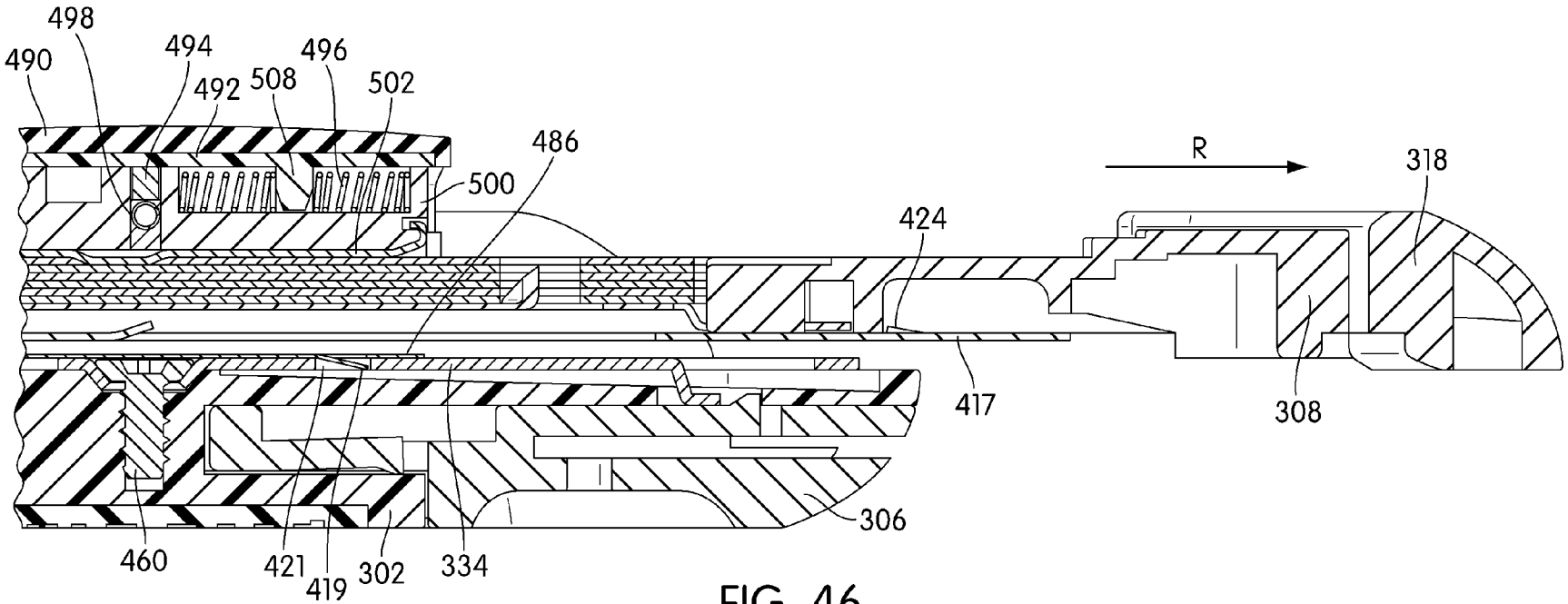
FIG. 46 is a partial cross-sectional side view of the knife, wherein the cartridge is released from the body in accordance to a second embodiment of the present invention.

As shown in FIGS. 41-47 and 49, the cartridge spring 486 includes a ramp portion 419 (e.g., downwardly protruding) that is constructed and arranged to engage with an opening 421 located in the barrel 334 so as to lock or secure the cartridge spring 486 with the barrel 334, and prevent the cartridge spring 486 from moving in the direction of an arrow R (as shown in FIGS. 44-46) along with the cartridge 318, when the cartridge 318 is being removed from the body 302 of the knife 300.

As seen in FIG. 49, for example, in one embodiment, a gripping member 462 is mountable on the body portion 338 in a position to engage the palm of a gripping hand to provide the palm with a comfortable gripping surface. In one embodiment, the gripping member 462 is preferably made of a suitable molded plastic material. In another embodiment, the gripping member 462 is preferably made of a bi-material suitable molded plastic material and is coated with a layer of an elastomeric material, such as a rubber based material. In one embodiment, the body portion 338 includes a recess 464 that is constructed and arranged to receive the gripping member 462 therewithin. The gripping portion 462 is connected to the body portion 338 using any attachment mechanism as would be appreciated by one skilled in the art. In one embodiment, the attachment mechanism includes, but not limited to, welding, fastening, friction fitting, snap fitting, or adhesive bonding. In one embodiment, a lower portion 466 of the gripping member 462 is contoured or arranged to more comfortably accommodate the fingers of the user rather than the palm. In the illustrated embodiment, the gripping member 462 and the body portion 338 are shown as two separate parts, however, it is contemplated that in another embodiment the gripping member 462 may be integrally formed with the body portion 338 of the knife 300.

Figure 34:
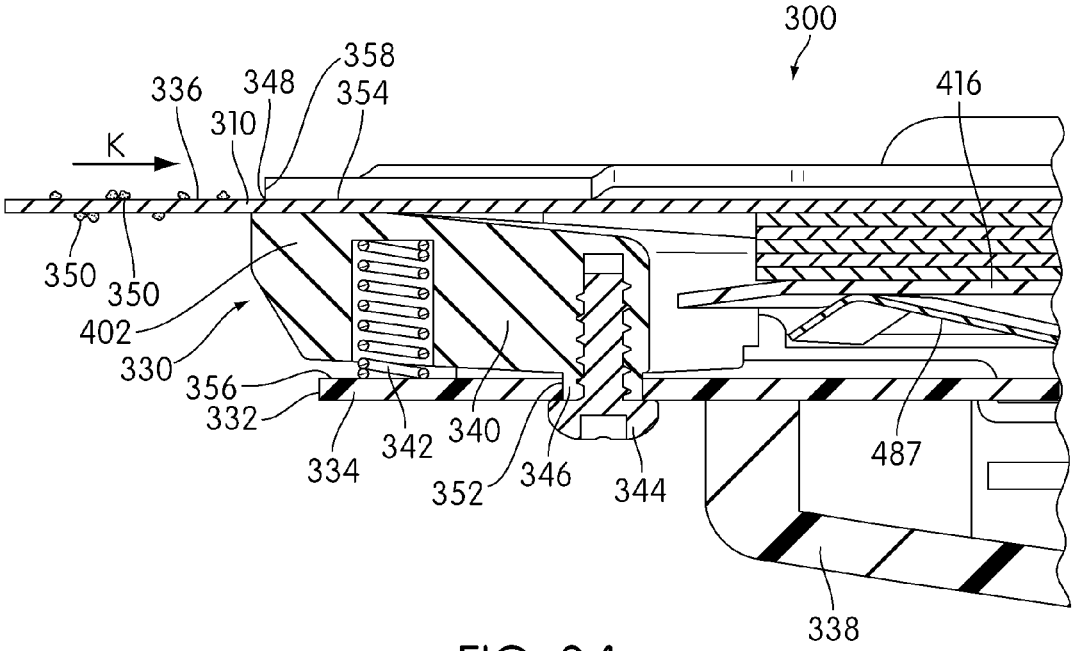
FIG. 34 is a partial cross-sectional side view of the knife, wherein a wiper member rests on the side surfaces of the blade assembly when the blade assembly projects through the opening at the one end of the handle in accordance to a second embodiment of the present invention.
Figure 35:
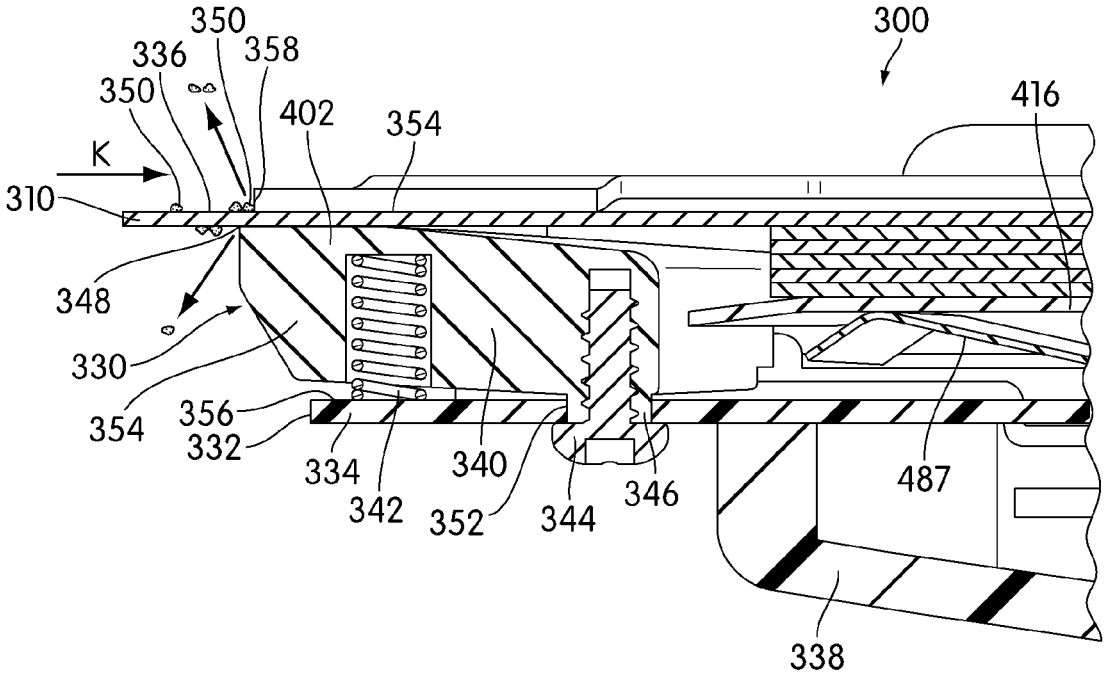
FIG. 35 is a partial cross-sectional side view of the knife, wherein the wiper member removes debris from the side surfaces of the blade assembly when the blade assembly is retracted into the handle in accordance to a second embodiment of the present invention.

As shown in FIGS. 34, 35 and 49, the knife 300 includes the blade wiper 330 that comprises a blade engagement portion 340 and a spring 342. The blade engagement portion 340 of the blade wiper 330 is attached to the base wall 470 (as shown in FIG. 49) of the barrel 334 using a fastener 344 as will be described in detail with respect to FIGS. 34 and 35. The knife 300 also includes the clamp assembly 360 that comprises the manually engageable actuator portion 362, and the connector portion 364, and will be described in detail with respect to FIGS. 36-38.

Figure 50:
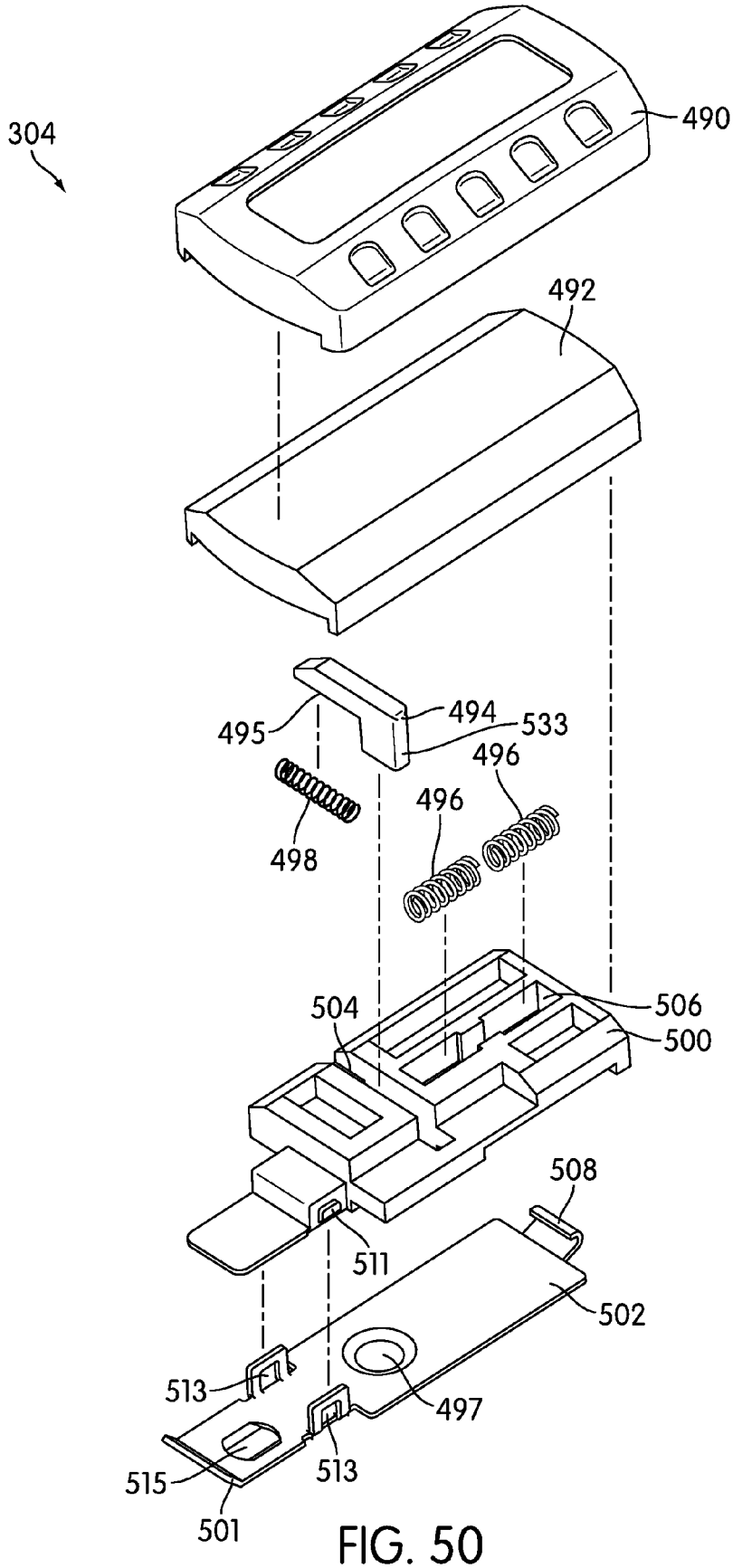
FIG. 50 is an exploded view of a retractable blade slider in accordance to a second embodiment of the present invention.

FIG. 50 shows an exploded view of the retractable blade slider 304. The retractable blade slider 304 is constructed and arranged to locate, advance and retract the blade assembly 310. The retractable blade slider 304 is constructed and arranged to ratchet on detents 480 that are located on (e.g., an inside surface) of the barrel 334 (as shown in FIG. 49). In one embodiment, an automatic release of the blade assembly 310 is enabled, when the retractable blade slider 304 is pushed to an extreme front portion of the knife 300. In one embodiment, the retractable blade slider 304 constructed and arranged to provide an audible "click stop" and the blade assembly 310 is locked against pushback in this position.

Figure 52:
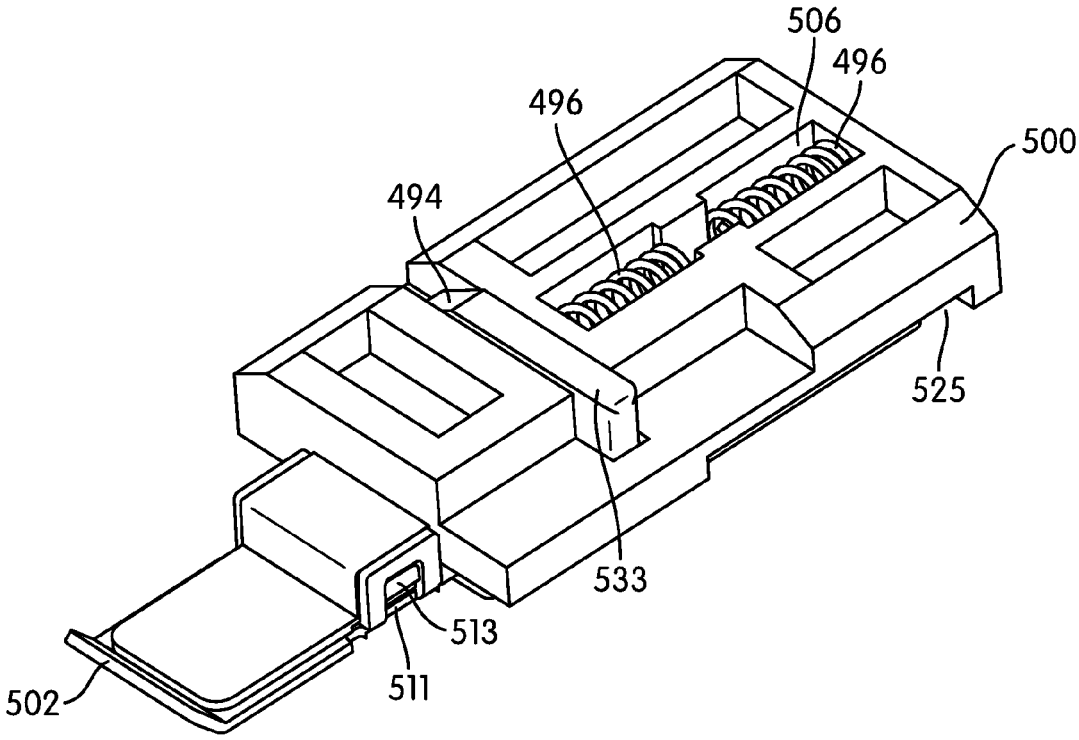
FIG. 52 is a perspective view of the first part and the second part of the retractable slider assembled together in accordance to a second embodiment of the present invention.

As shown in FIG. 50, the retractable blade slider 304 includes a grip portion 490, a cover portion 492, a movable portion 494, a pair of axially aligned coil springs 496, an orthogonal spring 498, a first portion 500 and a second portion 502. FIG. 52 shows the assembled view of the retractable blade slider 304. A cross-sectional view is shown in FIG. 41. The grip portion 490 and the cover portion 492 are connected to each other by any attachment mechanism as would be appreciated by one skilled in the art. The movable portion 494 and the spring 498 are received in an opening 504 in the first portion 500, where the spring 498 is located under the movable portion 494. The pair of springs 496 are received in an opening 506 in the first portion 500. In one embodiment, the pair of springs 496 are received on either side of a protrusion portion 508 of the cover portion 492. In one embodiment, the pair of the springs 496 are constructed and arranged to maintain the protrusion portion 508 in a centered position.

As shown in FIG. 50, the second portion 502 includes a bent portion 528 that is constructed and arranged to engage with a notch 510 (as shown in FIG. 41) in the first portion 500, and a pair of openings 513 on the second portion 502 is engaged with a pair of protrusions 511 on the first portion 500 to connect the first portion 500 with the second portion 502. FIG. 52 shows an assembled view where the first portion 500 is connected with the second portion 502. Also, as shown in FIG. 52, the pair of springs 496 are received in an opening 506 in the first portion 500, and the movable portion 494 and the spring 498 are received in the opening 504 in the first portion 500, where the spring 498 is located under the movable portion 494 in recess 495.

As shown in FIGS. 49, 50 and 51, the second portion 502 of the blade slider 304 includes an upwardly protrusion portion 501 that is constructed and arranged to engage with a front end 503 of the barrel 334, when the top blade assembly 310 is fully extended forwardly from the barrel 334. The engagement of the upwardly protrusion portion 501 with the front end 503 of the barrel 334 lifts a protrusion portion 515 of the blade slider 304 upwardly to disengage the protrusion portion 515 of the blade slider 304 from the opening 413 of the top blade assembly 310. Once the protrusion portion 515 of the blade slider 304 is disengaged from the opening 413 of the top blade assembly 310, the top blade assembly 310 (e.g., that is worn out or used) can be easily withdrawn from the barrel 334 and the blade slider 304 may be retracted (e.g., to a rear end 505 of the barrel 334) so that the protrusion portion 515 of the blade slider 304 can engage with next blade assembly 310 located on the top of the stack of blade assemblies in the cartridge 318.

Figure 54:
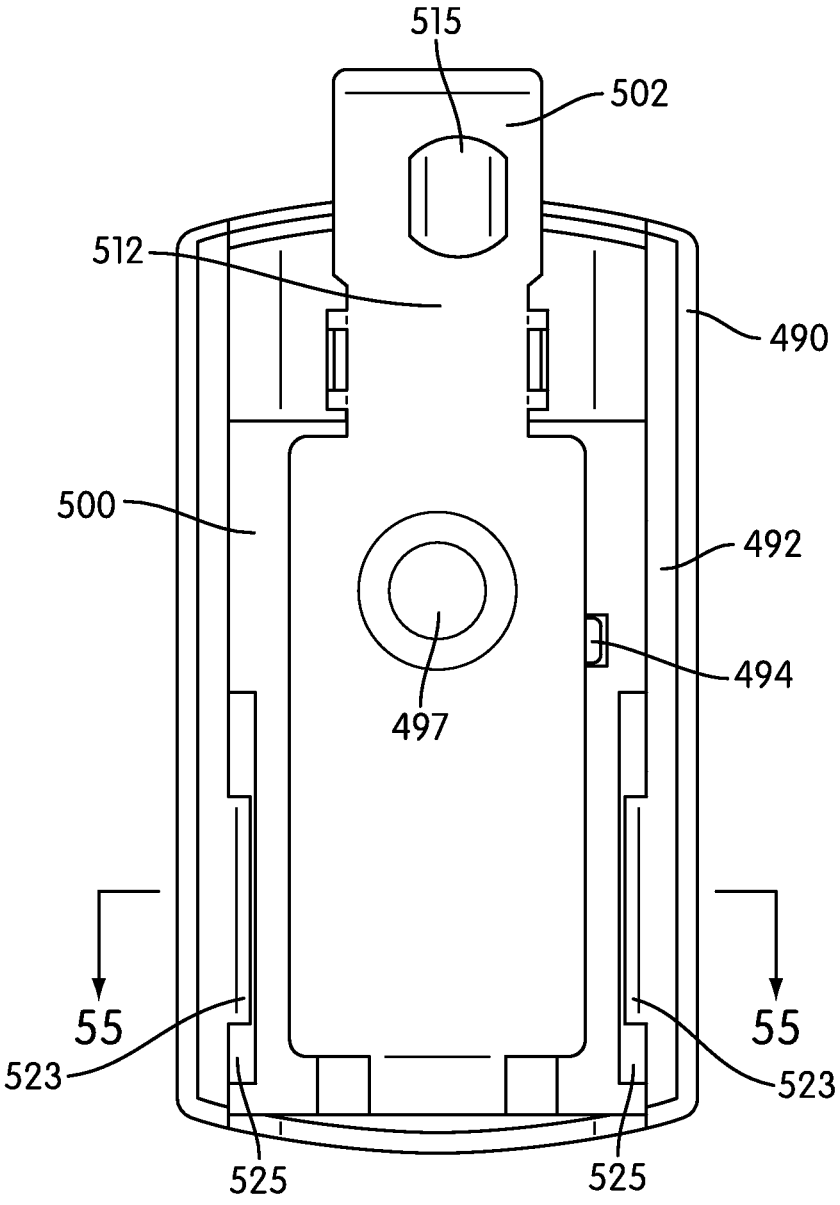
FIG. 54 is a bottom plan view of the retractable slider in accordance to a second embodiment of the present invention.

As shown in FIGS. 50 and 54, a protrusion portion 497 (e.g., protruding downwardly) on the surface portion 512 of the second portion 502 of the blade slider 304 is constructed and arranged to provide height alignment for the blade slider 304 with respect to the cartridge 318 loaded with a stack of blade assemblies 310 to ensure constant pick up height from the next new blade assembly 310 in the stack of blade assemblies 310.

Figure 53:
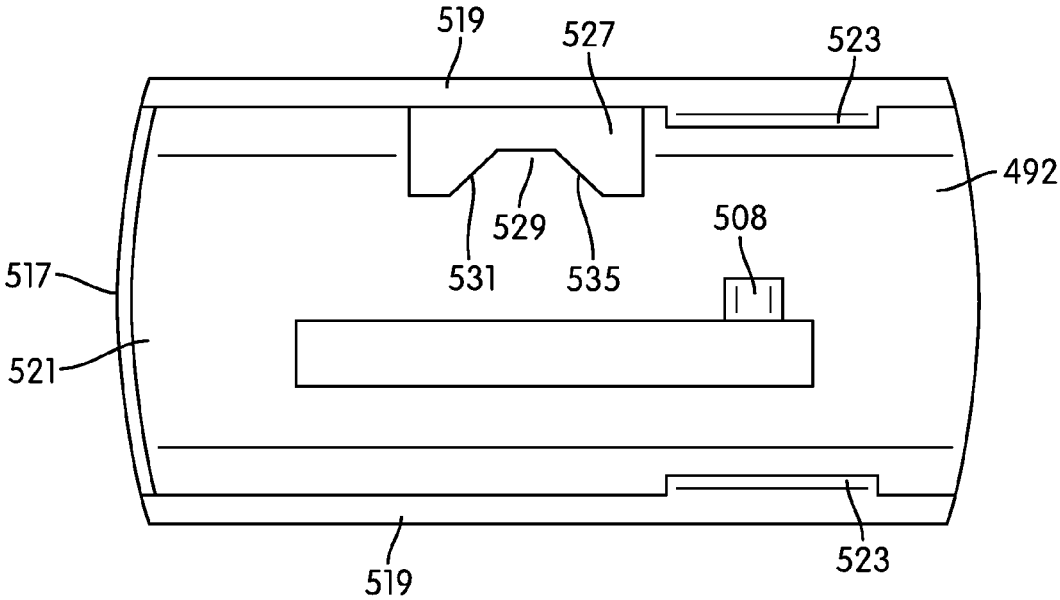
FIG. 53 is a bottom plan view of the cover portion of the retractable slider in accordance to a second embodiment of the present invention.
Figure 55A:
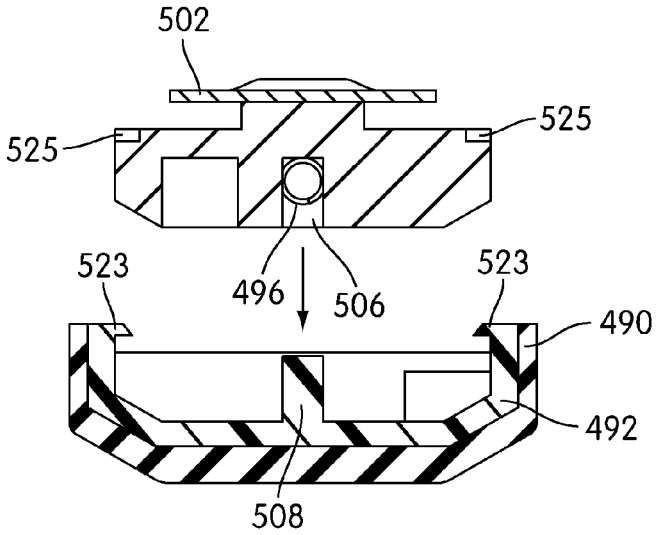
FIGS. 55A-55C are partial cross-sectional views of the retractable slider in accordance to a second embodiment of the present invention.
Figure 55B:
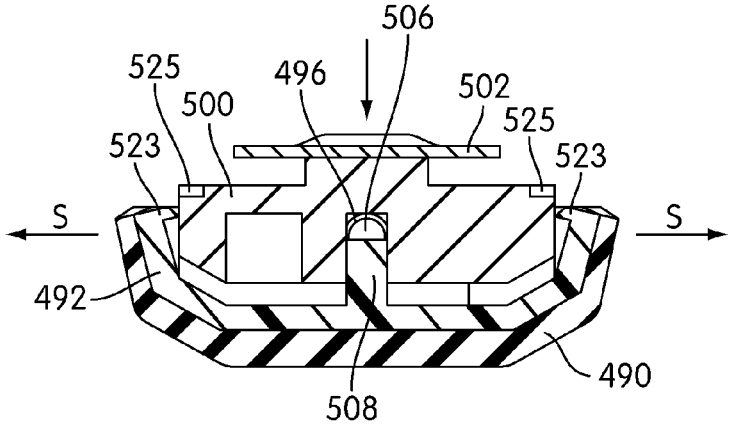

FIG. 53 shows the bottom plan view of the cover portion 492 of the retractable blade slider 304. The cover portion 492 comprises a front wall 517, a pair of side walls 519 and a top wall 521. The pair of side walls 519 includes a pair of hook-shaped portions 523 that are projecting inwardly from the pair of side walls 519. The pair of hook-shaped portions 523 are constructed and arranged to engage with a pair of grooves 525 (as shown in FIGS. 52 and 55A-B) located on the first portion 500 to enable a relative movement between the first portion 500 and the cover portion 492. As noted above, the protrusion portion 508 of the cover portion 492 is received in the opening 506 of the first portion 500 with the springs 496 located on either side of the protrusion portion 508. The top wall 521 of the cover portion 492 includes a engageable portion 527 that is constructed and arranged to engage with the end portion 533 of the movable member 494 of the retractable blade slider 304. The engageable portion 527 includes a groove 529 that is located between a pair of cam surfaces 531 and 535. The groove 529 of the engageable portion 527 is constructed and arranged to receive the end portion 533 (as shown in FIG. 52) of the movable member 494 of the retractable blade slider 304. Either one of the cam surfaces 531 and 535 can engage the end portion 533 of the movable member 494 depending on the direction engageable portion 527 is moved to force the movable member 494 inwardly (towards eleven o'clock in FIG. 52), against the bias of the spring 498.

As shown in FIG. 54, the protrusion portion 515 (e.g., protruding downwardly) on the surface portion 512 of the second portion 502 is constructed and arranged to engage with the opening 413 (as shown in FIG. 51) of the blade assembly 310 to move the blade assembly 310 in and out of the barrel 334.

Figure 55C:
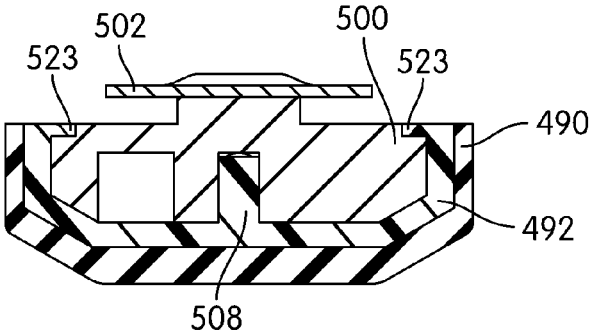
Figure 56:
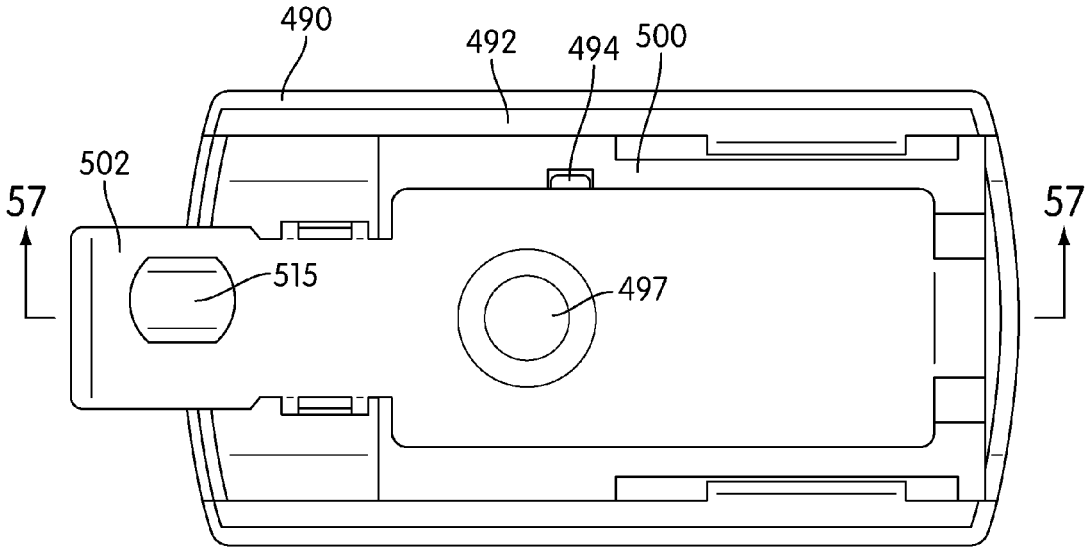
FIG. 56 is a bottom plan view of the retractable slider in accordance to a second embodiment of the present invention.
Figure 57:
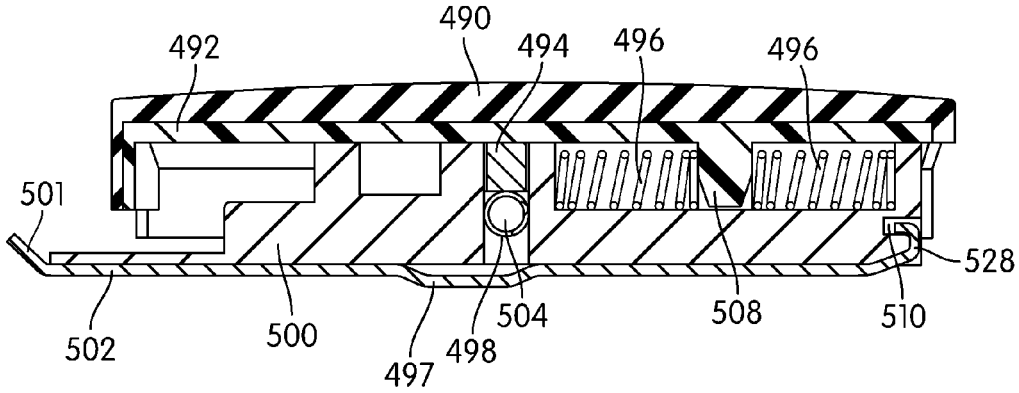
FIG. 57 is a partial cross-sectional side view of the retractable slider in accordance to a second embodiment of the present invention.
Figure 58:
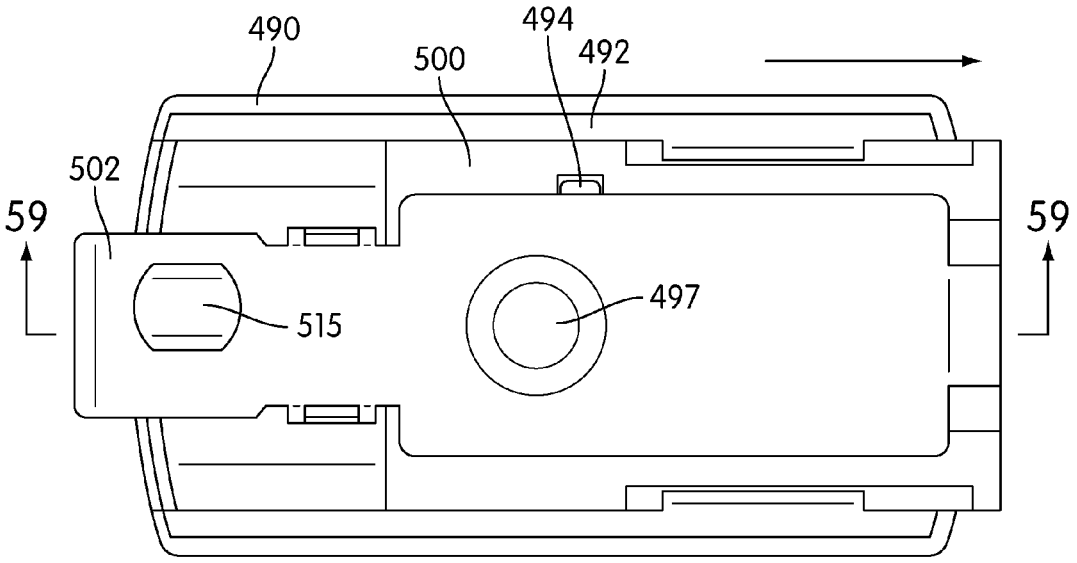
FIG. 58 is a bottom plan view of the retractable slider showing relative movement between the cover portion and the first portion of the retractable slider in accordance to a second embodiment of the present invention.

FIGS. 55A-C show the method of connecting the assembled grip portion 490 and the cover portion 492 with the assembled first and second portions 500 and 502 respectively. As the assembled first and second portions 500 and 502 are moved towards the assembled grip portion 490 and the cover portion 492, the protrusion portion 508 of the cover portion 492 is received in the opening 506 of the first portion 500, with the two springs 496 located on opposite sides of the protrusion portion 508. Also, the hook-shaped portions 523 of the cover portion 492 move outwardly in the direction of arrows S to allow the assembled first and second portions 500 and 502 to pass therebeyond. The hook-shaped portions 523 of the cover portion 492 return to their original form to engage with the pair of grooves 525 located on the first portion 500, thus, connecting the assembled grip portion 490 and the cover portion 492 with the assembled first and second portions 500 and 502 respectively.

Figure 33:
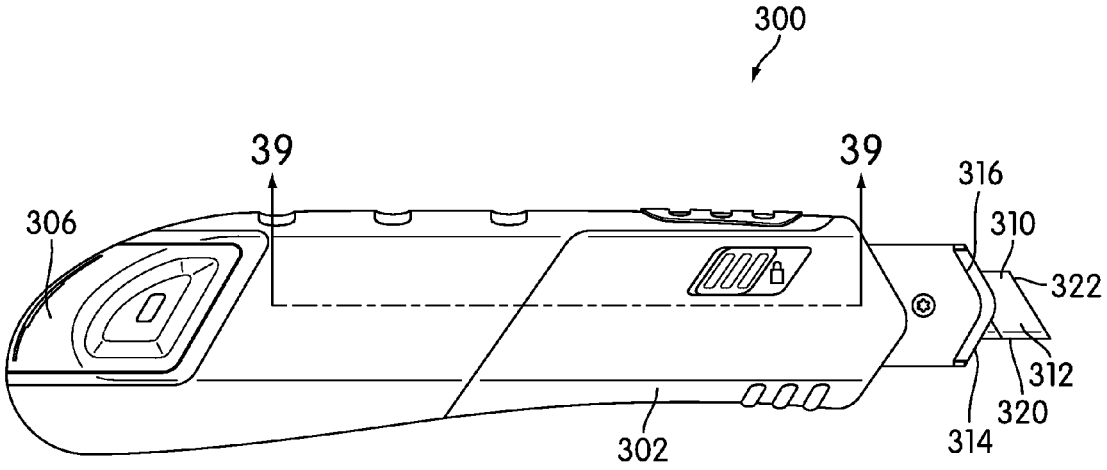
FIG. 33 is a right side plan view of the knife, wherein the blade assembly at the position of use wherein at least the forward most blade projects through the opening at one end of the body in accordance to a second embodiment of the present invention.
Figure 59:
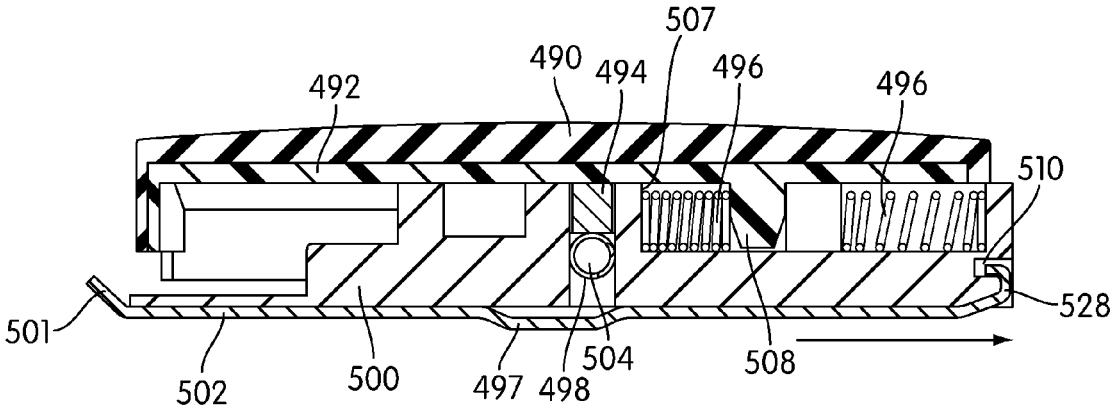
FIG. 59 is a partial cross-sectional side view of the retractable slider showing relative movement between the cover portion and the first portion of the retractable slider in accordance to a second embodiment of the present invention.

The operation of the retractable blade slider 304 is explained with respect to FIGS. 56-59. As a force is applied by a user to the grip portion 490 to move the grip portion 490 and the cover portion 492 attached to the grip portion 490 (e.g., in a forward direction), the pair of hook-shaped portions 523 of the cover portion 492 engage with and ride along the pair of grooves 525 located on the first portion 500 to enable a relative movement between the first portion 500 and the cover portion 492. This relative movement between the first portion 500 and the cover portion 492 at least partially compresses one of the springs 496 (via the protrusion 508), and causes the cam surface 531 of the engageable portion 527 to engage with the portion 533 of the movable member 494, thereby forcing the movable member 494 away from the series of notches 480 on the top wall portion 478 (as shown in FIG. 49) of the barrel 334. The spring 498 located under the movable member 494 is compressed, when the movable member 494 is forced away from the series of the notches 480 on the top wall portion 478 of the barrel 334. Also, the relative movement between the first portion 500 and the cover portion 492 causes the protrusion portion 508 of the cover portion 492 to move in the opening 506 by forcing one of the springs 496 against a portion 507 (as shown in FIGS. 50 and 59) of the opening 506. Once the movable member 494 is forced away from the series of the notches 480 on the top wall portion 478 of the barrel 334, the retractable blade slider 304 is free to move the blade assembly 310 through the opening 314 at one end 316 of the body 302 (as shown in FIGS. 32 and 33). After a desired length of the blade assembly 310 is extended out of the opening 314, the force applied on the grip portion 490 may be released by the user. This causes the spring 498 located under the movable member 494 to return to its original form and force the movable member 494 to engage with one of the notches 480 on the top wall portion 478 of the barrel 334, thus, securing the blade assembly 310 at the desired length. In this position, the movable member 494 also engages with the groove 529 located between the pair of cam surfaces 531 and 535 (as shown in FIG. 53).

Similarly, when retracting the blade assembly 310 into the cartridge 318, a force is applied by a user to the grip portion 490 to move the grip portion 490 and the cover portion 492 attached to the grip portion 490 (e.g., in a rearward direction). The pair of hook-shaped portions 523 of the cover portion 492 engage with and ride along the pair of grooves 525 located on the first portion 500 to enable a relative movement between the first portion 500 and the cover portion 492. This relative movement between the first portion 500 and the cover portion 492 compresses the other of the springs 496, and causes the other cam surface 535 of the engageable portion 527 to engage with the movable member 494 forcing the movable member 494 (against the bias of spring 498) away from the series of notches 480 on the top wall portion 478 of the barrel 334 causing the retractable blade slider 304 to move the blade assembly 310 into the cartridge 318.

FIG. 51 shows an exploded view of the cartridge 318. The cartridge 318 includes the manually engageable lock 308, an end portion 414, the blade platform portion 416, and a cartridge portion 418. In one embodiment, the blade platform portion 416 includes a connector portion 420 that is constructed and arranged to be received in an opening 422 in the end portion 414 to connect the blade platform portion 416 with the end portion 414. In illustrated embodiment, the connector portion 420 may have a L-shaped configuration. It is contemplated that the connector portion 420 may have any shape, construction and/or configuration that connects the blade platform portion 416 with the end portion 414. The cartridge portion 418 includes a barb portion 424 that is constructed and arranged to be received in an opening 426 in the end portion 414 to connect and secure the cartridge portion 418 with the end portion 414. In one embodiment, as shown in FIGS. 41-47, when the barb portion 424 is engaged with the opening 426 of the end portion 414, the relative movement between the end portion 414 and the cartridge portion 418 is prevented. In one embodiment, the blade platform portion 416 comprises a hook-shaped portion 415 that is constructed and arranged to engage with the opening 413 of each blade assembly 310 stored in the cartridge 318. The hook-shaped portion 415 is constructed and arranged to secure the blade assembly or assemblies 310 within the cartridge portion 418. The cartridge portion 418 includes the pair of opposing wall portions 428 and a bottom wall portion 417 that are constructed and arranged to provide a storage space 430 therebetween. In one embodiment, each wall portion 428 may have a C-shaped cross-sectional configuration. In one embodiment, the storage space 430 is constructed and arranged to receive one or more new blade assemblies. In one embodiment, the cartridge 318 may be configured to receive up to six blade assemblies 310. In one embodiment, a multiple blade assembly cartridge enables new cutting points to be exposed and blade assemblies changed rapidly, without the use of tools.

During assembly of the cartridge 318, the blade platform portion 416 is received in the cartridge portion 418, the connector portion 420 of the blade platform portion 416 is received in the opening 422 in the end portion 414 to connect the blade platform portion 416 with the end portion 414, and the barb portion 424 is received in the opening 426 in the end portion 414 to connect the cartridge portion 418 with the end portion 414, thus, connecting the blade platform portion 416 and the cartridge portion 418 with the end portion 414. In one embodiment, the manually engageable lock 308 is integrally molded into the end portion 414 of the cartridge 318. In one embodiment, the cartridge 318 is made of stainless steel to resist corrosion.

In one embodiment, as shown in FIG. 51, the hook-shaped portion 415 of the blade platform portion 416 of the cartridge 318 is constructed and arranged to be protruding in an upwardly direction to engage with the opening 413 of each blade assembly 310 in the stack of blade assemblies stored in the cartridge 318, except for the opening 413 of the top blade assembly 310 stored in the stack of the blade assemblies 310 stored in the cartridge 318. In other words, the hook-shaped portion 415 of the cartridge 318 does not engage with the opening 413 of the top blade assembly 310 stored on the top of the stack of the blade assemblies 310 stored in the cartridge 318.

On other hand, as shown in FIG. 50, the protrusion portion 515 on the surface portion 512 of the second portion 502 of the blade slider 304 is constructed and arranged to be protruding downwardly (e.g., in a direction opposite to the direction in which hook-shaped portion 415 is protruding) from the second portion 502 of the blade slider 304. The protrusion portion 515 of the blade slider 304 is constructed and arranged to engage with only the opening 413 (as shown in FIG. 51) of the top blade assembly 310 stored in the stack of the blade assemblies stored in the cartridge 318 to move the top blade assembly 310 in and out of the barrel 334.

As shown in FIGS. 34 and 35, the knife 300 includes a blade wiper 330 that is constructed and arranged to be positioned toward a front end 332 of the barrel 334. The blade wiper 330 is constructed and arranged to remove debris 350 from side surfaces 336 of the blade assembly 310 when the blade assembly 310 is retracted into the barrel 334. As noted above, in one, embodiment, the blade wiper 330 comprises the support portion 340 and the spring 342.

In one embodiment, a portion 346 of the support portion 340 is constructed and arranged to be attached to barrel 334 using a threaded or other type of conventional fastener 344. In one embodiment, the portion 346 of the support portion 340 is constructed and arranged to pass through an opening 352 in the barrel 334 to connect with the fastener 344, thus, attaching the support portion 340 with the barrel 334. The fastener 344 connects the portion 346 of the support portion 340 to the barrel 334 but allows the movement of a forward portion 402 of the support portion 340 between surface portions 354 and 356 of the barrel 334.

Figure 34A:
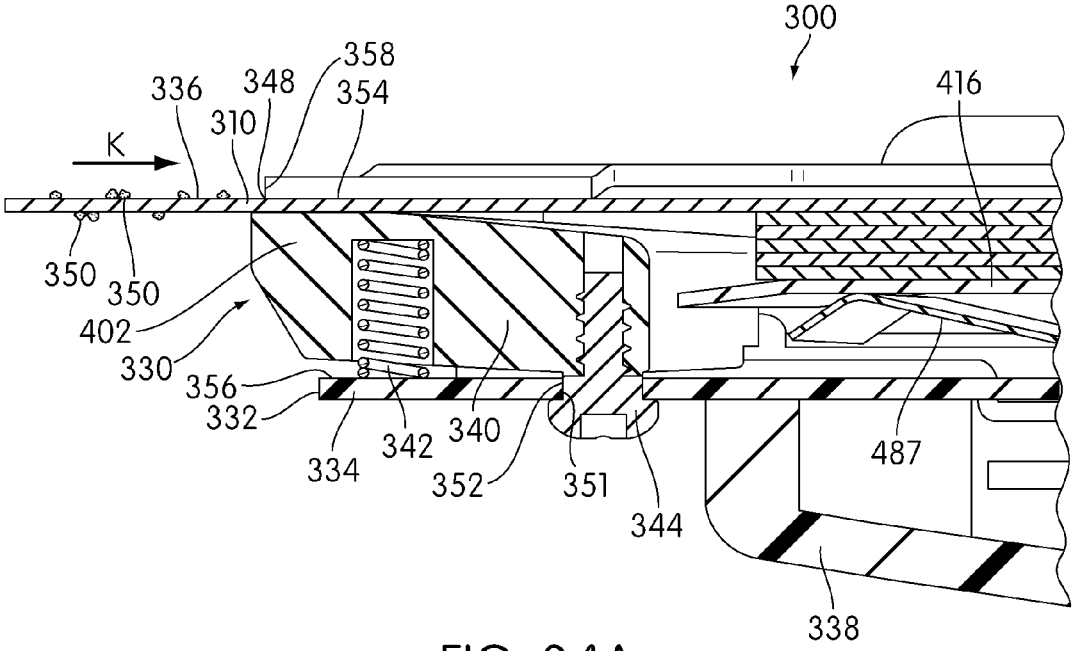
FIG. 34A is a partial cross-sectional side view of the knife, wherein a wiper member rests on the side surfaces of the blade assembly when the blade assembly projects through the opening at the one end of the handle in accordance to a second embodiment of the present invention.

In another embodiment, as shown in FIG. 34A, the fastener 344 includes a shoulder portion 351 that is constructed and arranged to pass through the opening 352 in the barrel 334 to position the fastener 344 with respect to the barrel 334, thus, attaching the support portion 340 with the barrel 334. In such embodiment, the shoulder portion 351 of the fastener 344 is constructed and arranged to functionally replace the portion 346 of the support portion 340 shown in FIG. 34. The fastener 344 connects the support portion 340 to the barrel 334 but allows the movement of a forward portion 402 of the support portion 340 between surface portions 354 and 356 of the barrel 334.

The spring 342 is constructed and arranged to apply a spring force on the support portion 340 to enable the support portion 340 to rest on the side surfaces 336 of the blade assembly 310 when the blade assembly 310 projects through an opening 348 at the one end of the barrel 334 so as to remove the debris 350 from the side surfaces 336 of the blade assembly 310 when the blade assembly 310 is retracted into the barrel 334.

The support portion 340 is made from a resilient material, such as an elastomer, plastic, resilient material, or rubber material. The resiliency of the material of the support portion 340 allows the support portion 340 to articulate about fastener 344 in multiple directions (e.g., in a longitudinal direction) about the fastener 344. In another embodiment, a support portion (or blade contacting structure) of the wiper is made from a rigid material (e.g., rigid metal), and the resiliency of the wiper is provided only by action of a biasing spring that forces the support portion against the blade assembly.

FIGS. 34-35 show the process of removing the debris 350 from the side surfaces 336 of the blade assembly 310, before the blade assembly 310 is retracted into the barrel 334, to prevent the debris 350 from entering into the barrel 334 and, thus, to minimize and to avoid possible jamming of the blade assembly 310 in the barrel 334. FIG. 34 shows the knife 300 with the blade assembly 310 at a position of use, wherein the debris 350 is located on the side surfaces 336 on the blade assembly 310. As the blade assembly 310 is retracted into the barrel 334 in the direction of an arrow K, the blade wiper 330 resting on the side surfaces 336 of the blade assembly 310 is constructed and arranged to allow the blade assembly 310 to be retracted into the barrel 334 and to simultaneously remove the debris 350 from the side surfaces 336 (both sides) of the blade assembly 310.

In one embodiment, the spring force from the spring 342 sandwiches the blade assembly 310 between the support portion 340 and the surface portion 354 of the barrel 334 so as to remove the debris 350 from the side surfaces 336 of the blade assembly 310 when the blade assembly 310 is retracted into the barrel 334. In one embodiment, the blade wiper 330 asserts the spring force at an end 358 on the surface portion 354 of the barrel 334.

By removing the debris 350 from the side surfaces 336 of the blade assembly 310 before the blade assembly 310 is retracted into the barrel 334, the debris 350 does not enter the barrel 334, and consequently does not get trapped in the barrel 334 to jam the blade assembly 310. The blade wiper 330 contacts the side surfaces 336 of the blade assembly 310 thereby removing the debris 350 from the blade assembly 310 and storing the clean blade assembly 310 in the barrel 334.

Figure 36:
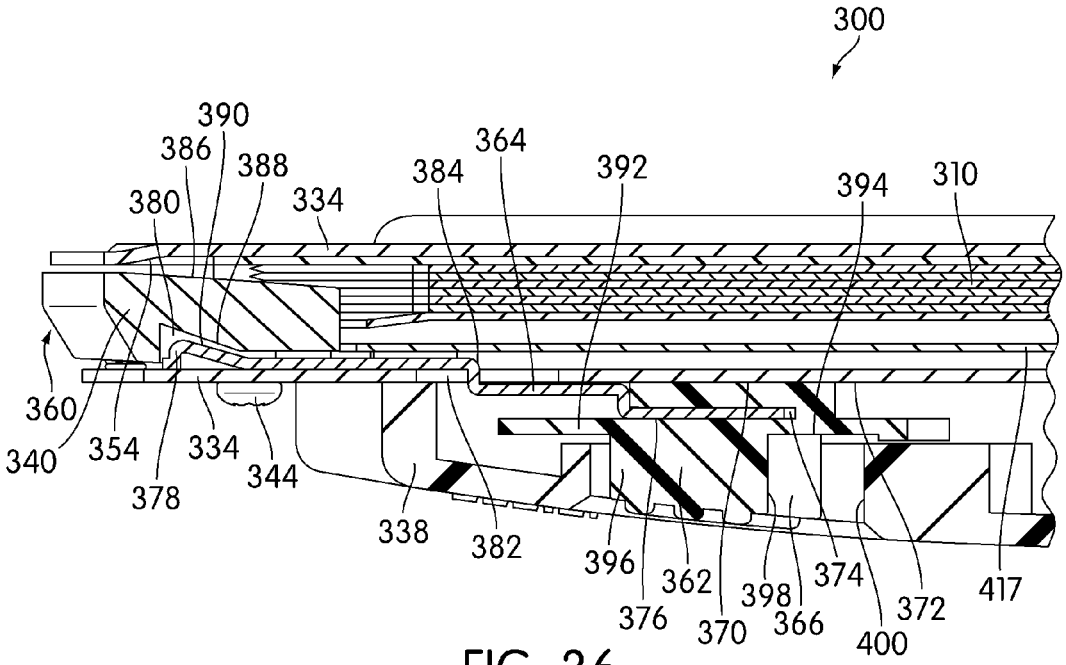
FIG. 36 is another partial cross-sectional side view of the knife, wherein the blade assembly is disposed in the handle in accordance to a second embodiment of the present invention.
Figure 37:
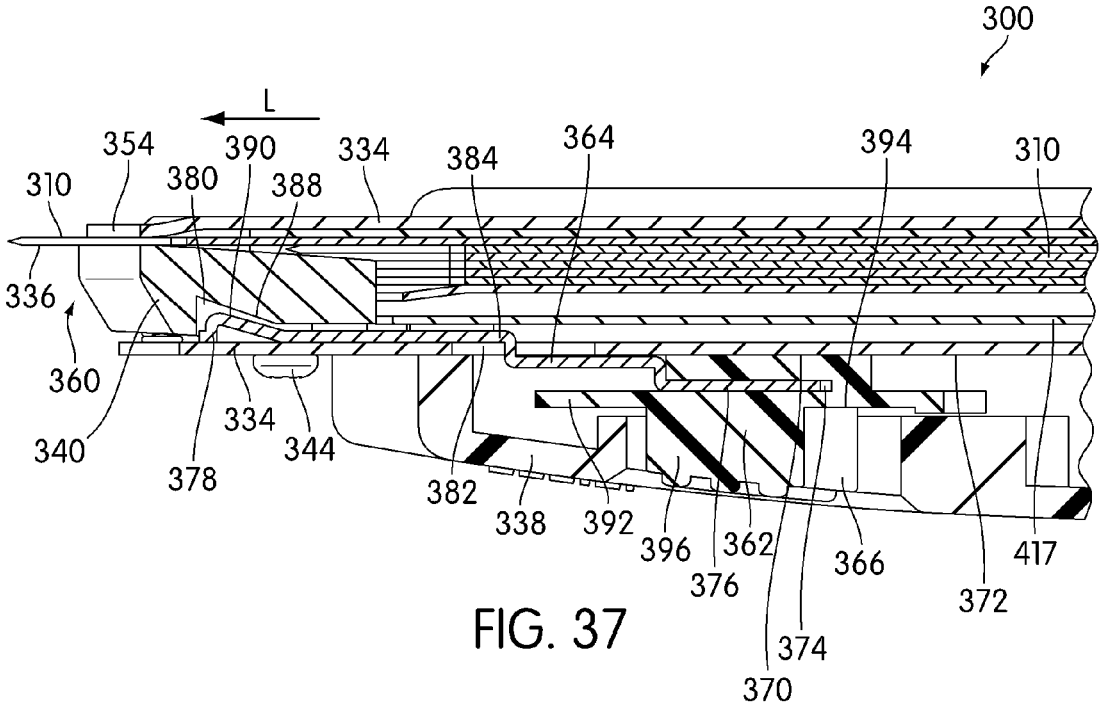
FIG. 37 is another partial cross-sectional side view of the knife, wherein the blade assembly is at the position of use wherein at least the forward most blade projects through the opening at one end of the handle in accordance to a second embodiment of the present invention.
Figure 38:
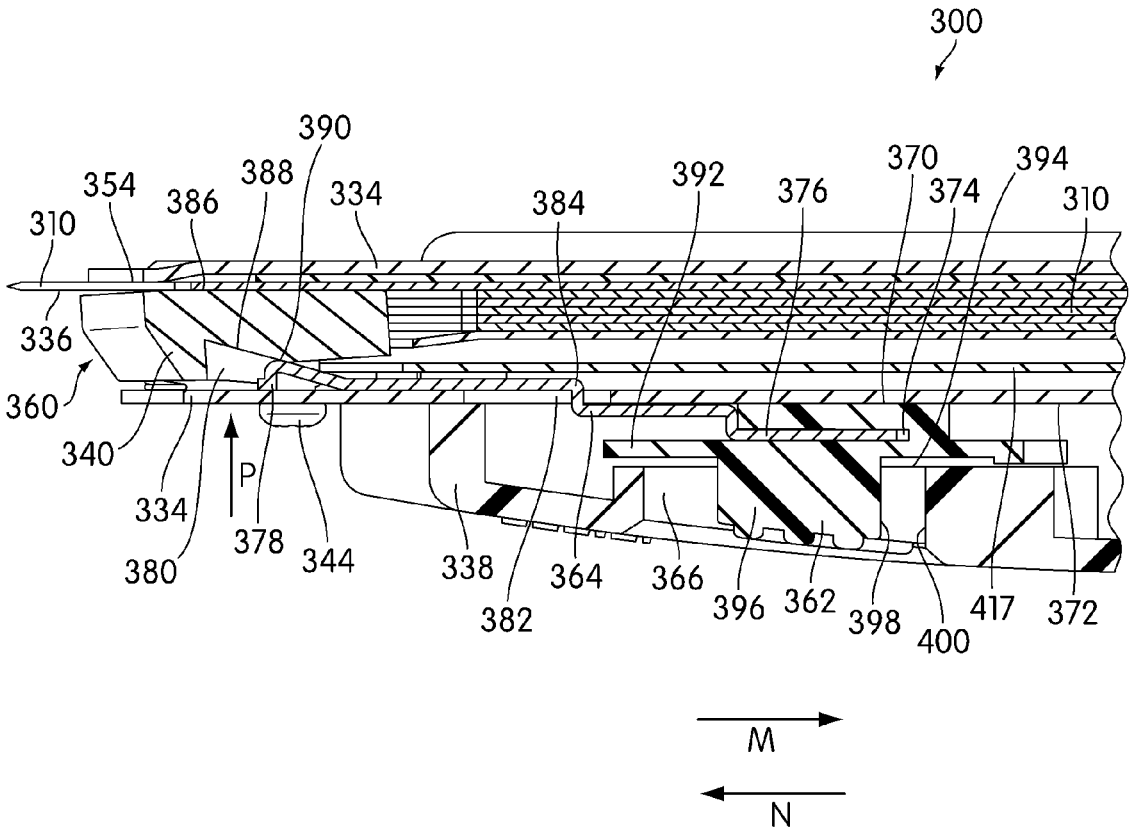
FIG. 38 is another partial cross-sectional side view of the knife, wherein the blade assembly is clamped by a clamp assembly disposed in the handle in accordance to a second embodiment of the present invention.

FIGS. 36-38 show a clamp assembly 360 that is constructed and arranged to apply a clamp force to the side surfaces 336 of the blade assembly 310. In one embodiment, the clamp assembly 360 comprises the manually engageable actuator portion 362, the connector portion 364, and the support portion 340. The clamp assembly 360 further comprises the surface portion 354 of the barrel 334 that provides an opposing clamping engagement for the blade assembly 310, when the blade assembly 310 is clamped by the clamping assembly 360.

The actuator portion 362 is manually actuatable to move (e.g., linearly) the clamp assembly 360 between the clamp position and the release position. As noted earlier, the body portion 338 of the knife 300 comprises the opening 366 constructed and arranged to receive the manually engageable portion 396 of the actuator portion 362 therewithin, wherein the manually engageable portion 396 is configured to move (e.g., linearly) within the opening 366 to move the clamp assembly 360 between the clamp position and the release position. In one embodiment, the actuator portion 362 includes a notch 374 that is constructed and arranged to receive a portion 376 of the connector portion 364 therewithin. In one embodiment, a surface portion 370 of the actuator portion 362 is disposed to rest on a surface portion 372 of the barrel 334 as the clamp assembly 360 moves between the clamp position and the release position.

As noted earlier, at one end of the connector portion 364, the connector portion 364 includes the portion 376 that is received in the notch 374 of the actuator portion 362. At the other end of the connector portion 364, the connector portion 364 includes a ramp portion 378 that is constructed and arranged to be received in a recess 380 in the support portion 340, when the clamp assembly 360 is in the release position. The barrel 334 includes an opening 382 that is constructed and arranged to allow a portion 384 of the connector portion 364 to pass therethrough. The opening 382 is constructed and arranged to facilitate the movement of the portion 384 of the connector portion 364 therethrough, when the clamp assembly 360 is moved between the clamp position and the release position.

In one embodiment, the support portion 340 (the same portion that operates as part of the wiper feature) is constructed and arranged to apply clamp force to the side surfaces 336 of the blade assembly 310. Specifically, the support portion 340 comprises a clamp surface 386 that is constructed and arranged to apply clamp force to the side surfaces 336 of the blade assembly 310. In one embodiment, the clamp surface 386 is located on a side of the support portion 340 that is opposite to the recess 380. The support portion 340 also includes cam surface portion 388.

The ramp portion 378 of the connector portion 364 includes cam surface portion 390. The relative movement of the cam surface portion 390 of the connector portion 364 with respect to the cam surface portion 388 of the support portion 340 forces the clamp assembly 360 (support portion 340 thereof) to apply clamp force to the side surfaces 336 of the blade assembly 310.

The clamp assembly 360 further comprises indicators 392 and 394 configured to provide an indication whether the clamp assembly 360 is in the clamp position or the release position. In one embodiment, the indication is visual indication. In one embodiment, the indicators 392 and 394, each correspond to the clamp position and the release position of the clamp assembly 360 respectively. In one embodiment, the indicators 392 and 394 are located on either side of the manually engageable portion 396 of the actuator portion 362.

The operation of the clamp assembly 360 is discussed with reference to FIGS. 36-38. As shown in FIG. 36, the blade assembly 310 is in a retracted position and is stored within the barrel 334 of the knife 300. In one embodiment, the grip portion 490 (as shown in FIG. 50) of the retractable blade slider 304 is manually actuated to move the blade assembly 310 disposed within the barrel 334 in the direction of an arrow L from the retracted position (as shown in FIG. 36) to an extended position (as shown in FIG. 37). In one embodiment, when the clamp assembly 360 is in the release position, and the blade assembly 310 is disposed in the barrel 334 as shown in FIG. 36, a blade clearance or a blade gap is provided between the clamp surface 386 of the support portion 340 and the surface portion 354 of the barrel 334. The blade clearance or the blade gap allows the blade assembly 310 to pass therethrough against a nominal spring force from spring 342 of the blade wiper 330.

Figure 31:
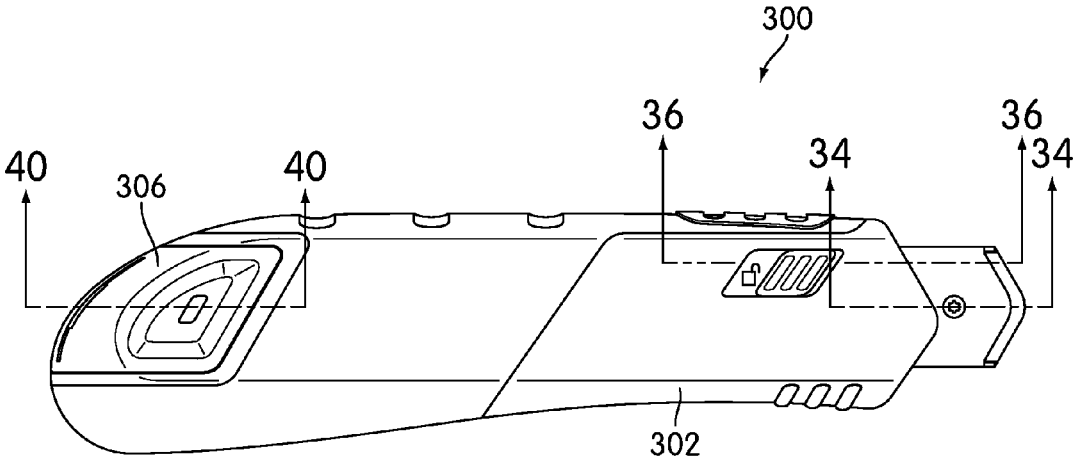
FIG. 31 is a right side plan view of the knife, wherein the blade assembly is retracted into the body in accordance to a second embodiment of the present invention.

In one embodiment, as shown in FIGS. 31, 36 and 37, when the clamp assembly 360 is in the release position and the actuator portion 362 is in a first position, the indicator 394 (i.e., the indicator for indicating the release position of the clamp assembly 360) and the manually engageable portion 396 are visible through the opening 366 in the body portion 338. In such embodiment, the indicator 392 (i.e., the indicator for indicating the clamp position of the clamp assembly 360) is positioned under a portion of the body portion 338 and is not visible through the opening 366, thus, providing an accurate indication about the position (e.g., release position) of the clamp assembly 360.

The clamp assembly 360 is moved from the release position (as shown in FIGS. 31, 36 and 37) to the clamp position (as shown in FIG. 38) by manually actuating the manually engageable portion 396 of the actuator portion 362 in the direction of an arrow M from the first position to a second position. As the manually engageable portion 396 of the actuator portion 362 is moved in the direction of the arrow M, the portion 376 of the connector portion 364 that is received in the notch 374 of the actuator portion 362 moves along with the actuator portion 362, thus, moving the connector portion 364 in the direction of the arrow M. The movement of the connector portion 364 cams the cam surface portion 390 of the connector portion 364 away from the cam surface portion 388 of the support portion 340 to apply the clamp force to the side surfaces 336 of the blade assembly 310.

When the cam surface portion 390 of the connector portion 364 is cammed away from the cam surface portion 388 of the support portion 340, the clamp surface 386 of the support portion 340 contacts and bears against the side surfaces 336 of the blade assembly 310 to exert and apply the clamp force in the direction of an arrow P on the side surfaces 336 of the blade assembly 310. As noted earlier, the surface portion 354 of the barrel 334 is constructed and arranged to provide the opposing clamping engagement for the blade assembly 310, when the blade assembly 310 is clamped by the clamping assembly 360.

As shown in FIGS. 36 and 38, an outer surface portion 398 of the actuator portion 362 is constructed and arranged to engage with inner surface portions 400 of the body portion 338, wherein the inner surface portions 400 of the body portion 338 act a stop to limit the movement of the actuator portion 362 in the direction of the arrow M beyond a maximum clamp position.

In one embodiment, as shown in FIG. 38, when the clamp assembly 360 is in the clamp position and the actuator portion 362 is in the second position, the indicator 392 (i.e., the indicator for indicating the clamp position of the clamp assembly 360) and the manually engageable portion 396 are visible through the opening 366. In such embodiment, the indicator 394 (i.e., the indicator for indicating the release position of the clamp assembly 360) is positioned under the body portion 338 of the knife 300 and is not visible through the opening 366, thus, providing an accurate indication about the position (e.g., clamp position) of the clamp assembly 360.

When the clamp assembly 360 is moved from the clamp position (as shown in FIG. 38) to the release position (as shown in FIGS. 31 and 37) by manually actuating the manually engageable portion 396 of the actuator portion 66 in the direction of an arrow N from the second position to the first position, the cam surface portion 390 of the connector portion 364 are moved towards the cam surface portion 388 of the support portion 340, and the clamp surface 386 of the support portion 340 is moved out of contact with the side surfaces 336 of the blade assembly 310, thus, releasing the clamp force applied on the blade assembly 310.

In one embodiment, the support portion 340 may be used as a clamp member to apply clamp force to the side surfaces 336 of the blade assembly 310, and may be used as a blade wiper to remove debris 350 from side surfaces 336 of the blade assembly 310 when the blade assembly 310 is retracted into the barrel 334.

FIGS. 41 and 42 show partial cross-sectional views of knife 300 with the cartridge 318 and the blade snapper 306 disposed in the body portion 338.

The blade snapper 306 includes the upper portion 404 and a lower portion 406 that are connected to each other and provide a slit 408 therebetween. The blade snapper 306 can be removed from the rear end of the knife and used to snap-off a dull or used blade portion from the front end of the blade assembly 310. Specifically, the slit 408 is constructed and arranged to receive the one blade from the blade assembly 310 to snap-off the one blade from the blade assembly 310 (along the weakened portion 324) so as to present a new blade of the blade assembly 310 for use. The blade snapper 306 includes the extended portion 410 that is constructed and arranged to be received in the opening 412 in the body portion 338, when the blade snapper 306 is disposed within the knife 300.

As shown in FIGS. 41 and 42, the barrel 334 includes a resilient member 432 at one end thereof. In one embodiment, a portion 434 of the resilient member 432 is in the form of a step structure. The portion 434 of the resilient member 432 includes a first portion 436, a second portion 438, and a ramp portion 440. The ramp portion 440 is constructed and arranged to connect the first portion 436 with the second portion 438. The first portion 436 is constructed and arranged to engage with an engageable portion 442 of the manually engageable lock 308. The second portion 438 is constructed and arranged to engage with a portion 450 of the blade snapper 306. The resilient member 432 also includes a portion 444 that is separated from the portion 434 of the resilient member 432 to provide an opening 446 therebetween. In one embodiment, the opening 446 is constructed and arranged to receive a portion 448 of the end portion 414 of the cartridge 318.

When the manually engageable lock 308 is in lock position as shown in FIGS. 41 and 42, a surface portion 452 of the blade snapper 306 is constructed and arranged to engage with a surface portion 454 of the body portion 338 to lock the blade snapper 306 with the body portion 338 against detachment from the body 302, and a surface portion 456 of the cartridge 318 is constructed and arranged to engage with a surface portion 458 of the resilient member 432 to lock the cartridge 318 against detachment from the body 302.

The operation of the manually engageable lock 308 to release the blade snapper 306 and the cartridge 318 to enable either or both to be released from the body 302 is discussed with reference to FIGS. 43-47. As shown in FIG. 43, the manually engageable lock 308 is actuated in the direction of an arrow Q. When the manually engageable lock 308 is actuated in the direction of the arrow Q, the engageable portion 442 of the manually engageable lock 308 exerts force on the first portion 436 of the resilient member 432, thus, moving the resilient member 432 in the direction of the arrow Q. Such movement of the resilient member 432 causes the second portion 438 of the resilient member 432 to exert force on the portion 450 of the blade snapper 306, thus, moving the portion 450 in the direction of the arrow Q. This movement of the portion 450 disengages the surface portion 452 of the blade snapper 306 from the surface portion 454 of the body portion 338 to release the blade snapper 306 from the body portion 338 and to enable the movement of the blade snapper 306 rearwardly in the direction of an arrow R as shown in FIGS. 44, 45 and 47.

The movement of the resilient member 432 in the direction of the arrow Q also causes the portion 444 of the resilient member 432 to move in the direction of the arrow Q disengaging the surface portion 456 of the cartridge 318 from the surface portion 458 of the resilient member 432 to release the cartridge 318 from the body portion 338 and to enable the movement of the cartridge 318 in the direction of the arrow R as shown in FIGS. 44, 45 and 46. FIGS. 44 and 45 show both the cartridge 318 and the blade snapper 306, after being released, are enabled to move in the direction of the arrow R and are removed from the body 302 of the knife 300. If desired, only one of the blade snapper 306 or the cartridge 318 can be optionally removed after the lock 308 is depressed, or both can be removed at the users option.

Figure 47:
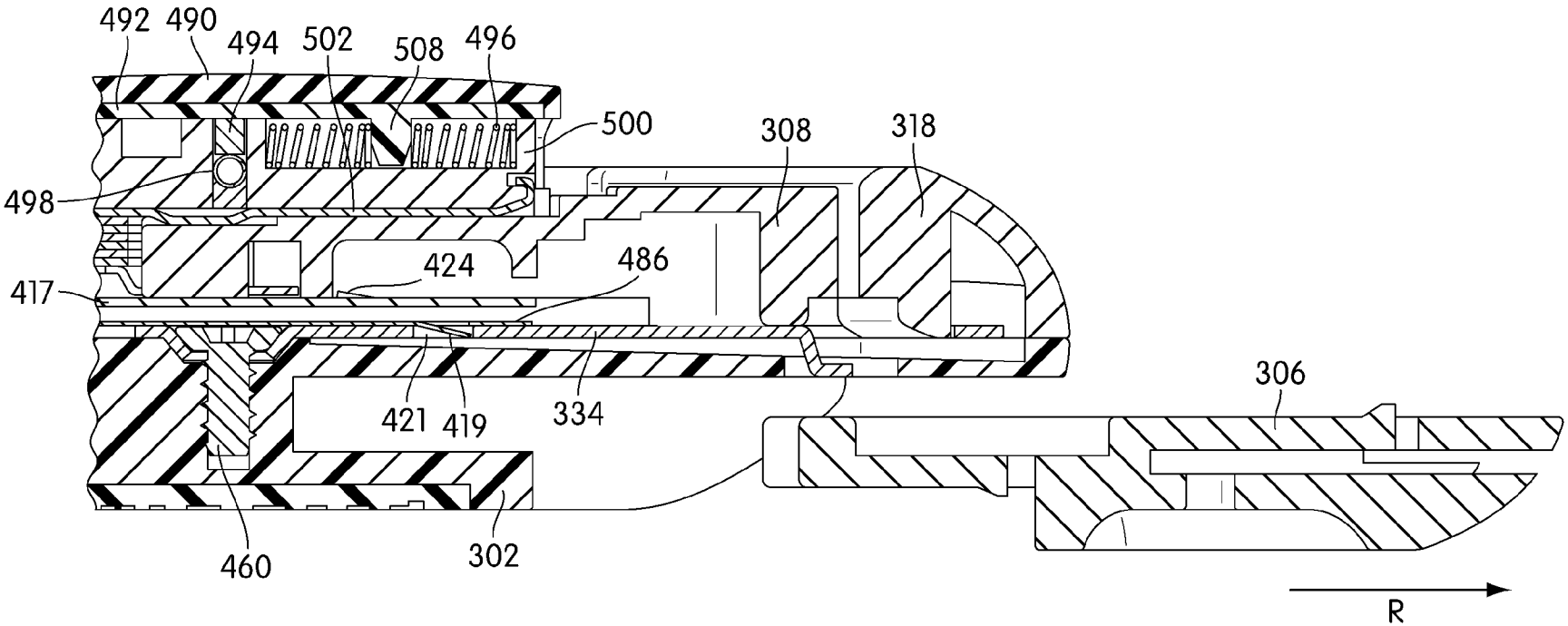
FIG. 47 is a partial cross-sectional side view of the knife, wherein the blade snapper is released from the body in accordance to a second embodiment of the present invention.

In one embodiment, when one or more blades of the blade assembly 310 are to be snapped-off from the blade assembly 310 so as to present a new blade of the blade assembly 310 for use, optionally only blade snapper 306 is removed from the body 302 of the knife 300 as shown in FIG. 47. Also, when new blade assemblies are to be received by the cartridge 318, optionally only the cartridge 318 is removed from the body 302 of the knife 300 as shown in FIG. 46. In yet another embodiment, as explained earlier, both the cartridge 318 and the blade snapper 306 may be optionally removed simultaneously from the body 302 of the knife 300 as shown in FIG. 45.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A knife, comprising:

a body;

a retractable blade slider constructed and arranged to position a multi-blade blade assembly at a position of use wherein at least a forwardmost blade projects through an opening at one end of the body, and to retract the blade assembly into the body;

a blade snapper removably locked to the body, wherein the blade snapper is constructed and arranged to snap-off at least one blade from the blade assembly;

a cartridge removably locked to the body, wherein the cartridge when removed from the body is configured to receive a new blade assembly; and a manually engageable lock constructed and arranged to move between a lock position and an unlock position, wherein the manually engageable lock is separate from the retractable blade slider, and wherein the manually engageable lock is operatively associated with both the cartridge and the blade snapper such that, in the lock position, the manually engageable lock is arranged to lock both the cartridge and the blade snapper to the body, and wherein the movement of the same said manually engageable lock from the lock position to the unlock position releases both the cartridge and the blade snapper from the body.

2. The knife of claim 1, wherein a surface portion of the blade snapper is constructed and arranged to engage with a surface portion of the body to lock the blade snapper with the body.

3. The knife of claim 2, wherein the movement of the lock from the lock position to the unlock position forces the surface portion of the blade snapper away from the surface portion of the body to unlock the blade snapper from the body to enable the blade snapper to be removed from the body.

4. The knife of claim 1, further comprising a resilient member constructed and arranged to be connected to the body, wherein a surface portion of the cartridge is constructed and arranged to engage with a surface portion of the resilient member to lock the cartridge with the body.

5. The knife of claim 4, wherein the movement of the lock from the lock position to the unlock position forces the surface portion of the resilient member away from the surface portion of the cartridge to unlock the cartridge from the body to enable the cartridge to be removed from the body.

6. The knife of claim 1, wherein the blade snapper comprises an opening constructed and arranged to receive the one or more blades from the blade assembly to snap-off the one or more blades from the blade assembly so as to present a new blade of the blade assembly for use.

7. The knife of claim 1, wherein the body comprises a barrel and a body portion.

8. The knife of claim 7, wherein the cartridge is associated with a cartridge spring positioned in the barrel and the cartridge spring is constructed and arranged to be compressed as the cartridge is moved into the barrel to a locked position and released to its relaxed configuration as the cartridge is moved out of the barrel.

9. The knife of claim 8, wherein the cartridge spring is configured to provide a force upwardly against the new blade assembly stored in the cartridge, when the cartridge is in the locked position.

10. The knife of claim 1, wherein the cartridge further comprises a blade engaging portion constructed and arranged to engage with an opening of the new blade assembly stored in the cartridge so as to secure the blade assembly within the cartridge.

11. The knife of claim 1, wherein the cartridge further comprises a plurality of wall portions constructed and arranged to provide a storage space therebetween and the storage space is constructed and arranged to receive the new blade assembly.

* * * * *